US012789047B2

(12) United States Patent
Munson, Jr. et al.

(10) Patent No.: US 12,789,047 B2
(45) Date of Patent: Nov. 10, 2026

(54) HUMAN PHYSICAL TRAINING APPARATUS AND METHODS

(71) Applicant: FOI Group LLC, Dallas, TX (US)

(72) Inventors: David M. Munson, Jr., Dallas, TX (US); David Shawn Flatt, Forney, TX (US)

( * ) Notice: Subject to any disclaimer, the term of this patent is extended or adjusted under 35 U.S.C. 154(b) by 0 days.

(21) Appl. No.: 18/982,739

(22) Filed: Dec. 16, 2024

(65) Prior Publication Data

US 2026/0166379 A1 Jun. 18, 2026

(51) Int. Cl.

| | |
|---|---|
| ***A63B 24/00*** | (2006.01) |
| ***A63B 21/00*** | (2006.01) |
| ***A63B 21/008*** | (2006.01) |
| ***A63B 69/00*** | (2006.01) |

(52) U.S. Cl.

CPC ..... *A63B 24/0075* (2013.01); *A63B 21/0087* (2013.01); *A63B 21/4047* (2015.10); *A63B 2024/0068* (2013.01); *A63B 2024/0093* (2013.01); *A63B 69/002* (2013.01); *A63B 2214/00* (2020.08)

(58) Field of Classification Search

CPC ..... A63B 69/20; A63B 69/22; A63B 69/34; A63B 69/002; A63B 24/0075; A63B 21/0087; A63B 21/4047; A63B 2024/0068; A63B 2024/0093; A63B 2214/00

See application file for complete search history.

(56) References Cited

U.S. PATENT DOCUMENTS

| | | | |
|---|---|---|---|
| 4,235,437 | A | 11/1980 | Book |
| 4,880,230 | A | 11/1989 | Cook |
| 5,439,225 | A | 8/1995 | Gvoich |
| 5,755,645 | A | 5/1998 | Miller |
| 6,119,530 | A | 9/2000 | Oddsson |
| 6,413,195 | B1 | 7/2002 | Barzelay |
| 6,679,812 | B2 | 1/2004 | Torkelson |
| 7,121,982 | B2 | 10/2006 | Feldman |
| 7,172,538 | B2 | 2/2007 | Keiser |

(Continued)

FOREIGN PATENT DOCUMENTS

| | | | | |
|---|---|---|---|---|
| WO | WO-2014080090 A1 * | 5/2014 | ..... | A63B 21/008 |
| WO | WO2025163553 A1 | 8/2025 | | |

*Primary Examiner* — Megan Anderson
*Assistant Examiner* — Jonathan A Dicuia
(74) *Attorney, Agent, or Firm* — Michael Best & Friedrich LLP

(57) ABSTRACT

A programmable exercise device comprises a frame, an exercise interface for engagement by a human trainee when performing an exercise, an assembly of interconnected joints coupled to the frame and exercise interface, and actuators to move the joints. A control system generates control signals, causing the actuators to translate the interface within a predefined exercise space according to an exercise routine program. The device can execute movements not anticipated by the trainee, including sudden changes in trajectory, velocity, or force, to improve reaction time and power, train fast twist muscles, or develop sports-specific skills. The control system receives feedback signals from sensors and can dynamically modify the movement based on them. The device enforces trainee-specific limits and collects performance data. The system enables customized, dynamic training for power, reaction time, agility, and sport-specific skills.

18 Claims, 22 Drawing Sheets

(56) References Cited

U.S. PATENT DOCUMENTS 7,201,712 B2 4/2007 Tiahrt
7,331,226 B2 2/2008 Feldman
7,491,159 B2 2/2009 Patterson
7,608,024 B2 10/2009 Sechrest et al.
7,648,450 B2 1/2010 Munson, Jr.
7,686,749 B2 3/2010 Keiser
7,695,414 B2 4/2010 Tiahrt
7,725,175 B2 5/2010 Koeneman et al.
7,762,934 B1 * 7/2010 Munson, Jr. ..... A63B 21/4045 482/112
7,846,067 B2 12/2010 Hanoun
7,914,425 B2 3/2011 Hanoun
7,998,038 B2 8/2011 Keiser
8,214,029 B2 7/2012 Koeneman et al.
8,257,284 B2 9/2012 Gruben et al.
8,287,434 B2 10/2012 Zavadsky
8,323,158 B2 12/2012 Keiser
8,360,939 B2 1/2013 Huang
8,387,437 B2 3/2013 Yamazaki
8,753,296 B2 6/2014 Einav et al.
9,126,081 B2 9/2015 Hockridge et al.
9,132,314 B1 9/2015 Giannelli et al.
9,144,705 B1 9/2015 Giannelli et al.
9,421,456 B2 8/2016 Okamoto
9,427,649 B2 8/2016 Teevens
9,457,224 B2 10/2016 Giannelli et al.
9,457,230 B2 10/2016 Giannelli et al.
9,682,276 B2 6/2017 Hockridge et al.
9,682,301 B2 6/2017 Connell
9,700,755 B2 7/2017 Giannelli et al.
9,724,563 B2 8/2017 Schmidt
9,757,614 B1 9/2017 Giannelli et al.
9,861,856 B1 1/2018 Miller
9,937,380 B2 4/2018 Giannelli et al.
10,037,711 B2 7/2018 Chauncey et al.
10,039,682 B2 8/2018 Einav et al.
10,062,301 B2 8/2018 Chauncey et al.
10,086,300 B1 10/2018 Suttell
10,105,569 B2 10/2018 Giannelli et al.
10,118,073 B2 11/2018 Wicks et al.
10,201,728 B2 2/2019 Giannelli et al.
10,328,307 B2 6/2019 Schmidt
10,335,626 B2 7/2019 Orady
10,335,631 B2 7/2019 Giannelli et al.
10,486,015 B2 11/2019 Valente
10,589,163 B2 3/2020 Orady
10,617,903 B2 4/2020 Orady
10,661,112 B2 5/2020 Orady
10,702,757 B2 7/2020 Connell
10,850,162 B2 12/2020 Wicks et al.
10,850,163 B2 12/2020 D'alesio
10,874,905 B2 12/2020 Belson
10,881,890 B2 1/2021 Orady et al.
10,918,899 B2 2/2021 Gisin
10,940,362 B1 3/2021 Foucault et al.
10,946,245 B2 3/2021 Schmidt
11,040,231 B2 6/2021 Rubin
11,058,908 B2 7/2021 Mccann
11,077,330 B2 8/2021 Orady et al.
11,110,317 B2 9/2021 Valente et al.
11,123,592 B2 9/2021 Orady et al.
11,148,003 B1 10/2021 Graham
11,219,794 B2 1/2022 Orady et al.
11,285,351 B2 3/2022 Orady et al.
11,302,213 B2 4/2022 Connell
11,324,983 B2 5/2022 Orady et al.
11,389,687 B2 7/2022 Orady et al.
11,465,006 B2 10/2022 Orady et al.
11,484,744 B2 11/2022 Orady et al.
11,524,219 B2 12/2022 Orady et al.
11,529,543 B2 12/2022 Miller
11,628,328 B2 4/2023 Valente et al.
11,628,330 B2 4/2023 Valente et al.
11,660,489 B2 5/2023 Orady et al.
11,701,537 B2 7/2023 Orady et al.
11,759,674 B2 9/2023 Foucault et al.
11,771,613 B2 10/2023 Song et al.
11,890,502 B2 2/2024 Graham
11,904,223 B2 2/2024 Orady et al.
11,918,884 B2 3/2024 Neuhaus et al.
11,931,616 B2 3/2024 Orady et al.
11,944,869 B2 4/2024 Schmidt
12,005,287 B2 6/2024 Yeh
12,042,713 B2 7/2024 Yoo et al.
12,070,642 B2 8/2024 Orady et al.
12,076,601 B2 9/2024 Orady et al.
12,097,403 B2 9/2024 Valente et al.
12,161,903 B2 12/2024 Orady et al.
12,161,907 B2 12/2024 Jones
12,172,041 B2 12/2024 Orady et al.
12,179,055 B2 12/2024 Peal et al.
12,186,620 B1 1/2025 Lawrence
12,208,298 B2 1/2025 Orady et al.
12,251,616 B2 3/2025 Neuhaus et al.
12,311,222 B2 5/2025 Neuhaus et al.
12,318,661 B2 6/2025 Barbalinardo et al.
12,330,041 B2 6/2025 Orady et al.
12,364,905 B2 7/2025 Barbalinardo et al.
12,409,359 B2 9/2025 Andrews et al.
12,440,721 B2 10/2025 Hammer
12,447,377 B2 10/2025 Yoo et al.
12,453,883 B2 10/2025 Peal et al.
12,465,800 B2 11/2025 Orady et al.
12,485,316 B2 12/2025 Yoo et al.
12,485,334 B2 12/2025 Yoo et al.
12,496,480 B2 12/2025 Til
12,527,990 B2 1/2026 Zoffoli et al.
2007/0287612 A1 12/2007 Cha
2008/0280703 A1 * 11/2008 Eldridge ..... A63B 69/0053 473/445
2014/0357430 A1 * 12/2014 Bognanno ..... A63B 69/34 473/442
2018/0034938 A1 2/2018 Huang
2019/0126092 A1 5/2019 Miller
2020/0101146 A1 4/2020 Hubbell
2020/0324158 A1 10/2020 Maynard
2021/0008428 A1 * 1/2021 León, III ..... A63B 69/32
2021/0154531 A1 5/2021 Gilstrom
2021/0170212 A1 6/2021 Lafrance
2021/0387038 A1 * 12/2021 Premachandra ... A63B 24/0087
2025/0128124 A1 4/2025 Ouyang
2025/0256153 A1 8/2025 Alenaddaf et al.
2025/0303214 A1 10/2025 Wan
2025/0367501 A1 12/2025 Chan et al.
2025/0375667 A1 12/2025 Malcolm
2026/0016849 A1 1/2026 Conti et al.
2026/0027418 A1 1/2026 Casagrande

* cited by examiner

HUMAN PHYSICAL TRAINING APPARATUS AND METHODS

FIELD OF INVENTION

The disclosure pertains to human physical exercise devices.

BACKGROUND

Strength training has been used for many years to help people recover from injury, maintain and improve health, and improve athletic performance. Strength generally refers to the ability of a human body to exert force through the activation of tension-generating sites within muscle cells called muscle contraction. Tension can be generated by muscle while shortening or being elongated by another force. Isometric muscle contraction refers to activating muscle tension without shortening the length of the muscle. Concentric contraction occurs when a muscle shortens during contraction. Contraction of the muscle while it is lengthening is called eccentric contraction. Strength can change depending on body position and movement during the exertion and the type of contraction. Strength may also vary based on the speed of the movement. An individual muscle may undergo varied concentric, eccentric, and isometric contractions through a prescribed range of motion in an exercise movement.

Human muscles are made up of a heterogeneous collection of different types of muscle fibers. Each type of muscle fiber is distinguished by its structural and metabolic abilities. Muscle fiber types can be grouped into "fast twitch" and "slow twitch." The proportion of fast to slow twitch muscle fibers can vary between persons and within different muscle groups or individual symmetrical muscles in the same person. Thus, the biochemical and contractile properties of muscles will also vary.

Slow twitch muscle contraction is generated using aerobic respiration, which involves glycolysis, Krebs Cycle, and oxidative phosphorylation metabolic pathways. These pathways will generate molecules of ATP from glucose in the presence of oxygen. The reaction rate of ATP production through aerobic respiration is slower than anaerobic respiration. Due to their large oxygen demands, slow twitch fibers are associated with larger blood vessels, increased numbers of mitochondria, and high concentrations of myoglobin. In contrast, fast twitch muscle relies on anaerobic respiration, meaning only glycolysis. No oxygen is required for glycolysis. Glycolysis is, therefore, better suited for providing the energy necessary for rapid bursts of movement repeated over intervals of rest and recovery, or for sustained efforts over limited periods of time.

Furthermore, glycolysis produces fewer molecules of ATP per glucose molecule, so it is less efficient than aerobic respiration and thus not as well suited for endurance activities. Consequently, a higher concentration of slow twitch muscle fibers is helpful for longer length and duration muscle contractions and repeated muscle contractions needed for endurance activities. Fast twitch muscle contractors are more useful for movements requiring short, rapid contractions during rapid movements like jumping, sprinting, boxing, and certain sudden wrestling moves.

Regular training exercises can modify human muscle fibers' biochemical and contractile properties. Conventional resistance training exercises have the primary objective of building muscle strength. Traditionally, training to increase muscle strength involves overloading one or more groups of muscles using a prescribed movement from a start position against resistance and returning to the start position. The prescribed movement, and thus the overloading, is repeated until muscle failure is experienced. A muscle increases strength by progressively overloading it using as much resistance as it can move.

Resistance force can be supplied by the weight of the person's body, or an external object being lifted. However, it can also be supplied mechanically, such as by springs and dampers in response to displacement or rotation of an input by the trainee. In most examples, the resistance's magnitude is proportional to displacement or rotation. However, it may also be proportional to the velocity or acceleration at which the trainee moves the input. Common types of resistance training equipment used to improve strength, such as "free weights" and other weightlifting machines, react to the user's input predictably during each repetition by generating a resistance force throughout the range of a movement. A trainee pushes, pulls, and/or rotates an interface of the device, and the machine generates a resistance based on the trainee's movement. The user must displace the interface to generate the resistance.

In comparison, resistance generated by isokinetic exercise devices varies with the speed with which a trainee attempts to move the interface. The device attempts to maintain a constant speed by varying the resistance. The faster the user tries to push or pull on the device, the greater the resistance it generates. The mechanical structure of such devices limit or restricts the motion of the device's interface to a single path, applying resistance to the user's movement of it along the path, or applies force along a vector intersecting a single point to resist a user's movement of the device. Furthermore, the same amount of resistance is applied each time the interface is moved along the same geometric path and, in the case of isokinetic equipment, with the same speed. For example, in a simple system of a cable and pulleys, with the cable attached at one end to a weight stack, spring, or another device that provides resistance to movement and a handle connected to the other end, the trainee might be able to pull or push on a handle connected to the end of a cable in different directions, along different paths of movement. However, the resistance is always applied along a vector extending to the pulley.

Unlike traditional strength training exercises, plyometric training exercises are used to build what colloquially is termed "explosive strength," which can be thought of as the ability to exert force with higher speed. Explosive power requires a combination of strength and quickness. Plyometric exercises activate muscles' quick response and elastic properties while strengthening them. Because muscle contractions are neurogenic, plyometric training might also train the body's neurological system to generate a rate of neuronal action potentials that will produce a muscular contraction close to the maximum of the muscle's potential for contraction. Athletes in many different sports, such as track sprinters, soccer players, shot putters, high jumpers, martial artists, discus throwers, and players in sports such as soccer, baseball, basketball, football, boxing, and others, use plyometric exercises to improve reaction time, start times, and explosive strength of muscle groups important to success in the sport.

Plyometric exercises are designed to cause muscles to undergo a "stretch-shortening cycle" (SSC) during contraction, in which an eccentric (lengthening) muscle movement is quickly followed by a concentric (shortening) movement. The eccentric phase "pre-stretches" the muscle to allow elastic energy stored from eccentric contraction to be applied to the concentric contraction, thus augmenting force with reflexes and muscle stiffness elasticity. Plyometric training often relies on a trainee's body weight and simple equipment, if any, like jump boxes and hurdles, or competing, sparing with, opposing, or practicing live full-speed actions with a human training partner or opponent.

Training for fast-twitch muscle development typically relies on exercises demanding quick and relatively short, high-energy, intense movements, such as sprinting, jumping, agility training, powerlifting, hang and power clean lifts, high-intensity cycling, and box jumps.

SUMMARY

Disclosed below are examples of representative, nonlimiting embodiments of exercise devices and methods of using them that are configurable, such as by programming, to control the movement of an exercise interface of the device when engaged by a human trainee performing a physical exercise. The movements are configured for a human trainee engaging the exercise interface to perform exercises that develop or improve any one or more of the following: agility; power or explosive strength through the development of fast twitch muscles; range of motion; coordination; reaction time; balance; basic strength; and coordinated athletic body movements used in a sport, such as football, wrestling, martial arts, soccer, basketball, baseball, and many others.

A representative, nonlimiting embodiment of such an exercise device comprises an assembly of joints, linkages, and actuators arranged to move an exercise interface in two or more degrees of freedom to any point within a two- or three-dimensional space, in which a trainee may engage an exercise interface coupled with the assembly. A controller is configured to control the movement of the exercise interface to cause a human trainee engaging with it to perform a physical training exercise. The controller controls the movement of the exercise interface by selectively actuating one or more of the actuators to displace one or more of the joints to move the exercise interface. The controller may, optionally, also selective actuate one or more of the actuators to brake and/or lock movement of one or more joints. Subject to control over its movement by the controller, the exercise interface is movable by the human trainee applying force to the exercise interface (or part of it), such as by pushing, pulling, or twisting it. The controller controls the motion of the exercise interface while the trainee engages it to perform one or more exercises or body movements. The one or more exercises or body movements may target, for example, improvement of the trainee's power, reaction time, agility, strength, balance, range of motion, coordination, or execution of a body movement or combination of movements used in a sport, or a combination of any two or more of such traits.

According to another representative, nonlimiting example, the exercise device is configured to move the exercise device while a trainee engages it to perform an exercise that requires a trainee to react with one or more high-energy movements that develop or improve any one or more of a trainee's agility, reaction time, explosive strength, range of motion, coordination, and body movement.

According to another representative, nonlimiting example, the exercise device is configured to move the exercise according to an exercise routine that has one or more movements that require a trainee engaging the exercise interface to perform an exercise targeting development of fast-twist muscle strength needed for power or explosive strength. The exercise routine may incorporate at least one change that is made, unexpectedly, without warning, quickly, suddenly (quickly without warning or unexpectedly) or abruptly (suddenly and unexpectedly) in the controller's movement of the exercise interface that causes or requires the trainee to activate the quick response and elastic properties of the trainee's muscles, such as subjecting them to a stretch-shortening cycle. Such capability may allow for activation of muscles that are not possible using traditional plyometric exercises. The movements may, optionally, cause or require the trainee to move as the trainee would make when participating in a variety of sports or a specific sport, thereby targeting training fast twist muscles needed to perform a similar movement when participating in or playing a sport.

In another alternative representative example, the controller can be configured to execute a movement of the exercise interface in a manner, at a time, and/or in a position that the trainee is unaware of before it occurs. Such movement unexpected from the trainee's perspective and can be used to cause the trainee to adjust how the trainee is moving or their engagement with the interface. For instance, the controller may achieve an unexpected movement by activating any one or more actuators to create an unanticipated or unexpected change in trajectory by changing the direction, velocity, acceleration, or applied force of the interface.

Although a change in the controller's movement of the exercise interface may, for instance, be partly a response to how the trainee is engaging or interacting with the interface, an unexpected change in movement that responds also in part to trainee input may, for example, comprise an change to the trajectory (a path of motion as a function of time) of the exercise interface's motion in the form of, a sudden, unexpected, or abrupt change in trajectory that is not a proportional or, more generally, a linear response to the trainee's input. Such a change in how the controller responds could be made by, for example, changing the path along which the exercise is being moved, its direction, speed, acceleration, or force of the exercise interface, or any combination of any of these changes.

In other alternative embodiments, the exercise device is configured to control the movement of the exercise interface to cause the trainee to move as they would when participating in a sport or improve the trainee's performance in the sport or activity. Such movements may, for example, improve reaction time or agility without necessarily targeting fast twist muscle development. In addition, the exercise device may be configured to move the exercise interface to simulate a real-world scenario, such as by imitating an opponent or a past sporting event.

DESCRIPTION

In the following description, like numbers refer to like elements.

The terms "exercise" and "exercise routine" used below generally refer to the movement of the exercise interface of an exercise device to allow a human trainee to perform a physical training exercise. Furthermore, notwithstanding a reference to "force" and "torque" in the same phrase or sentence, any reference to just a "force" is intended to refer to both linear and rotational forces (torques) unless the reference cannot be to both for technical reasons. For purposes of this disclosure, when "force" is used with respect to, for example, a revolute or other type of joint capable of being rotated around an axis, it should be interpreted as referring to torque. "Area" and "space" refer to a plane, curved surface, and a three-dimensional volume unless modified by a statement limiting it to two dimensions, three dimensions, curvature, or another dimensionality.

Figure 1:
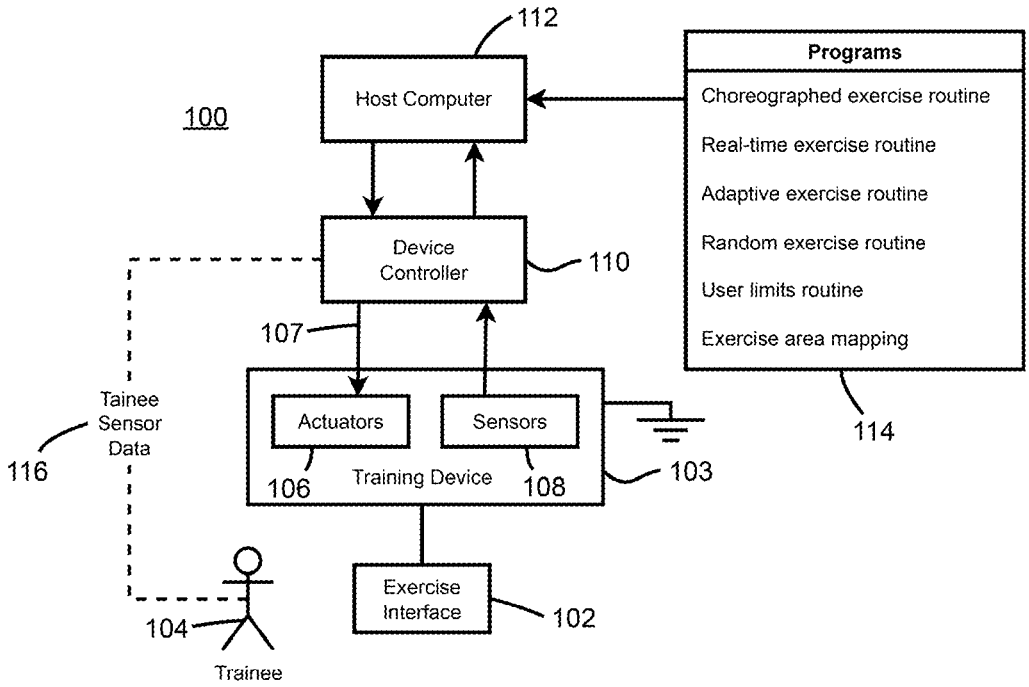
FIG. 1 schematically represents a nonlimiting example of a training device configurable with programmable exercise routines.
Figure 2:
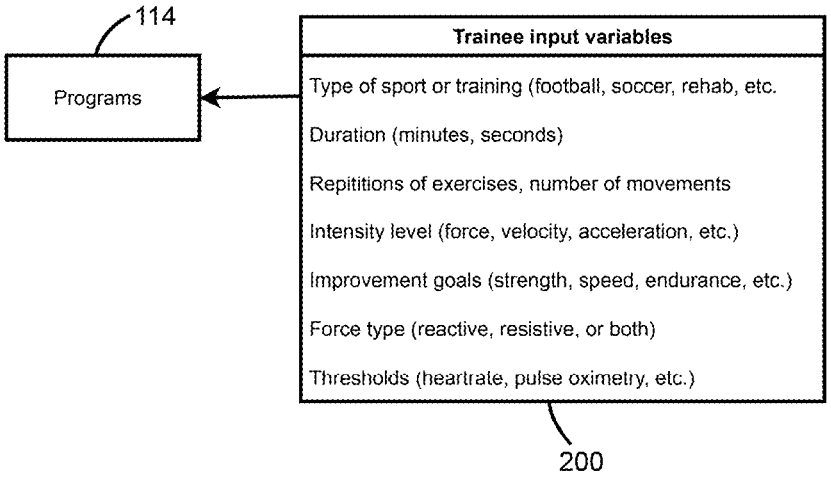
FIG. 2 schematically represents input variables for a programmed exercise routine that may be used with any of the training devices described herein.

Referring to FIGS. 1 and 2, a programmable exercise device 100 includes an exercise interface 102 adapted or configured for engaging a human trainee 104. The exercise interface is coupled through an assembly 103 of interconnected joints (not separately indicated in FIGS. 1 and 2) and, optionally, linkages to a frame 105. The assembly includes a plurality of actuators 106 that move the joints to move the exercise interface. An actuator may be a joint. Therefore, a reference to a joint in the assembly includes an actuator functioning as a joint.

The actuators are controlled by a programmable control system represented by device controller 110 that causes actuators to rotate, extend, retract, brake, or lock. A joint can be, for example, revolute, spherical, prismatic, screw, cylindrical, universal, planer, or possibly a combination of two or more of these types. If an actuator is not functioning as a joint, the force and mechanical displacement of an actuator is transmitted to a joint through a transmission, examples of which include example, linkages, cables, chains, belts, gears, screws, rods, direct drives, pullies (in the form of, for example, wheels, axles, or shafts), hydraulic and other types of couplings, and combinations of such elements.

The exercise interface 102 is an end effector that can generically be considered a tool with a predetermined tool center point (TCP), which is not indicated in the figure. The TCP may, for example, be located where the exercise interface connects to the assembly, which could assist with the substitution of exercise interfaces for different types of exercise routines without having to change the frame of reference used by the control system or to allow exercise routine programs to use offsets to account for different exercise interface geometries being accounted for with exercise routine programming. However, the TCP can be located elsewhere or updated using other methods. Unless the context indicates otherwise, any motion or movement of the exercise interface is in reference to its TCP.

The device frame 105 comprises a structure strong enough to resist reasonably expected static and dynamic forces produced by the actuators and the trainee. The frame can be at fixed location relative to the ground on which a trainee is moving, such as by resting or affixing it to the ground or a foundation, floor, or wall of a building or other permanent structure. It may also be suspended from a permanent or temporary structure, such as a crane or lift. To allow it to be moved, the frame can be configured for mounting on a mobile platform for transport to a site, where it can be stabilized for use. However, it may, optionally, be configured to move the exercise device while it is being used.

The structure of assembly 103 is configured to enable the actuators 106 to apply forces to the joints to move the exercise interface 102 to any point within the device motion space. It also allows the trainee 104 to move the exercise interface to any position within the device motion space if the trainee applies sufficient force to overcome friction of joints within the assembly and any forces applied by the actuators to the joints under the direction of control signals from the device controller 110.

In a representative, nonlimiting embodiment, assembly 103 and frame 105 are configured to permit the exercise interface to interact with a human trainee using his or her feet to move on a surface when performing an exercise routine. The exercise interface is positioned and moves above the ground to permit a human trainee to interact with it while standing. However, the exercise device may, optionally, be configured or configurable to be used by the trainee not standing—such as sitting, lying, or leaning on a bench, chair, stool, or other object, for example—when performing an exercise routine. The exercise device may, alternatively or in addition, be configured or adapted to enable the exercise interface to be moved next to or along the ground or other surfaces.

In the disclosed examples and embodiments, the assembly 103 of joints, linkages, and actuators 106 are arranged to allow the actuators 106 to apply forces to translate the exercise interface with respect to the frame in at least two and optionally three to six degrees of freedom (DOF) within a two- or three-dimensional space defined by the range of the motion of the joints (and/or actuators) of the assembly 103. The joints and actuators of assembly 103 are mechanically configured to allow the actuators to move the exercise interface between any two points and along any path within the motion device space or, if limited, the workout space during the execution of an exercise routine. The mechanical configuration does not, for example, limit the movement of the exercise interface by the actuators or trainee to a predetermined path or set of paths, thereby enabling an exercise routine to specify a path along which the device controller moves the exercise interface using the actuators or along which the trainee may move it under resistance supplied by the actuators. It also enables, if desired, the device controller to alter the existing path, switch to a different path, and selectively allow a trainee to move the exercise interface off a path or along any set of paths while using actuators to create forces that prevent its movement.

For example, locations or positions within the space may be specified using a frame of reference having three coordinate axes or, optionally, two coordinate axes if the space is two-dimensional. The positions within the device motion space can be specified using more than one frame of reference In representative examples and embodiments disclosed herein, the assembly of joints and actuators mechanically allows movement of the exercise interface along any path to any point within the device motion space, subject to any selectively applied physical limits on the device motion, as discussed below. Thus, for example, when a trainee is engaging the exercise interface during an exercise routine, the device controller 110 of the exercise device may move on or restrict movement of the exercise interface by a trainee to any path (a line, which can be straight or curved, or a multi-segmented line) and/or, optionally, its current trajectory (a planned or actual path of the exercise device as a function of time) within the device motion space (or limited device motion space, as described below) and to dynamically change the path or trajectory, and thus the direction of movement, and, optionally, any one or more of speed, acceleration, and applied force.

The exercise device may, optionally, have the capability of selectively limiting the range of motion of one or more joints to limit the size, shape, and/or dimensionality of the device motion space while permitting the exercise interface to be moved along any path within the limited device motion space. A limited device motion space may also be referred to as a workout space or an exercise space.

For example, the range of motion of one or more joints may be selectively limited using a physical device such as a mechanical stop that is actuated by device controller 110 or manually set. Different types of mechanical stops can be used for different joints. A selective limit on the range of motion of the exercise device may also be imposed virtually by configuring the device controller to enforce one or more virtual boundaries while other programmed processes, such as those being performed according to instructions of an exercise routine program, are controlling the movement of the exercise interface. Both physical and virtual boundaries could be stored using, for example, maximum and/or minimum positions for one or more actuators or joints or the corresponding positions of the TCP of the exercise interface in a reference frame for the device motion space. The physical and virtual boundaries may, optionally, allow for the size and any movement of the exercise in relation to the TCP and, optionally, the size of a trainee and any buffer needed for safety. Processes running on the device controller may, for example, use the stored limits to determine whether to execute of a program or certain of its instructions that would result in the exercise interface being moved beyond a selectively applied physical or virtual boundary. It may also add to, substitute, or modify parameters in an exercise routine program before or during execution to prevent motion exceeding a limit.

The assembly 103 may, optionally, be configured to rotate the exercise interface with respect to the TCP in one, two, or three DOFs. For example, this can be done to maintain an orientation while it is being translated. It may also be configured to enable changing its orientation in up to six DOF independently of translation of TCP. Alternatively, or in addition, the exercise interface may be coupled through an assembly of joints and actuators 106 to be independently translatable and/or rotatable with respect to the TCP of the exercise interface in one to six DOF.

The exercise interface 102 is configured to be engaged by a trainee in a manner suitable for the exercise to be formed. Depending on the exercise routine, engagement may involve the trainee physically contacting the exercise interface to apply forces to it, such as by pushing, pulling, or twisting it, while the exercise device is applying forces to move the exercise and/or resist it's movement by the trainee. However, the trainee may also engage with the exercise interface without contacting it, such as by reacting to its movement. An exercise may include either or both types of engagement.

The configuration, such as its size, shape, and/or functionality, of the exercise interface may, for example, be generic, permitting it to be used with a wide range of exercises or otherwise suitable for performing multiple different programmed exercise routines and planned movements, including those for which the device controller is programmed to execute. It may, alternatively, be specially configured for specific types of exercise. For example, a generic exercise interface may have a relatively flat surface that the trainee can push or pull to apply force to a part of or the entire body of the interface. It may, instead, be three-dimensional and have a geometry that is specially configured to be gripped by a trainee's hand, hooked by a trainee's arm, leg, or head, or pushed by the trainee using the trainee's hands, arms, legs, head and/or torso. It may optionally be entirely or partially padded.

The exercise interface 102 may, optionally, have a more complex shape that conforms to part of the human anatomy or is shaped to resemble equipment used in a sport, such as a football, soccer ball, basketball, baseball, baseball bat, tennis racket, or any other type of equipment. Optionally, it can be shaped to resemble a person or to have one more anatomical features of a person, such as a torso, head, arms, hands, legs, and/or feet, to imitate, for example, an opponent in a sports activity, or to imitate a player, such as a football, lacrosse or hockey player. For example, it may have appendages that could be stationary or can be moved by the trainee and/or the device to imitate an opponent. Furthermore, the exercise interface may be soft or hard, depending on the exercise. It may include materials or mechanisms to mitigate impact forces on the trainee or otherwise protect the trainee from the application of excessive force.

In addition, the exercise interface or assembly may have embedded speakers, haptic feedback generators, and/or visual displays to communicate exercise instructions and trainee performance information to the trainee and/or to imitate an opponent. The exercise interface can be statically coupled, meaning that it cannot independently move with respect to the TCP of the assembly 103, or may be coupled through one or more joints or actuators at the TCP for its orientation to be changed in one or two dimensions, such as up and down (pitch) and/or left and right (roll). It may also incorporate actuators (linear and/or rotation) to translate and/or rotate the exercise interface about one or more of its axes in multiple DOFs, which may be useful when the exercise interface is being used to imitate a sports opponent. The exercise interface may comprise, for example, a padded surface suspended above the ground by the training device, against which a trainee may engage using the trainee's hands, arms, head, legs, head, torso, or any combination of them.

Optionally, the device controller 110 may selectively limit the size, shape, or dimensions of the device motion space using virtual boundaries. Virtual boundaries may, for example, be created with one or more programs and are used to prevent the device controller from moving or allowing movement of the TCP or exercise interface beyond a programmed boundary or by selectively limiting the mechanical range of the movement of any one or more of the joints in assembly 103, such as by activating for each of the one or more joints a mechanical lock, brake, limiter, or a combination of them to limit the range of movement of the joint and thus prevent movement of the TCP by actuators or a trainee beyond the virtual boundaries. Such virtual boundaries may, optionally, be selectively applied for a trainee, trainees meeting certain conditions, or all trainees, or for an exercise routine, a type or types of exercise routines, or all exercise routines. For example, they could be created based on available space where the exercise device is located, safety concerns, the exercise routine being performed, and/or the trainee's abilities. The device motion space limited by any virtual boundaries may be referred to as the workout space, the exercise space, or the limited device motion space.

Host computer 112 may, for example, be used to execute one or more programs that generate an interactive user interface for a user—a trainee, a coach, or an operator—to input information, make selections, and perform various tasks relating to set up, operation, and maintenance of the exercise device. The host computer may be configured with one or more programs to execute processes according to one or more user or workout protocols that may, for example, be used to do any one or more of the following: set or enter configuration information for the exercise device; select exercise routines and download exercise routine programs for executing the exercise routines to the device controller; set, select, and/or enter options, parameters and/or configuration information needed for a selected exercise routine program or by the device controller, such as intensity, duration, and repetitions; enter or load trainee information into the device controller, and/or to control starting and stopping an exercise session.

Representative, nonlimiting examples of embodiments of the assembly 103 are disclosed in connection with the descriptions of FIG. 6 to 24. Other representative, nonlimiting examples include articulating arms and combinations of such arms.

The actuators 106 include, for example, linear motion, rotary motion, and other types of actuators that convert energy to mechanical work. They are coupled to the frame and the TCP and, optionally, between the TCP and exercise interface using joints. An actuator's force and mechanical motion can be used to mechanically displace a joint, resist (brake) or lock mechanical displacement of a joint, or both. The exercise device thus uses mechanical work produced by actuators to control movement of the exercise interface to do any one or more of the following: move one or more joints; change the directions of movement of one or more joints; brake movement of one or more joints; and lock one or more joints.

The actuator types can be pneumatic, hydraulic, or electric (motor or magnetic, AC or DC). A combination of different types of actuators can be used. A pneumatic or hydraulic actuator converts energy from a flow of pressured fluid to mechanical work that applies a force to a joint. An electrical actuator converts energy from electrical current to mechanical work, such as by causing an electric motor to rotate or a solenoid to shift to apply a force to a joint. The flow of pressurized fluid may be controlled by, for example, fluid control valves (which can be actuated by solenoids). An electric motor driver may, for example, used to control the delivery of electrical current to an electric motor. Motion control of an actuator may use any one or more of the following: solenoids, amplifiers, proportional drives, proportional solenoids, variable frequency drives, flow controls, stepper motors, and servo motors. Other types of motion control devices could also be used. The force and mechanical displacement of an actuator may, optionally, be transmitted to a joint through any suitable transmission, including, for example, cables, belts, gears, screws, cylinder rods, direct drive, and combinations of such elements.

Actuators may be coupled to the exercise interface in various ways to transmit motion and forces to the interface. Some actuators or combinations of actuators and joints may, for example, provide more desirable motion characteristics of the exercise device, such as if they are more compact or have a lower inertial mass. Lower initial mass may improve, for example, control of the dynamic behavior, responsiveness, portability, power requirements of the exercise device, other desirable characteristics, or a combination of desirable characteristics.

When moving, standing, turning, twisting, running, lifting, pulling, pushing, punching, hopping or jumping, or any combination of these or other movements, for example, humans can react and move quickly with a smooth, fluid-like motion that involves quick changes in direction and force. To try to better imitate such movements, exemplary embodiments of the assembly 103 may, optionally, use actuators or combinations of actuators to create a smoother, more fluid-like motion (without jerky stops and starts) of the exercise interface while also varying force. For example, one or more actuators used in any of the representative, nonlimiting examples or embodiments of the exercise devices disclosed herein may incorporate proportional valves and/or motor drives to control the actuator's movement to achieve a more fluid-like motion of the exercise interface during quick changes in motion (such as the direction of movement and changes in speed or acceleration) while also permitting force to be varied.

This exemplary embodiment may also include one or more actuators that use pneumatic cylinders. A pneumatic cylinder may offer one or more advantages than other types of actuators. Due to the compressibility of gases, pneumatic cylinders inherently can dampen high-magnitude impulse forces caused by, for example, a trainee impacting the exercise interface or by sudden "hard" stops or starts of the movement of the exercise interface. While this characteristic can, in some circumstances, make precise control of the exercise device more difficult, it has the advantage of reducing the risk of injury to a trainee. Furthermore, because of the nature of at least some movements, protocols, workouts, and exercise routines that the exercise device could be programmed to execute, precise positioning of the exercise interface may not be as important for some embodiments. Additionally, valving for the air supply to a pneumatic cylinder may also be configured to enable pressures to rise or fall quickly or slowly, which allows the device controller to increase or decrease applied or resistive forces of the interface on a trainee very quickly while also being able to absorb impulse forces from impact with, in effect, fluid dampening.

Embodiments of the exercise device with one or more actuators that use pneumatic cylinders that have cables coupled to the piston rather than a rod may enhance and/or offer additional advantages. For example, a pneumatic cylinder with a cable system attached to both sides of the piston can have smoother motion than a cylinder with a rod and still produce high forces. It will also have a lower inertial mass. Low inertial mass allows for quick changes in the direction and velocity of the actuator. It also may improve the controllability of the exercise interface, reducing the risk of injury from the exercise interface when moving fast.

Pneumatic and hydraulic cylinders can exhibit erratic velocity changes or "jumpy" travel due to friction forces between internal bearings and seals, sudden load changes, air pressure, or airflow to and from the cylinder. Cable cylinders tend to be less prone to jumpy travel. Cable cylinders have less friction between the cable seals and bearings than a rod design, which reduces the "slip-stick" cylinder phenomenon common with pneumatic cylinders. Cables, compared to rods, have lower moving inertial mass, reducing acceleration forces that contribute to slip-stick. Because a cable cannot transmit a high perpendicular load, cable cylinders, as compared to rod cylinders, are also less prone to alignment problems and the resulting side-loading, frictional force losses and high bearing side loading that contribute to slip-stick.

Furthermore, the area on each side end of a cable piston, against which the fluid pressure acts, can be made equal. Equal areas on each side allow the actuator to produce the same force in opposite travel directions using the same pressure. In comparison, cylinders connected to rods usually have less area on one side of the piston than the other, resulting in less force in one direction using the same pressure. In addition, velocities of the piston, and thus also the actuator, are inherently easier to control with cable cylinders in both directions of travel using flow control valving because of flow demand for either direction of travel being the same due to equal areas on opposite sides of the piston.

The device controller 110 controls the motion of the exercise interface with control signals 107 generated on its output channels or interfaces, which are then transmitted to the actuators 106 to cause them to apply forces to displace the joints. A representative and nonlimiting example of an embodiment device controller is configured to enable control the actuators to control the position, the force or torque applied to, and the velocity of the movement of one or more joints. This enables the device controller to control the position, velocity, acceleration, and/or force applied to the exercise interface.

The device controller 110 also includes input channels or interfaces to receive feedback signals 111 from analog and/or digital sensors and sensor systems, collectively represented by sensors 108. Feedback signals may, for example, represent or transmit information on properties or conditions of the exercise interface, the trainee, device limits, and/or device motion spaces that allow detection or measurement of, or estimates for, properties or conditions of joints, actuators, the exercise interface, and the human trainee engaging with it. For example, sensors may optionally be used to measure, detect, or estimate one or more of the following properties and conditions: location, position, posture, configuration, force, torque, velocity, or acceleration of one or more joints in the assembly 103, the exercise interface 102 (including parts of it), the human trainee (including parts of the trainee's anatomy), the proximity and movement of the trainee relative to the exercise interface or the frame within the exercise or workout area, and physiological conditions of the trainee.

Sensors 108 may include internal and/or external sensors used by the exercise device. At least some of the sensor feedback signals are provided as inputs to the device controller 110. Some or all of them may also be provided as inputs to a performance analysis system (not indicated in the figure.) Feedback signals transmitted to the device controller and any performance analysis systems may also include real-time feedback signals 116 transmitted sensors associated with the trainee 104 or other systems not shown.

An internal sensor is incorporated or included as part of an actuator or motion controller for an actuator or that is coupled with a joint in the assembly 103. External sensors are, for example, mounted or incorporated into the exercise interface 102, assembly 103 or, for example, a video or LIDAR motion capture system for detecting or measuring the movement of the assembly 103, the exercise interface 102, and/or the trainee 104 or receivers or microphones to detect and record audio signals, sonic indicators, commands, language and verbal exclamations by the trainee.

A feedback signal generated and transmitted by any of the remote sensors 108 may take the form of an electrical, radio frequency, optical, or acoustical signal, including modulations of them, that can be received and processed as inputs by the device controller 110.

At least some of the feedback signals from sensors 108 are used by the device controller to determine the state of the joints and actuators comprising the assembly 103 or used in the exercise interface and the TCP of the exercise interface. The feedback signals may, for example, represent or be used to estimate the relative positions of joints and/or actuators and optionally their respective velocities (rotational or linear), acceleration, and/or applied or sensed forces and torques. The device controller may use information from the feedback signals to generate control signals to move the joints and exercise interface according to a programmed exercise routine.

The exercise interface may, for example, include embedded or associated sensors for measuring or sensing any one or more of the following: proximity of the trainee to the exercise interface; contact of the trainee with the exercise interface; the velocities, stresses, forces and/or torques experienced by the exercise interface and any joints, actuators, and or other components of the exercise interface; and the position, shape, and/or orientation of the exercise interface and any movable parts of the exercise interface with respect to the TCP, other parts of the exercise interface, and/or the trainee.

Similarly, sensors may, optionally, be worn by human trainee 104 to provide any one or more of the following: measurements and/or estimates of heart rate and other physiological aspects of the trainee or the trainee's body position in the device motion or workout space; the orientation; the orientation or posture of the trainee or any part of the trainee's body; proximity of the trainee to the exercise interface, velocity, speed, acceleration, the magnitude and/or direction of forces applied by the human trainee to the exercise interface 102; and the magnitude, direction, and/or location relative to the body of the trainee of the forces the exercise interface applies to the trainee. Examples of such sensors include biometric sensors for measuring and reporting parameters such as heart rate and devices such as accelerometers, force sensors, and position and location tracking devices that are worn. External systems such as optical camera motion detection systems, LIDAR systems, and similar tracking systems that are capable of tracking, for example, the position, direction of movement, speed, and/or acceleration of the trainee and/or positions of the trainee's anatomy may be used instead of or in addition to worn sensors. Such external systems may improve detection or be able to detect what wearable sensors cannot, such as anatomical conditions like eye movement, angles of appendages (which can be relative to the body or other appendages or determined with reference to a coordinate system of the device motion space or workout space), and estimates of velocities and acceleration of a trainee's body.

Data represented by or estimated from at least one or more of the sensor feedback signals may be provided to a data acquisition and/or performance analysis system to be stored. Stored data may, optionally, be analyzed later. Such data may, optionally, be used for real-time analysis of at least one or more performance parameters to provide real-time feedback on trainee performance to the trainee or trainer (or coach). Vision systems may, optionally, also be used in combination with traditional sensors to generate feedback for the device controller and/or trainee performance evaluation. Optionally, one or more performance parameters generated by the performance analysis system may be provided to the device controller as an input.

In a representative, non-limiting embodiment, the device controller 110 generates on its output channels or interfaces control signals to cause movement of individual actuators or groups of actuators to move the exercise interface based, at least in part, on a stored exercise routine program and, optionally, on one or more feedback signals from sensors 108, one or more device or user settings, and/or real-time input, during execution of an exercise routine or workout program, from a trainer or coach. Depending on the type of control the device controller uses to generate control signals for the actuators 106, the device controller may employ open control loops and/or closed feedback control loops to execute a planned movement. For example, closed feedback loops use the feedback signal values to generate control signals to execute a planned or calculated trajectory.

The device controller 110 is configured by one or more stored programs to actuate the various actuators to move the user interface according to an exercise routine program. The exercise program includes instructions for the device controller on making one or more movements of the exercise interface. The programmed instructions of an exercise routine are loaded into the device controller before a workout. The device controller may be configured with additional programmed instructions stored by the device controller and can be executed when executing an exercise routine program. Executing the software instructions causes the device control to generate control signals to move the actuators to cause movement of the exercise interface 102 according to the exercise routine. The exercise routine program may, for example, instruct the device controller to rotate, extend, or retract an actuator or specify a movement, specify a position (or configuration), velocity, and/or force for an actuator during a movement, specify movement of the exercise interface in terms of positions, trajectories, paths, velocities, accelerations, and forces, or specify to the device control execution of a preprogrammed or pre-configured movement and parameters for it.

The movement of the exercise interface causes a trainee engaging with it to activate his or her muscles in predetermined or predictable ways for purposes of developing or improving any one or more of abilities: agility, strength, power or explosive strength (fast twitch muscle development), reaction time, balance, range of motion, coordination and body movements useful in specific sports.

A planned movement during an exercise routine may, for example, be based on a planned geometric path for movement of the TCP of the exercise interface and/or movement of the exercise interface relative to the TCP. A planned path may be determined before the exercise routine or movement. However, it may, optionally, be dynamically determined at the time of execution of the exercise routine or planned movement and/or changed or updated during the execution of planned movement. A planned path comprises, for example, a point or continuous line within the two- or three-dimensional device motion space or the workout space. The continuous line can be specified using a piecewise linear curve (assuming a Euclidian space) in which two or more waypoints specify one or more linear segments. A planned path may also be specified, for example, with splines, parametrically using polynomials, combinations of the foregoing, and other ways. For example, a planned path for a movement may be specified mathematically using variables for waypoints or other parameters without explicitly specifying values for the variables or just initial values and specifying the conditions and manner of determining and updating values for the variables.

The planned movement of the exercise routine may, for example, also include target positions, velocities (vector or scalar), and/or forces (vector or scalar) for joints, actuators, the exercise interface, and/or trainee. The target velocities and forces can be a single set value, a range of values, or constraints or limits (average, upper or lower, or both) on the values.

Movements or portions of movements that are part of an exercised routine may have one or more of the target values. The target values can be set using several different methods. First, a target value may be specified as part of a planned movement. Second, the device controller may determine the target value at the start of an exercise routine or the planned movement using trainee data, settings entered in the device controller before the planned movement, limits on the device motion space, and/or trainee performance in prior movements during the exercise routine or dynamically determine the target value during execution of the movement. It may, optionally, also update the target value during the execution of the exercise routine. For example, the exercise routine program may instruct the programmable controller before execution of the exercise routine or a particular movement to determine the targets and limits based on information about the device and its environment, the type or objective of the exercise or training to be performed, the abilities of the trainee, and/or inputs or settings from the trainee or coach. They may also be dynamically calculated and/or updated during the execution of the exercise routine based on feedback from sensors and/or inputs from trainers and coaches.

The device controller may, optionally, be configured, for example, to use a trajectory for a movement to generate control signals to control the motion of the actuators 106. A trajectory refers to the dynamic movement of the joints and/or the exercise device as a function of time. The device controller generates control signal outputs transmitted to the actuators that cause the actuators to move the exercise interface along the trajectory with a target velocity and/or under a target force. A trajectory may be calculated for a planned path at the beginning of a planned movement. It may also be iteratively determined or updated during a movement to correct for errors or deviations from a planned path or previously calculated trajectory.

A planned movement may include instructions for a trajectory, a simple example of which is moving the user interface to a specified endpoint or along a planned path for a specified time or at a target velocity. However, the device controller may change the trajectory of the exercise interface based at least in part on the current state of the exercise device. The current state of the exercise device may include, for example, its configuration, meaning the relative position of the joints and/or actuators of the exercise device or the TCP of the exercise interface. It may also include the velocity (linear or rotational speed of a joint relative to other joints or elements of the exercise device or in a fixed reference frame) and/or force/torque on the joint. The exercise device state can be obtained or estimated at least in part from feedback signals from at least some of the sensors 108 and in other ways. Thus, the device controller may determine a new trajectory using, at least in part, any one or more of the following conditions: time, velocity, force, the current state of the exercise device, and/or other inputs to the device controller such as those determined by detecting, measuring, or estimating properties and conditions relating to the exercise interface and/or the trainee.

The device controller may, at least for some types of exercise routines or movements, be programmed with instructions to determine or change dynamically during a planned movement one or more variables for the planned movement based on real-time inputs. These variables may include, for example, planned paths, trajectories, type of control, targets for velocity and/or force, and other constraints, including trainee limits based on real-time inputs. Examples of such real-time inputs include any one or more feedback signals from sensors, such as those representing the state of the exercise device, the exercise interface, or the trainee. The exercise routine or planned move may also accommodate or require real-time input from a trainer or device operator using a control input device, such as a handheld joystick, or input from another source, such as a pseudo-random number generator used to introduce randomness.

An exercise routine is programmed using methods supported by the device controller. Depending on the type of device controller used, exercise routine programs may, for example, be written at different levels of abstraction or specificity based on the capabilities and design of the device controller for taking the instructions and using them to generate output control signals and programming methods supported by it. An exercise program or parts of it may, but is not required to, be programmed at the actuator and joint level and specify, for example, target positions, velocities, and forces for the actuators, the type of control to be used, processing feedback parameters, and flow control. It may, optionally, be written at higher levels without having to specify details needed to process feedback signals and generate control signals to move specific actuators. For example, it could be written as high-level instructions that specify one or more movements of the exercise interface and the sequences of the movements by specifying one or more positions, paths, trajectories, and/or velocities for the exercise interface relative to the exercise device frame or trainee, target forces to be applied to the exercise interface, timing, orientations of the exercise interface, and conditions that could trigger changes to any of the foregoing.

Furthermore, an exercise routine may, for example, be assembled using one or more pre-programmed movement types that are to be executed according to a script. The device controller or other program would, for example, transform, interpret, or compile high-level instructions, conditions, or properties pertaining to the exercise interface into instructions that can be executed by the device controller for processing feedback signals and generating control signals for controlling the movement of actuators to achieve the movements specified. The device controller may, optionally, be configured to execute an exercise routine program with instructions specified using objects or blocks representing movements of the exercise interface that the device controller has been configured or programmed to execute. This disclosure should be understood to permit the use of any of these types of programming methods. Thus, references to conditions or properties of an exercise interface or TCP, such as position, velocity, acceleration, size, and forces, should also be understood as references to corresponding properties or conditions of the joints and/or actuators connected with it unless otherwise specified.

An exercise routine program will typically specify one or more planned movements and may allow required variables, such as any one or more of those mentioned above, to be provided. It may also allow for optional variables. The user interface application on the host computer 112 or the device controller 110 may offer a list of options for required and optional variables for selection by, or otherwise prompt for entry of choices of or instructions for determining variables by a user (trainee, trainer, or operator.) The exercise routine may also obtain selections, values, or instructions for determining one or more variables from a profile for a trainee or trainer that is stored, for example, on the host computer or remotely.

A non-limiting, representative example of an exercise routine includes instructions describing or executing at least one planned movement. Exercise routines may optionally be created on, for example, the host computer 112, using previously coded instructions for a planned movement and/or by selecting and combining two or more planned movements.

In a representative, nonlimiting example, the instructions for the planned movement for use in an exercise routine may, optionally, specify one or more variables or parameters to be used when executing the planned movement. Target values for the variables may be included in the instructions or determined by the device controller before or during the execution of the exercise routine or a planned movement. Instructions for how to determine the target values may, optionally, be included. Representative, nonlimiting examples of target values include any one or more of the following: one or more destination coordinates for the TCP within a frame of reference for the device motion space or workout space; positions of one or more joints; a planned path of motion for the exercise interface, such vectors, equations, or models, parameters such as coordinate points and coefficients for vectors, equations models, and instructions for determining the planned path; time intervals, such as for completion of a planned movement or segments of a planned path; velocity targets (for a TCP or one or more joints); target forces, such as forces applied to a joint or TCP to move the exercise interface against or to resist forces that a trainee applies to the exercise interface; or a target number changes for any of the variables listed above; a target average, sum, integral, or derivative of magnitude of such changes cumulative within a set time, set path, workout session or sessions or based on real-time feedback from the trainee or a trainer/coach; and other variables. Positions and paths may be specified or determined using, for example, coordinates in a predefined reference frame for the TCP within device motion space or limited device space or the corresponding positions of joints or actuators in the assembly 103. A target for a variable (generally a "target value") may, for example, be a single value, a threshold value, or a range of values. The target value for a variable can be determined, calculated, and/or before an executed move or motion of the TCP. It may also be determined or updated during the execution of an exercise routine. Thus, for example, target values may be used to specify desired operational parameters for the exercise interface and actuators during the execution of a planned movement. A target value may, for example, be: (1) a single specified value that the controller attempts to maintain; (2) a range defined by minimum and maximum threshold values within which the controller maintains the parameter; or (3) a set of constraints that define acceptable limits for the parameter. Therefore, Target values may optionally be specified for force (such as the magnitude and/or direction of force applied by an actuator or all of the actuators to move or resist movement of the exercise interface), velocity (speed and/or direction movement of the exercise interface or any of the actuators), position (such as coordinates for the exercise interface within the device motion spaced or the position of one or more joints or actuators), orientation or posture of the exercise interface or parts of it, acceleration (a rate of change of velocity of movement of the exercise interface or an actuator), or a sum, average, derivative, integral, or other calculation based on one or more measured or estimated parameters. The controller may use sensor feedback signals to compare actual values against target values and adjust actuator control signals based on the comparison.

For at least some exercise routines, the device controller or other program used to generate executable instructions for an exercise routine may, optionally, use performance, strength data, and/or other information about a trainee to determine values for variables in the exercise routine program that determine limits, program flow, or other parameters used by the device controller when executing the programmed exercise routine. The device controller may, optionally, also be configured to enforce not only device limits during the execution of an exercise routine program but also trainee limits on, for example, positions, paths, velocities, forces, or combinations of them of the TCP and/or parts of the exercise interface based on the trainee data. Device limits may include, for example, limits on the range of motion of one or more actuators that are used to set the device motion space or dynamic limits on the movement of the actuators or exercise interface. A nonlimiting example of a device limit is to set a limit on actuator travel that prevents an exercise routine program from using an actuator's full travel distance to allow enough distance for the actuator to decelerate before hitting a hard stop. Device limits may also be determined or set based on position, velocity, acceleration, and force for any one or more actuators and/or the exercise interface.

The exercise routine may specify a target value for each of these variables. Alternatively, the exercise routine may have the device controller, by default or using instructions, determine and set any one or more of the variables at the start of an exercise routine or determine or, if previously determined, update it during the exercise routine. The device controller may base these determinations on any one or more of the following: instructions in the exercise routine, programs stored on the device controller, exercise device settings (which could be set or entered by an operator of the device, trainer, or trainee), device limits, and trainee information (for example, preferences, basic physical features, physical assessment testing data, and/or past performance data); real-time input from a trainer or device operator using a control input device; current performance data, such as from prior movements; feedback signals from sensors 108; and combinations of any two or more of the foregoing.

For one or more of the target values, the exercise routine program may instruct the device controller to perform, or the device controller may perform by default or prioritization, a determination of an initial or updated target value for a planned movement dynamically during a planned movement and/or determine to end a planned movement and go to different planned movement in the exercise routine. This dynamic determination may be based on an algorithm (coded into the exercise routine program or another program on the device controller) and one or more specified inputs or conditions. Examples of such specified inputs and conditions include the current state of execution of the movement, trainee performance during the movement, input from a real-time input control device operated by a trainer or device operator, input that is randomly or pseudo-randomly selected or generated, and combinations of any one or more of such examples. A condition based on the state of execution of a movement could be, for example, one or more of the following: elapsed time exceeding a threshold; deviations from a planned path exceeding thresholds; required trajectories exceeding or not meeting prescribed conditions, limits, or requirements, such as trajectories that would exceed trainee or device limits; velocities and/or forces falling outside of desired ranges or deviating from a value by a prescribed amount; and combinations of any two or more of the foregoing.

An exercise routine or a planned movement in an exercise routine may include instructions to move the exercise interface 102 in ways the trainee does not anticipate or expect. Incorporating a motion that a trainee is not likely to or cannot predict or anticipate into an exercise routine or planned movement can be used to evaluate reaction times and explosive power or improve reaction times and develop the strength of fast twitch muscle fibers to improve explosive power. Examples of such motions include a substantial and sudden, abrupt, or unexpected change in the trajectory of the exercise interface, such as the direction or velocity of movement of the exercise interface by the actuators, in the magnitude of force being applied by the actuators to move the exercise interface along the current trajectory or change in how the exercise interface is responding to the trainee's input to the exercise interfaces. When executing an unanticipated or unpredictable motion, the device controller may, for example, be instructed, for example, to dynamically update or change a planned path or trajectory, a calculated trajectory, a target for velocity or force, or switch another planned movement in response to one or more inputs, as described above. The update or change can be based on any one or more of the feedback signals or based, for example, on an input from a pseudorandom selection process that randomly selects the dynamic change or update and/or the timing of the dynamic update.

Furthermore, a planned movement in an exercise routine may, optionally, include instructions for adapting, or the device controller may be configured to adapt a planned movement in real-time during a routine to account for a trainee's strength being greater or less than expected using a control process such as those described above to change or incrementally change the velocity and/or the forces applied to the interface by actuators. The adjustments could be, for example, based on differences between an expected and executed trajectory, a planned and executed path, planned (or target) and actual velocities, and/or target and actual forces on the exercise interface. For example, a trainee usually achieves muscle exhaustion during strength and endurance training. If a planned movement involves applying resistive force to the exercise interface that a trainee is expected to move at a target velocity or to a predetermined position within a predetermined time, the device controller may be configured to adjust the force applied to the exercise interface and/or adjust the target velocity of the exercise interface in real-time. The device controller may, optionally, switch to the next planned movement in an exercise routine. If a trainee is overpowering the exercise interface, which might be indicated by velocity or acceleration above a target velocity or acceleration, the device control can adjust the force that the actuators apply to the exercise interface to meet the target velocity and, optionally, adjust the target velocity so that the exercise interface arrives at the end of the path for the planned movement after a predetermined elapsed time threshold or within predetermined timing parameters.

An exercise routine may, optionally, program the device controller to create one or more virtual boundaries within a device motion or workout space that divide the space into two or more subspaces. The sections could be the same or have different sizes and shapes. The device controller may, for example, be configured to use the location of the exercise interface or trainee in a subspace as an input for determining or setting a parameter for a movement or selecting movements for the exercise interface. The device controller may, for example, be configured as a trigger the exercise interface's or a trainee's approach to or crossing of a virtual boundary to switch to a different planned movement, to make a sudden, abrupt, unanticipated, or unexpected movement, or to change parameters for movement of the exercise interface.

The device controller may, optionally, store and/or provide some or all sensor data to the connected host computer 112 during an exercise routine. Furthermore, data from sensors could be processed in real-time to generate performance metrics by programs on the host computer or remotely and displayed for viewing and evaluation in real-time in a trainer or user application. It may also be stored for later viewing and performance evaluation.

As mentioned above, the device controller 110 may be configured to perform additional processes. These additional processes may, optionally, be performed by one or more programs stored in firmware that are executed before or concurrently with exercise routine instructions, linked with it during compilation or other pre-execution processes prior and then downloaded to the device controller, linked by the device controller at runtime for execution with the exercise routing program, or others methods, as well as any combination of any of these methods. The additional processes may include, for example, any one or more of the following processes: determining, setting, and/or enforcing device limits; processes that determine, set, and/or enforce trainee limits; providing real-time feedback to a trainee, trainer, coach, and/or third-party; providing safety demonstrations; receiving environmental inputs and readings; and providing exercise routine examples and simulations.

The values determined or set by the device limits processes are stored by, for example, writing them to a data file or database stored on or otherwise accessible to the device controller. The controller may use the values to determine or enforce limits or thresholds on the motions of actuators during the execution of an exercise routine program.

The programs may, optionally, be loaded into a device and modified only by technicians. They may not, for example, be accessible by a user (trainee, trainer, or device operator) or the owner of the exercise device owner or trainee unless they are also a trained device technician. Optionally, the device limits program may be modified by a trained technician to initially set and/or update the machine's physical capabilities (e.g., maximum actuator force, velocities, acceleration, and actuator full travel distance). Because machine parts and sensors wear during use, resulting in changes in actuator travel, bearing friction, and sensors, one or more processes of the device limits program may, optionally, be automatically executed periodically or upon the occurrence of an event or condition. For example, the device limits processes may be run each time the controller is powered on to compare and calibrate minimum and maximum sensor values and update device limits to account for the effects of wear on the device limits.

Device limit processes that enforce device motion limits may be executed independently of processes that enforce trainee limits and processes performed by execution of exercise routine programs.

If a programmer, user, coach, trainee, or other person creates a program without limits or with limits that would exceed device limits processes, the device limit processes may, optionally, generate an error and not permit the device controller to execute the exercise routine program. It may, instead, permit the controller to execute the exercise routine but use default values for the limits, such as those set by device limits processes.

In addition, the device limits program may, optionally, enforce during the execution of the exercise routine program a limit such as maximum, minimum, and/or average values for travel, velocity, force, and/or acceleration of actuators or the exercise interface by not permitting the device control to execute instructions that would result in violation of one of these limits or modify the execution of the instructions to comply with the limit.

Furthermore, the device controller may, optionally, be configured with program instructions to perform a process, either as part of the device limits process or separately, to monitor one or more sensors on the exercise device and/or the trainee in real-time to detect rapid accelerations that might indicate potential or actual interactions with a trainee that are unsafe. If the monitored sensors include an acceleration that exceeds a set threshold, the device controller may, optionally, be configured to take action to reduce or avoid the possibility of unsafe acceleration, such as by taking one or more of the following actions: immediately stopping motion; substantially reducing the magnitude of force one or more actuators are applying to the exercise interface; reversing the direction in which the force of any one or more forces the actuators are applying to the exercise interface; applying other forces; or a combination of such actions or other actions. Such monitoring offers an advantage over typical, real-world practice sessions that may result in interactions or collisions between players, such as between American football linemen, which involve unsafe levels of momentum or force. The amount of momentum or force that might be involved between two players cannot be detected, and the interaction or collision cannot be stopped or mitigated before a potential injury.

A trainee-limits process on the device controller enforces applicable limits on motions of the exercise interface based on the trainee's physical abilities and/or training objectives. It may also be used to determine such limits. Trainee limits may take the form of, if applicable, limits on allowed positions within a device motion space or workout space, range of motion, velocities, accelerations, and/or forces or loads applied to the exercise interface. Information on the trainee's physical abilities and/or training objectives may, for example, be input by the trainee, trainer, or operator into the host computer 112, a remote computer or data storage service, or the device controller. For example, the data can be stored as part of a profile for the trainee that is stored or downloaded to the host computer. Optionally, trainee limits or information from which to determine trainee limits may instead or, in addition, be directly input into the device controller by the trainee, trainer, or device operators.

Figure 5:
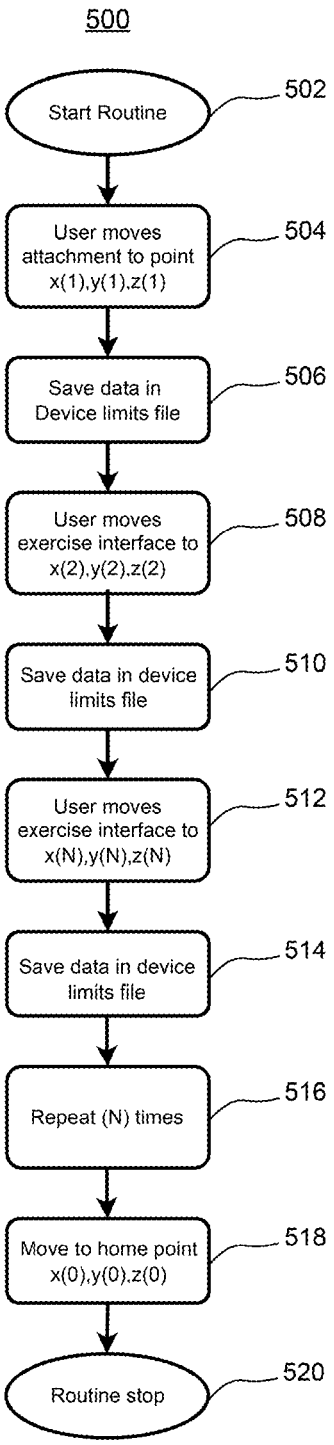
FIG. 5 is a flow diagram representing an example of a routine to set user limits that may be used with a training device, such as any of those described herein.

Trainee limits may, for example, be determined by a program on a remote computer, the host computer 112, and/or on the device controller 110 based on information about a trainee's physical abilities and limitations and/or athletic performance. This information may, for example, be entered into and stored in a trainee limits database or profile before a new trainee may use the training device. This information may include athletic metrics data for a trainee. The information may, for example, be manually entered into the trainee limits database or profile from known data—examples include maximum weight lifted, maximum repetitions of weight lifted, sprint times, and measures of jumping ability, agility, eye-hand reaction time, and other physical abilities—for an individual. The determination of at least some trainee limits information may instead or, in addition, be based on one or more physical assessments made by the device controller executing an assessment process on the exercise device, during which performance data is collected. The device control or, optionally, the host computer or another computer may determine and/or update the trainee limits at the start of or during the execution of an exercise routine program. FIG. 5, described below, illustrates a representative, nonlimiting example of a user limits process executed by the device controller 110.

When executing a planned movement according to an exercise routine program, the device controller may use position control, velocity control, torque/force control, or a combination of them, for example, when executing the planned movement, in addition to using feedback signals mentioned above. Alternatively, the device controller may choose (by default or based on the nature of the planned movement) to use feedback control to execute a planned movement involving movement of the exercise interface. For example, to move the interface to a specified point within the coordinate frame of the device motion space or workout space, the device controller may rely on servo-position actuators that move the joints until a specified position of the actuator is reached without regard to velocity, force, or trajectory. If the movement requires that only one joint be moved, the other joints could be locked by locking actuators that move those joints. A lockable actuator can be locked to a position from which it cannot be moved by a force less than the maximum force that the actuator can generate. The threshold force may, for example, be greater than forces that may be transferred to it from a typical trainee or one or more of the other actuators.

Position control may be appropriate when the trajectory of the exercise interface is not as important, such as when a target velocity is not specified or is allowed to vary within a wide range or when the force of the actuator or actuators being displaced cannot be controlled. However, trainee limits might not be observed without using velocity and/or force or torque control loops. Using a combination of position and velocity control, position and force control, or a combination of position, velocity, acceleration, and feedback control to enforce, for example, trainee limits can be observed. Additionally, trainee position sensing may, optionally, be used as an additional feedback input for use in a controller's processing of other input signals to determine a position, velocity, acceleration, or force applied to the exercise interface or as part of a process to generate controls signals that observe any applicable limits on device motion, including trainee limits.

Without velocity control, the trajectory of the TCP is difficult to control. Therefore, the executed path of the exercise interface could vary depending on the magnitude and direction of the force that the trainee applies to the exercise interface. However, this type of control might be desirable or acceptable for some types of movements. If not, the device controller is, optionally, programmed or configured to control the motion of the exercise interface by varying force in response to feedback signals on the position and velocity of the exercise interface and/or trainee to maintain the movement of the exercise along a trajectory that achieves a planned path.

The device controller may, optionally, be programmed or configured to control actuators in response to feedback signals to achieve or maintain target values for one or more conditions, such as the velocity and acceleration of the exercise interface and force applied to the exercise interface. A target value can be a specific or set value, a minimum value, a maximum value, or a range of values for any one or more of the conditions. A target value for a condition is in addition to any trainee limits for the condition, or it can be the trainee limit for the condition if no other target value is specified.

The exercise routine may, for example, intentionally allow for deviations from a planned path or calculated trajectory and, once a predetermined amount of deviation occurs, introduce a sudden, unexpected, unanticipated, or abrupt change from the trainee's perspective to the exercise interface's trajectory. For example, this change may be made by changing any one or more of the following: the path along which the exercise interface is being moved or the exercise interface's velocity, acceleration, and/or force. The change may, for example, include switching to another planned movement that is part of the exercise routine.

As represented by FIGS. 1 and 2, multiple exercise routine programs may optionally be stored in a library 114 on the host computer 112, from which they can be selected and downloaded to device controller 110 memory for execution. The library may, instead, be stored locally or remotely, such as by remote data service, if accessible to the host computer. The library represented in FIG. 1 contains representative examples of exercise routines. Furthermore, input variables 200 that might be needed for the execution of an exercise routine configuration can also be stored on the host computer 112 for download to the device controller 110 in connection with the execution of the exercise routine, as indicated by FIG. 2, or remotely if accessible by the host computer 112 or device controller 110. The interface application running on computer 112 may be used by a person, such as a trainee, trainer, or device operator, to select and configure options for an exercise routine program, including entering one or more input variables 200. Representative, nonlimiting examples of possible types of input variables include the type of sport; player position; duration of the exercise routine; movements included in the exercise routine, workout, or training session; the number of repetitions for the training session; the intensity level for the session and/or each repetition; performance goals and biometric thresholds for the trainee; and any other information needed for execution of the exercise routine program. The trainee, trainer, or operator of the exercise device could enter this information, or it could be generated from information provided by or stored by the host computer (or remotely) by the trainee. The variables required, if any, to execute an exercise routine may depend on the exercise routine.

The host computer 112 may also provide long-term storage for trainee performance data, long-term storage of exercise routine programs, editing and compiling of exercise routine programs, and hosting data accessible through a local area network (LAN), wide area network (WAN), cellular mobile data network, edge network, or other type of network, including the public Internet. Data and/or programs may also be transferred to and stored on an attached device or a remote server accessible through a network or internet connection and downloaded on demand.

Figure 3:
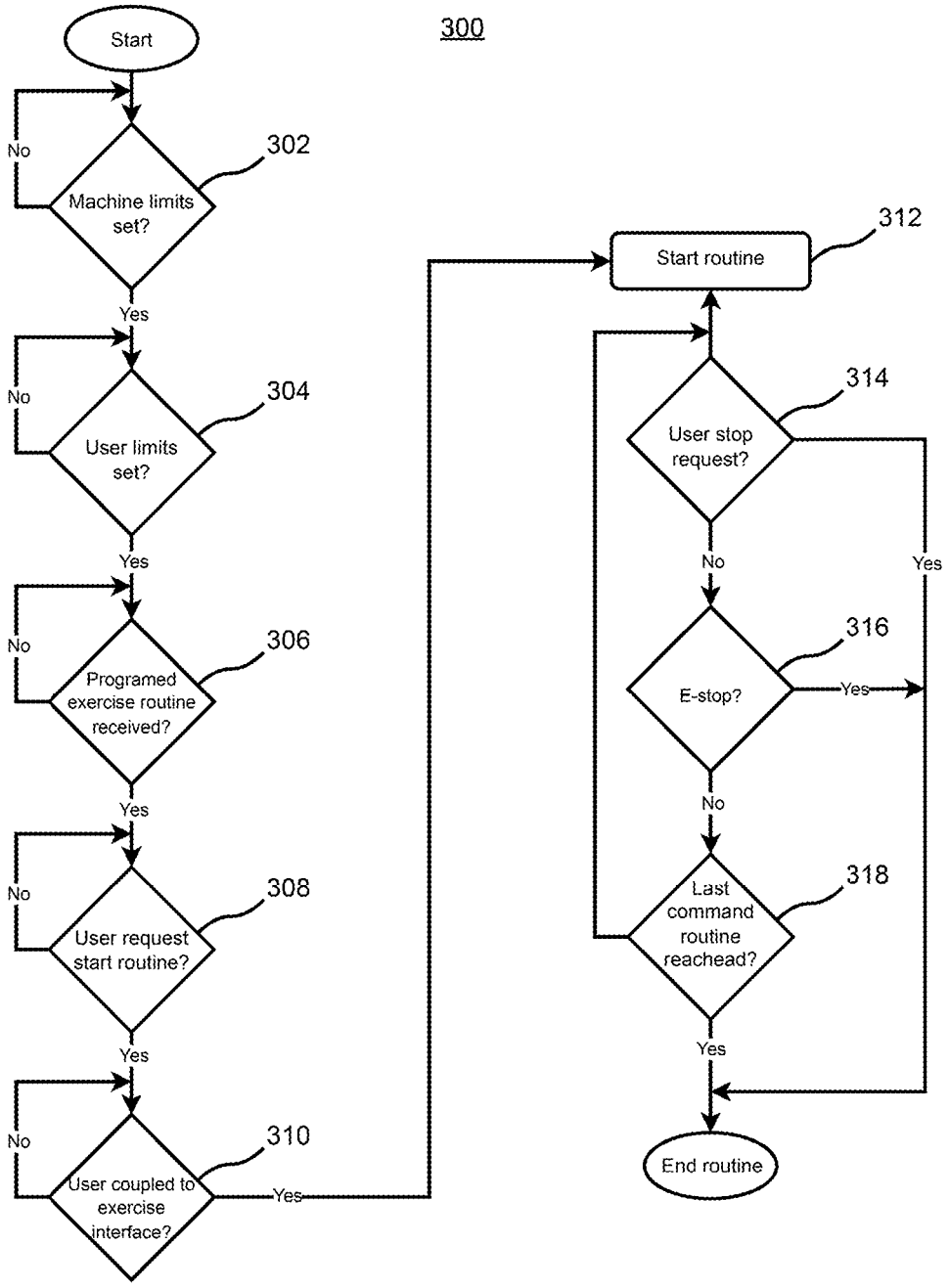
FIG. 3 is a flow diagram of a representative example of a start process for an exercise routine that may be used with a training device, such as any of those described herein.

The flow diagram 300 of FIG. 3 is a representative example of a start process for an exercise routine run by the device controller 110 or, optionally, partially by the host computer 112 in coordination with a process on the device controller. The process checks at step 302 that machine limits have been set and at step 304 that user limits have been set. At step 306, it waits for a selection of an exercise routine, including any options, and downloading, if necessary, the exercise routine program into the device controller. Once loaded for execution, the device controller waits, as represented by step 308, for a request to start the exercise routine and, depending on the exercise routine, checks at step 310 whether a safety disconnect is engaged (and/or whether a trainee is engaging and/or positioned correctly relative to the exercise interface) which will allow the device controller to immediately slow or stop movement of the user interface if the connection is interrupted. A connection could be, for example, interrupted if the trainee lets go or moves too far away from or too close to the exercise interface. Once the execution of the exercise routine starts at step 312, the device controller executes the exercise routine unless and until a user stop request is made at step 314, an "e-stop" trigger is received at step 316 from a safety or other process running on the digital controller, such as any that have been mentioned or disclosed, or the exercise routine ends at step 318. An exercise routine program loaded onto the device controller 110 may, optionally, continue to be the exercise routine program executed by the device control when a workout is started until a new program is loaded from the host computer or the device controller is reset.

Figure 4:
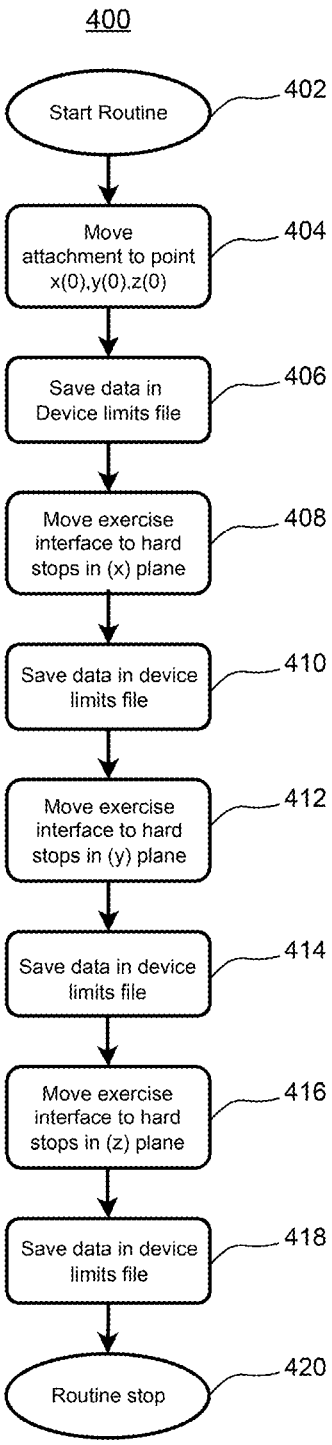
FIG. 4 is a flow diagram of a representative example of a routine for use that may be used with a training device, such as any of those described herein, to map a device motion space.

The flow chart in FIG. 4 illustrates a representative, programmed process of the device controller to map within a coordinate system the range of motion of the joints and actuators by moving the TCP of the exercise device and thereby establishing the boundaries of the device motion space. The coordinate system may but is not required to be a two- or three-dimensional cartesian, polar, cylindrical, spherical, and/or other type coordinate system. However, other types of coordinate systems can be used if appropriate. A three-dimensional cartesian coordinate system is assumed for the exemplary process, though it may be limited to two dimensions. The process is run, for example, when the exercise device is set up or when necessary or desired, as mentioned above. Once started at step 402, the TCP for assembly 103 is moved at step 404 to a point chosen as an origin or starting position. The configuration of joints and/or actuators as this position is stored at step 406 in the exercise device's configuration or limits file. As represented by steps 408, 412, and 416, the TCP is moved to hard stops—where the range of motion of the joints in the assembly 103 end or stop—along each of the coordinate system axes. As indicated by steps 410, 414, and 418, the coordinates of the hard stops and, optionally, the configuration of the assembly 103 in terms of the relative positions of the joints and/or actuators are stored in the exercise device configuration or limits file. The process then ends.

The flowchart of FIG. 5 is a representative, nonlimiting example of a trainee limits assessment routine or program that may, optionally, be used to determine limits on the ability of the user to move and/or resist movement in the exercise interface 102 in multiple directions at predetermined velocities and/or under predetermined forces of the exercise interface. Once the routine is started at step 502, the user moves the exercise interface to a first point at step 504, a second point at step 508, and, optionally, up to N points, as indicated by step 512, and after each step data collecting during the movement step is stored in a trainee limits database, file, or profile, as represented by steps 506, 510, and 514. The routine may be repeated one or more additional times, up to N times, as represented by step 516. The device controller can change the velocity, acceleration, and/or force with which the exercise device moves or resists movement for each repetition.

A training limits routine process allows a user to apply or resist forces/torques and motion to the exercise interface in one or more directions within the device motion space or limited device space to collect baseline metrics data. Trainee metrics data would allow a trainer to set up the exercise device within the trainee's known physical abilities before a session. Setup of the exercise device using such data may allow a trainee to engage in a more productive exercise routine and/or reduce the risk of injury.

Representative, nonlimiting examples of types of exercise routine programs described below illustrate how the execution of exercise programs by the device controller may move the exercise interface to cause, assist, allow, require, or direct a person to perform exercises for any one or more of the disclosed purposes or applications.

Movement by the device controller of the exercise device while executing at least some of the examples of exercise routine programs inherently include or may be implemented to include the device controller controlling the device's actuators to move the exercise interface in a direction or with a force, acceleration, or velocity, or any combination of two or more of these properties, which is unexpected to at least the trainee. An unexpected motion is, for example, unanticipated, sudden (done quickly and unexpectedly, without warning), or known in advance to the trainee. Such motion may, for example, be an initial movement that is not known in advance or a sudden change in the current motion of the exercise interface. A sudden change in motion may be a sudden change in the current trajectory of the movement of the exercise interface. Unexpected movements may improve response time, fast twitch, and train for sports-specific movements. The device controller may be programmed to control the actuators to create one or more unexpected motions of the exercise interface in different ways.

A choreographed exercise routine would include instructions for a planned movement or a series of planned movements. The routine would consist of one or more preselected exercise actions. Choreographed routines can be very simple or complex, depending on the goals of the exercise routine. Such routines are most suitable for strength training, rehab, response time, fast twitch muscle development, training for specific sports moves, coordination, muscle memory, and agility, performance metrics data collection, and entertainment.

A real-time exercise routine permits another person to interact with the trainee in real-time. The program for the exercise routine may include instructions to use trainee limits for the routine and a planned movement with parameters or variables to instruct the control device control how to interpret input from an input control device and, based on the input, control the movement of the exercise interface according to the input. The control input device is operated by another person in real-time, such as a trainer watching the trainee. Examples of such devices include manually operated devices such as joysticks, game controllers, remote controllers for vehicles, and computer I/O devices such as keyboards, trackpads, and mice. The input control device may also include devices that detect the movements of the third person, such as optical motion capture devices (cameras and LIDAR, for example) and/or voice commands. The third person could be a trainer or coach teaching specific exercises or movements for a sport or, possibly, a person moving like an opponent or teammate in a sport might move. A real-time exercise routine would, for example, specify a planned movement to move the exercise interface 102 according to an endpoint, trajectory, path or indicated by the control input, subject to any targets for velocities, forces indicated for the planned movement and if trainee limits are to be applied.

An adaptive exercise routine is one in which the device controller adapts the programmed exercise routine. Examples of adaptions include selecting and executing a planned movement from multiple options for planned movements or changing a planned movement during execution. An exercise routine using adaptive motion might, for example, be suitable for an exercise routine that simulates or imitates a real-world opponent in a sport that is, for example, trying to outmaneuver the trainee. The adaptations made by the device controller when executing the instructions of the exercise routine could or will result in movements of the exercise interface that are not expected or anticipated by the trainee or trainer.

Adaptions may be made in several different ways. For example, a planned movement in the exercise routine can instruct the device controller to change the motion of the exercise interface in response to a trigger. The trigger may, for example, be based on feedback signals indicating the state of the exercise device, exercise interface, or trainee. Some examples are given above. These might include, for example, conditions of or deviations from planned movements or timings that exceed or fall below a specified threshold, range, or limit. Example conditions include the state or configuration of the exercise device (the relative positions of its joints or actuators) or the corresponding position of the exercise interface within the frame of reference of the device motion space or workout space, the actual trajectory of the exercise interface (its direction and velocity), deviations from a planned path or trajectory, the velocity or acceleration of the exercise interface and/or forces applied to the exercise interface, how a trainee is moving with respect to the exercise interface or engaging with it, the posture or position of the trainee, or combinations of any two or more of these or other conditions that can be determined from feedback signal to the device controller.

The adaptation may, alternatively, be triggered randomly or in other ways. Different triggers may initiate different adaptations during an exercise routine.

An adaptation of a planned movement being executed in response to a trigger condition could, for example, change one or more variables in the instructions for the planned movement. These variables could include any one or more of those disclosed above, such as planned path or trajectories, planned endpoint, target velocities, and target accelerations of the exercise interface, as well as target forces applied to the exercise interface. The exercise routine may also instruct switching to a different planned movement.

The nature and size of the change could be, for example, based on the instructions in the exercise. However, other states and conditions may be considered when inputs are made to the device controller. The instructions may, instead, involve random selection of the type of change and size. The instructions may ensure that the nature and size of the change are sufficient to be sensed and force the trainee to react quickly and activate fast twitch muscle fibers. Examples of unexpected or unanticipated changes in motion are given above and below.

A random exercise routine involves instructions that cause the device controller to move the exercise interface in a randomly selected manner using a randomizing process. Such movements would inherently be unknown or unanticipated to the trainee or others, such as a coach or trainer.

For example, the random exercise routine might instruct the device controller to move the exercise interface in an unplanned or randomly chosen way and/or change its motion at a random time. It may, instead or in addition, involve random selection from among two or more possible planned movements in the exercise routine at the start of the exercise routine, after a planned movement, or at a randomly selected time. The random motions could be any of the adaptations of an executing planned motion mentioned above. It might also involve creating a movement with one or more randomly selected variables, such as any one or more of the endpoints, path, trajectory, target velocity, target force for the movement, or size and/or shape of the exercise interface, such as when it can be adapted through adjustments or can be replaced with a different exercise interface. In any of these examples, the trainee and others, such as the trainer, would not know what motion or change might be next. Thus, depending on the nature of the random movement, the trainee may need to react quickly to it to continue to engage the exercise interface, which may also activate fast twitch muscle fibers. To enable it to make a random selection or change that would be unknown and thus unanticipated to the trainee and others, the device controller may, for example, use a process for randomizing the selection or change. The process may use, for example, a pseudorandom number or value generator.

Other examples of exercise routines with random motion may include instructing the device controller to make a random selection from two or more exercise actions selected by a trainer or trainee and compiled in a program. The program may also include variables for skill level and the random actions that can be selected before the session starts.

The programming, selection, and/or execution of exercise routines may, for example, be based on the training goals and preferences of the trainer and trainee or just for entertainment. Nonlimiting examples of training goals or preferences include strength training, rehabilitation, improved response time, fast twitch muscle development, range of motion goals, coordination improvement, training of specific sports moves, performance metrics data collection, or any two or more of such goals and preferences.

The device controller may also be configured with programs that imitate or simulate a real-world sport or exercise activity, imitate or simulate actions or movements of a specific individual player in a sport, such as an opponent or teammate, or both for purposes of practicing sport-specific movements and/or specific situations. Exercise routines that simulate real activities, game scenarios, or opponents may also require fast response and power by having the exercise device imitate an opponent, such as one having a similar or better skill level, quickness, and/or strength. An athlete in a specific sport or activity may benefit from exercise routines that simulate real game scenarios that require fast response and power by having the exercise device imitate an opponent, such as one with a similar or better skill level, quickness, and/or strength.

As an example, a device controller may be configured by an exercise routine program to control the movement of the exercise interface to simulate unexpected movements of a lineman or other football player positions (for example, a linebacker, tight end, or running back) using adaptive motions to change planned paths, calculated trajectories, velocities, and forces of the exercise interface, such as those described above, or to switch between planned movements.

Professional American football linemen are some of the strongest and largest people on a football field. However, though they might not be the fastest sprinters, they generally must have very fast reaction times coupled with an ability to move with agility and generate the explosive power needed to play the position successfully. Professional or high-level football players and those interested in becoming professional or high-level football players may use the exercise device when configured to practice moves specific to a position and/or situations that might be encountered and develop fast twitch muscles and/or improve reaction times.

A non-limiting, representative example of a scenario that could be simulated with a programmed exercise routine would be simulating with the exercise interface either a defensive or offensive player lining up across from the trainee at the beginning of a play and then, in effect, executing a play by moving the exercise interface to simulate actions of the opposing lineman.

For example, if the controller for the exercise device is enabled to execute instructions simulating an offensive lineman, it may be programmed to create a cue that corresponds to a snap of the football, hold the exercise interface position, determine the direction and velocity of movement of the trainee, begin a planned movement that repositions the exercise interface to keep it between the trainee and a target—a player with a football, for example, or possibly an assigned gap—that the trainee is trying to reach or occupy. The repositioning movement might also be based on a trainee or trainer-selected blocking move or one chosen from several possible blocking strategies either randomly or based on the trainee's movement. When the trainee contacts or hits the exercise interface, the device controller may switch to a second planned movement to control the motion of the exercise interface to move it (and/or optionally change its orientation, size, or posture), applying a force to the exercise interface to counter the force placed on it by the trainee according to the original blocking strategy and based on feedback signals indicating any one or more of the detected or estimated position of the trainer, the speed and direction of movement of the trainee, body position of the trainee, and the vector and magnitude of force (forces may include torques) the trainee is applying to the exercise interface. The planned movement might, for example, instruct the device controller to control the application force to maintain the position of the exercise interface, at least up to a certain limit set by the planned movement (or the trainee or device limits), or to apply force to allow the trainee to push the exercise interface along a trajectory that maintains the position of the exercise interface between the trainee and target, with a target velocity that is, for example, relatively slow. The device controller may be configured to use both position and velocity feedback control to do this. It may, for example, increase or decrease the displacement and/or force generated by one or more actuators to maintain the desired trajectory. The exercise routine program may, optionally, configure the device controller to switch to a different planned movement if, for example, the trainee overpowers the forces applied by the actuators and moves the exercise interface faster than the target velocity.

The device controller may be configured with one or more planned movements that implement a blocking move or strategy, in which the device controller controls the actuators to move the exercise interface away from a target when a trainee is moving too quickly toward or taking an indirect path to the target. This planned movement may be executed, for example, based on the initial movement of the trainee in reaction to the cue or to a subsequent change in the movement of the trainer for which the blocking strategy is appropriate or might be used by a known individual who is an opponent. After execution of this planned movement, the routine could, for example, switch to a different planned movement that carries out the next part of the blocking strategy or switch to another planned movement or blocking strategy.

In another example, an exercise routine program configures the device controller to cause the actuators to move the exercise device in a manner that imitates, for example, a linebacker tracking a moving virtual target while the trainee practicing as an offensive lineman attempts to block the user interface as it moves toward the target. The moving virtual target could be, for example, a running back with the football. Conversely, the device controller may, for example, be programmed to act like a blocker for a virtual target, such as a player with the ball. The virtual target moves laterally, for example, the device controller moves the exercise interface laterally and toward trainee to imitate a blocker. As a defensive player such as a linebacker, the trainee tries to avoid being blocked by exercise interface while moving with and/or toward the moving virtual target. The position of the moving target may, optionally, be indicated to the trainee.

Wrestlers make quick, sudden moves when engaging or changing holds to outmaneuver an opponent and take them down to the mat to be pinned. Much like the football lineman example, defensive or offensive wrestling moves could be programmed to train or evaluate the quickness of wrestlers by imitating the movements of an opponent. An exercise routine program may configure the device controller to execute variations of these examples.

Artificial intelligence (AI) systems trained on real-world events may be used to create exercise routine programs for configuring a device controller to move the exercise interface to make sport-specific or other movements, or to control the device controller's execution of programs. For example, an AI system is, optionally, used to select movements from a library of programmed movements, determine the order of execution of selected movements, modify programmed movements, and/or determine values or settings for parameters or variables to be used when executing the movements for purposes of creating an exercise routine program for execution by the device controller.

Processes described above in connection with FIGS. 1 to 6 may, optionally, be used to limit how quickly the exercise device reacts to a trainee, the velocity with which it moves the interface, and the amount of force it applies to simulate reasonably accurately a real-world opponent or teammate.

The examples of exercise devices, control methods, and exercise routines disclosed above and below enable, if desired, implementation of training methods in a controlled environment which involve unpredictable, sudden movements with equivalent or greater force and velocity than a human opponent by configuring the device controller with processes that constrain execution of exercise routine to improve safety or reduce risk of injury as compared to live practice against an opponent. For example, the device controller may be configured with one or more processes that set and/or enforce limits on movement of the exercise interfaced based on the physical abilities or skills of a trainee. Such limits may be referred to as trainee limits. The device controller may, optionally, be configured to execute one or more processes before or during execution of an exercise routine program to predict or detect a risk of a high energy impact between the trainee and exercise interface or another condition that might injure the trainee and change its movement of the exercise interface to mitigate the risk of injury to the trainee.

The device controller may, for example, be configured to execute programs used for evaluating an athlete's abilities to perform in a sport. For example, a coach helping an athlete improve strength and skills in a sport may, for example, use the exercise device to an assess the athlete's strength and skills. Teams and their scouts may use an evaluation program when evaluating potential recruits or hires. An evaluation program may, for example, be used to collect and store data on individual athletes over a period, such as a season, multiple years, or a career, to evaluate performance over time. Data gathered on an individual could also be used in future device programming to simulate specific opponents in each sport for preparation training for the next match or game and for gaming purposes.

The device controller or other system may be configured to receive sensor data concerning the trainee and digitally record and store it for later evaluation. Some performance data may be available and displayed to the trainer and/or trainee in real-time during the training session.

Referring now to FIGS. 6 to 14, each figure is a kinematic diagram or schematic of a representative, nonlimiting example of a programmable exercise device. Each example has an assembly that includes at least two joints and two or more actuators (which may also be a joint). A device controller is configurable to move according any one or more of the representative examples of programs disclosed herein. In the examples, the actuators are represented kinematically as a joint. However, in practice, the output of an actuator may, instead, be coupled to a joint through a transmission. Furthermore, multiple joints may, optionally, be configured to be actuated by a single actuator. In these examples, an actuator generates either linear or rotary motion—a displacement—that causes the joints to move, resulting in movement of exercise interface 102 to perform exercise routines such as those described above. A device controller is configured to coordinate and control actuation.

In the disclosed examples and illustrated embodiments, the configuration of the assembly of joints and actuators is configured allows a device controller to translate the control point of the exercise interface 102 to any point within a device motion space along any path within the space. In these examples, the device motion space is a two-dimensional plane having X and Y axes, as indicated by coordinate axes 1020. However, the exercise device may, optionally, be configured to translate within a device motion space that is three-dimensional having, for example, X, Y, and Z axes. The exercise devices in these figures have two but optionally more degrees of freedom to translate the exercise interface within the device motion space. The exercise device in these examples also has one degree of freedom for rotation of the exercise interface about the control point for the exercise interface. However, in any of the examples, the exercise interface's connection at the TCP to the assembly of joints and actuators may, optionally, have more than one DOF of movement or zero DOF with respect to the TCP.

A programable logic controller (PLC) 1002 is part of a device controller. It issues motion commands to one or more motion controllers 1004 based on programmed algorithms that implement, among other processes, movements of exercise interface 102 according to an exercise routine program loaded onto the PLC. The motion control device 2004 then energizes the actuators to move the actuator according to the motion command, causing the exercise interface 102 to move as trainee 104 engages with it. The PLC may, for example, be programmed to function like the device controller 110, as described above.

In the examples illustrated by FIGS. 6-14, the device motion space is a two-dimensional horizontal plane. The example configurations are configured to translate the exercise interface 102 in a plane above and parallel to a surface, such as the ground, where the trainee 104 stands and moves to any point within a two-dimensional device motion space 1001. The device motion space 1001 in each figure is intended only as a schematical representation. The shape and dimensions of the device motion space are defined by the range of motion of the assembly of the joints and linkages and the range of motion of any actuators that are not joints. The device motion space is not limited to and does not require a specific shape. However, the area is preferably large enough to accommodate exercise routines that move the exercise interface in X and Y directions within a planar workout space between any two points in the device motion space. For purposes of the description, the movement of the exercise interface will be described in reference to a cartesian coordinate system in fixed relation to the device motion space 1001. However, a programmable controller that moves the exercise interface is not required to use a cartesian coordinate system for control.

In the examples of FIGS. 6 to 14, exercise interface 102 is coupled to the exercise machine through a revolute actuator 1010*a* to rotate its orientation about a vertical axis (not indicated) extending through the revolute joint, which is assumed to be, but is not required to be, located at the tool control point. The PLC 1002 may, for example, be configured to actuate the revolute actuator 1010*a* as necessary to maintain the orientation of the exercise interface (within the reference device motion space and, thus, in effect, also within the reference frame of the user) as it is being translated. Optionally, the PLC may be configured to allow the exercise program to change the orientation of the user interface according to the exercise routine program being executed. Optionally, additional degrees of freedom of rotation may be added at the coupling by, for example, one or more additional revolute joints, by a joint that has two or more DOF of movement, or by other combinations of joints. An additional DOF could allow, for example, a change in the pitch of the exercise interface relative to the surface on which the trainee is moving, which would be rotation about a horizontal axis through the coupling.

The PLC may, optionally, have multiple levels of programming. A first level of programming may include, for example, programs to perform device limits processes that limit the device motion space or dynamics. A second level of programming may, for example, include exercise routine programs. For example, the PLC can be configured to perform a device limits process upon startup, before loading and/or execution of an exercise routine program, to discover mechanical limits for movement of the assembly 1003 and thus determine boundaries of the device motion space 1001. It may also be used to set minimum and maximum values for a range of motion, travel distance, velocity, acceleration, or forces or torque of any one or more, or all, actuators during the execution of exercise routine programs. The process may, optionally, disallow or limit the execution of the exercise routine program if its execution exceeds any of these limits.

The PLC 1002 has multiple input channels for sensors and output channels to control the movement of the actuators. The position, force, torque, and/or velocity of an actuator may be converted into an electrical feedback signal 1005 by sensors (not indicated) associated with the actuators and transmitted to inputs on PLC 1002. Sensors associated with exercise interface 102 and trainee 104 give feedback signals 1007 to the PLC. These are optional. The feedback signals are inputs to the PLC. They are used as described above in connection with the operation of the device controller 110 of FIG. 1 to determine the next action of each actuator. After the PLC calculates the next action for each actuator, it generates command signals on its outputs for motion controller 1004. The motion controller uses PLC output signals to generate control signals 1006 to operate drivers and valves that directly supply or turn on power to the actuators to cause them to move.

In the exercise devices illustrated in FIGS. 6-14, the actuators are either prismatic actuators 1008 or revolute actuators 1010. Each actuator of a particular type in a figure is referenced typically, but not always, with letter suffixes to distinguish them. Using the same reference number or suffix for an actuator in different illustrated examples is done only for convenience to describe the concepts illustrated by the respective embodiments. It does not imply any requirement that an actuator chosen to practice an exercise device, according to one of the examples, must be capable of being used in an exercise device while practicing another example.

Each actuator also functions as a joint with one degree of freedom (DOF). In some cases, the actuators are connected to other elements—for example, a linkage, frame, or other actuator, for example, through a joint that is not part of an actuator. In these examples, revolute joints 1012 provide a one DOF connection. However, other types of actuators and joints could be substituted.

The assembly of actuators and joints couples the exercise interface 102 to frame 1014, generally indicated by the ground symbol. Frame 1014 has a fixed relationship to the exercise or device motion space 1001. Frame 1014 supports the exercise interface's movement by the assembly of joints and actuators above the surface on which trainee 104 is positioned when engaging it. The trainee may, for example, engage it while standing, sitting (on the surface or an object on the surface), kneeling, crouching, or otherwise. In these examples, exercise interface 102 does not move vertically. Frame 1014 may, for example, be a stationary structure installed at a site. Such an installation might allow a frame to support an assembly with a greater range of motion and, thus, a larger device motion space than a mobile or non-stationary frame. Alternatively, the frame may be configured for transportation between sites or such that it is otherwise mobile. For example, it could be configured to be transported on a trailer and offloaded or permanently mounted on a towed trailer or road vehicle that is parked and stabilized. It may, optionally, be mounted on a mobile platform capable of being moved around a site.

The frame 1014 may, optionally, be adapted to support two or more individually controlled exercise interfaces. Each exercise interface may be controlled for independent movement using controllers operating separate exercise routines or, optionally, coordinated movement, in which case a single controller running an exercise routine programmed to control the movement of the multiple exercise interfaces or, optionally, multiple controllers running separate exercise programs that are coordinated by, for example, sharing feedback signals from sensors on the exercise device or by generating input signals for each other.

During the workout routine, data from all sensors may, optionally, be collected by a data acquisition system 1016 and sent to user interface 1018, which can be implemented using one or more applications running on a connected computer, a remote computer, or as a remote server or cloud-based software system. The user interface may store the data for later evaluation and viewing. It may also be used to display real-time data and performance evaluations during the user interface workout.

Figure 6:
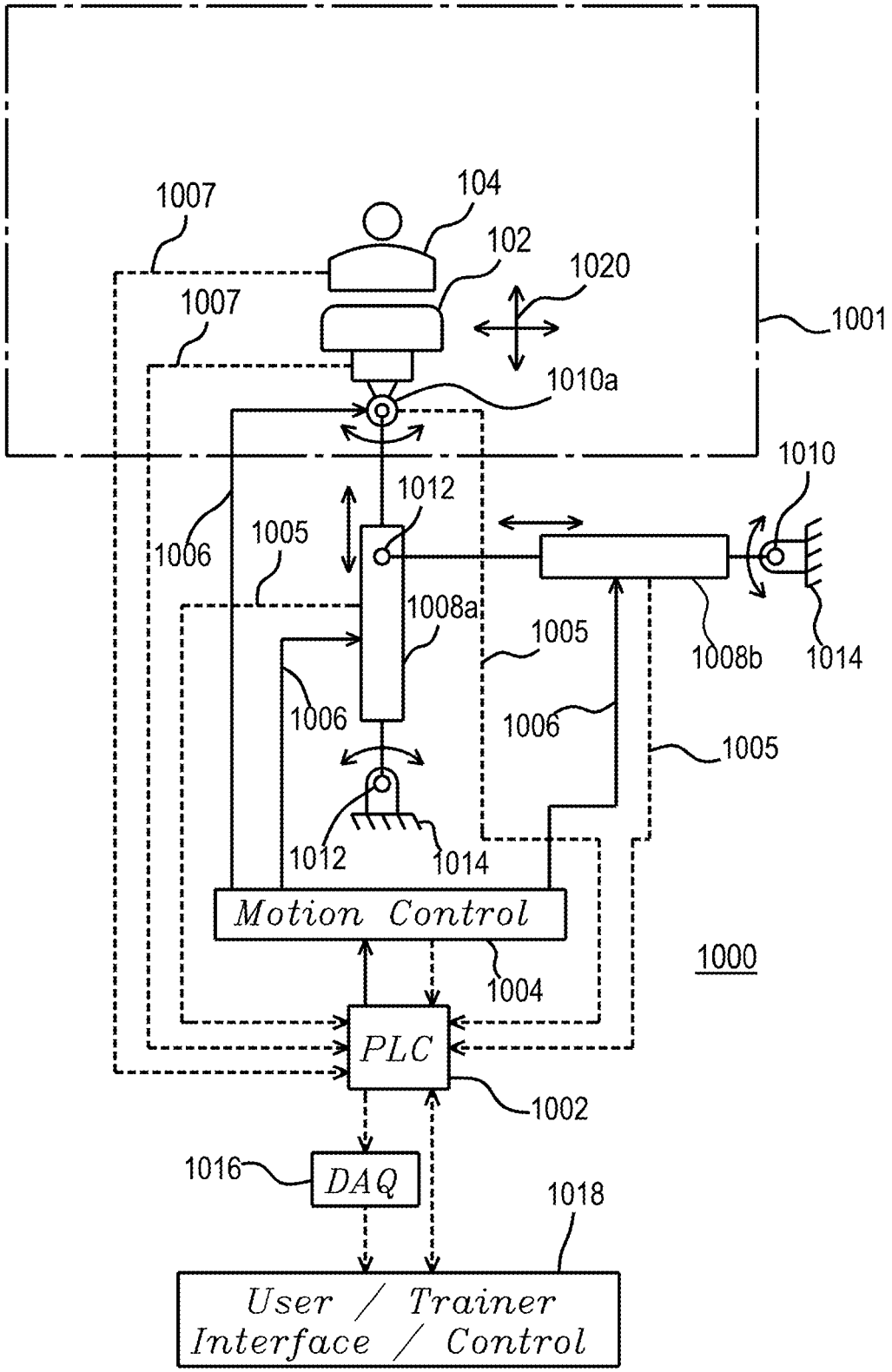
FIGS. 6 to 14 are kinematic representations of examples of representative, non-limiting embodiments of exercise training devices.
Figure 7:
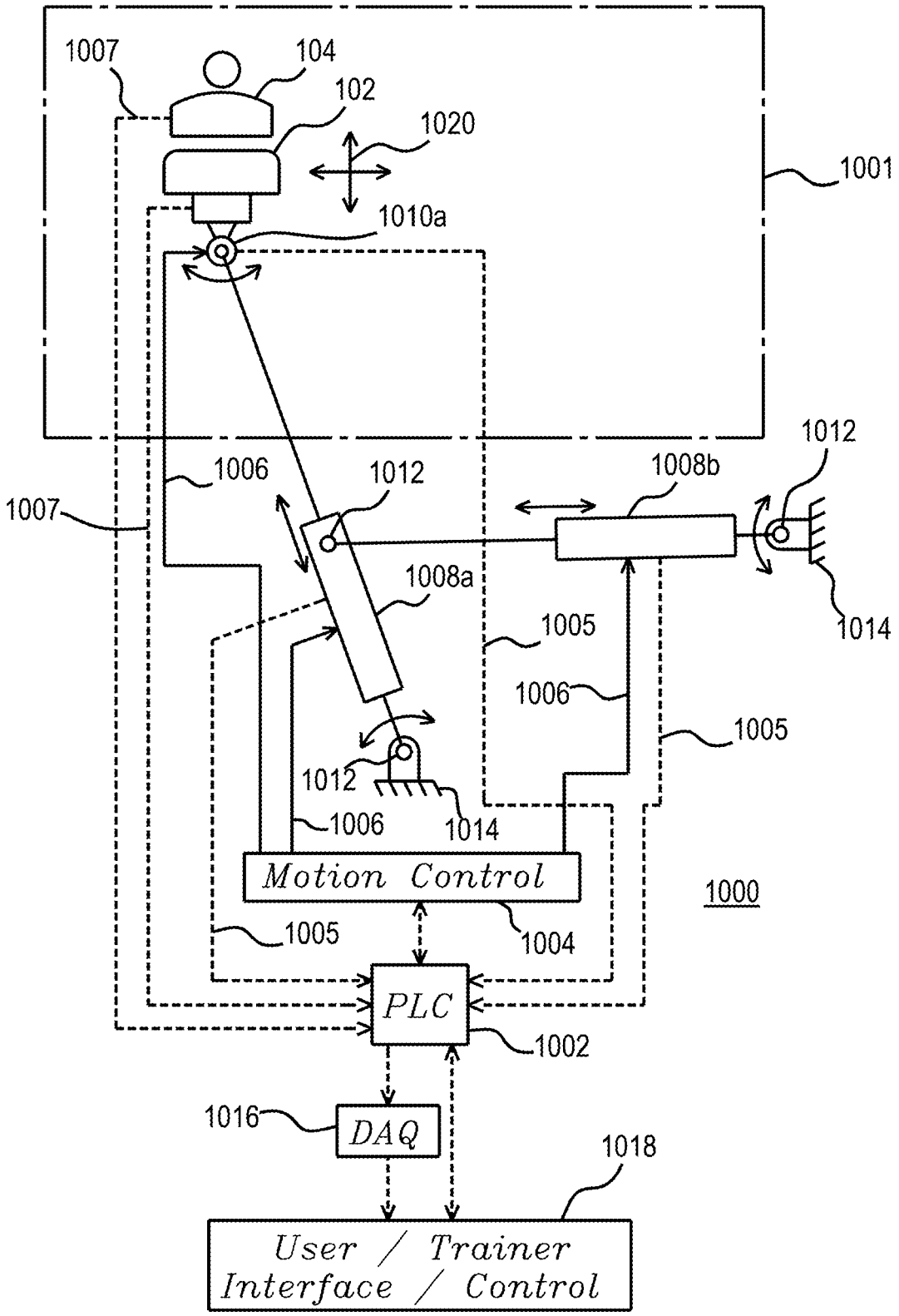

FIGS. 6 and 7 illustrate a kinematic or schematic diagram for a representative example of an exercise device 1000 with the exercise interface in two positions. The exercise device 1000 has two prismatic actuators, 1008*a* and 1008*b*, each coupled at one end to frame 1014 through a revolute joint 1012. The first of the two prismatic actuators is connected to a revolute actuator 1010*a*, which is coupled to exercise interface 102 to move the exercise interface in and out, while the second prismatic actuator pivots the first prismatic actuator about the revolute joint 1012 the revolute that connects it to the frame. The revolute actuator that connects the first prismatic actuator to the exercise interface 102 allows the exercise device to rotate the orientation of the exercise interface as it is being moved, as seen in FIG. 7.

Figure 8:
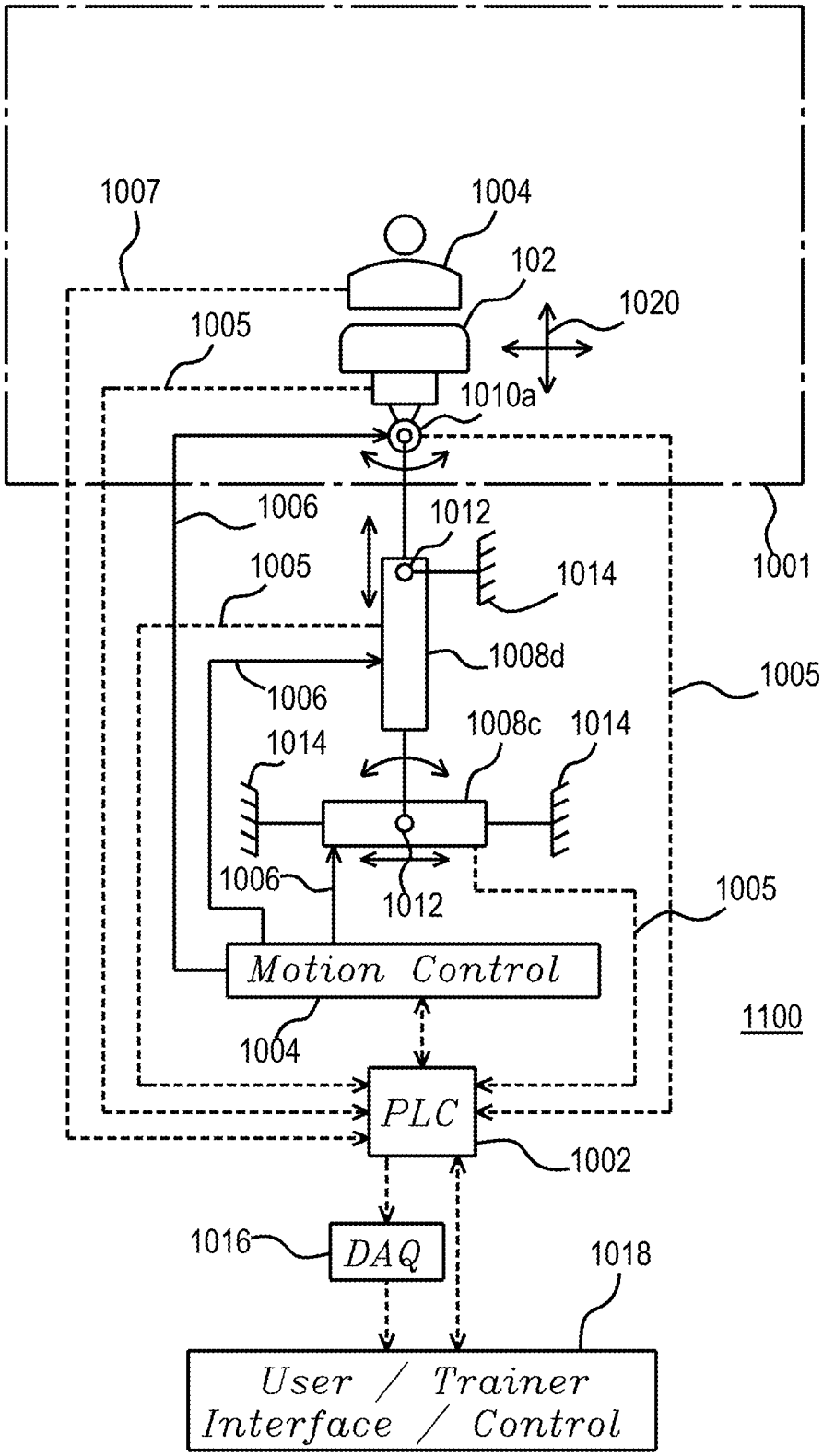

Exercise device 1100 of FIG. 8 also includes a first prismatic actuator 1008*c*, and a second prismatic actuator 1008*d*. The first prismatic actuator 1008*c* is connected at each end to frame 1014. Its activation will shift the body of the prismatic actuator laterally in either of two opposing directions. Like the exercise device 1000, one end of the second prismatic actuator 1008*d* is coupled with a revolute actuator 1010 attached to the exercise interface 102. The other end of the second prismatic actuator 1008*c* is connected to the body of the first prismatic actuator 1008*d* through a revolute joint 1012 so that it can pivot to change the direction in which it extends and retracts the exercise interface when the first prismatic actuator shifts laterally.

Figure 9:
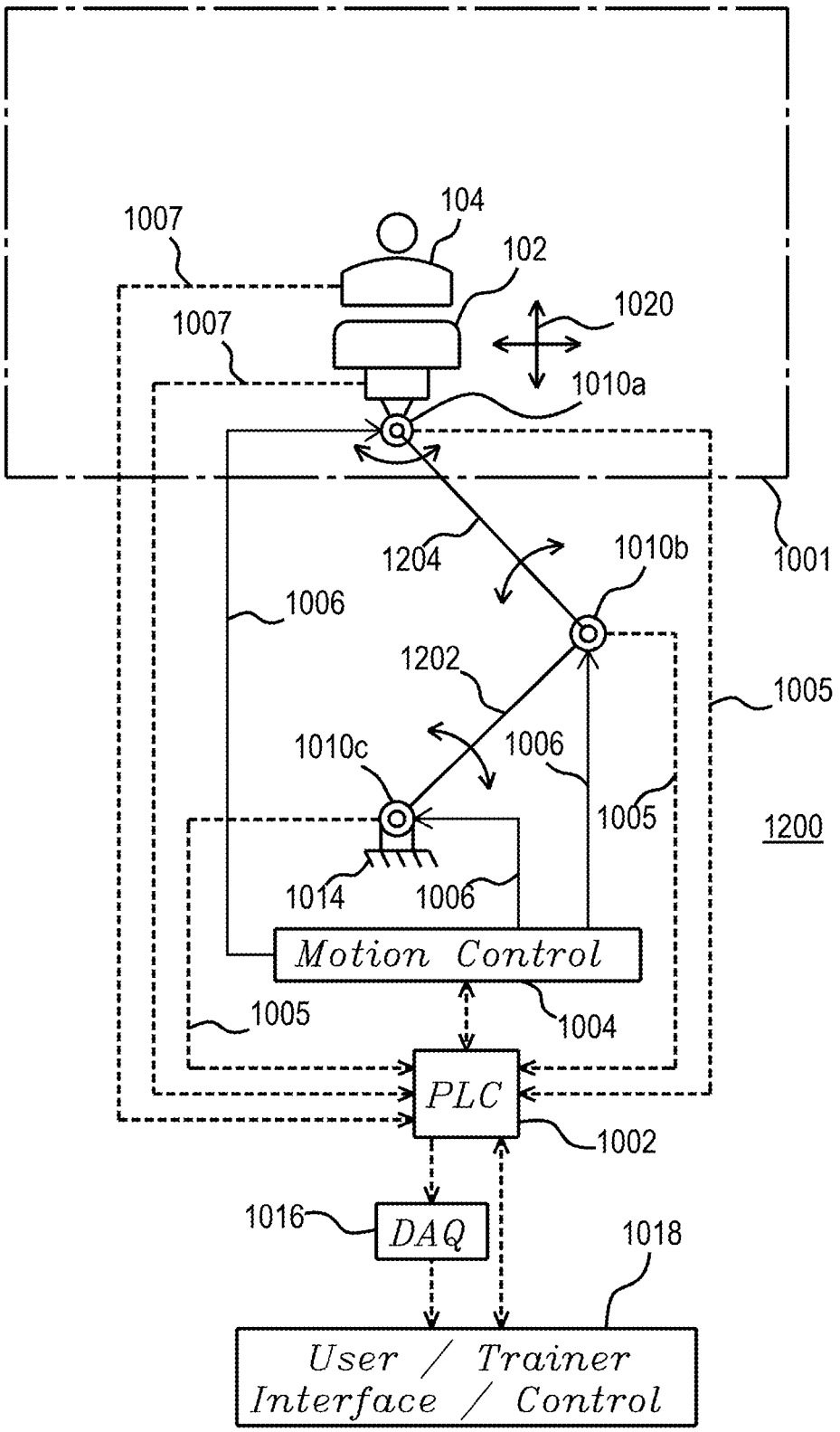

FIG. 9 illustrates a kinematic schematic of a representative example of an exercise device 1200 that employs an articulating arm with shoulder, elbow, and wrist joints, implemented using three revolute actuators that are connected in series by two fixed-length linkages, 1202 and 1204. Revolute actuator 1010*c* connects linkage 1202 to frame 1014. Actuation of it swings the linkage 1202 in a fixed arc in the two-dimensional horizontal plane of the device motion space 1001. Revolute actuator 1010*b* joins linkage 1202 to linkage 1204. Actuating it pivots or swings linkage 1204 in an arc about the joint. Linkage 1204 connects to revolute actuator 1010*a*, to which the exercise interface is connected. Actuation of the second revolute actuator while locking the base revolute actuator can, for example, translate the control point of the exercise interface 102 along a fixed arcuate path within the device motion space. Revolute actuator 1010*a* may, optionally, be actuated to change the orientation of the exercise interface as it translates along the arc. All three actuators are moved to translate exercise interface 102 along a straight path while also keeping the same orientation of the exercise interface.

Figure 10:
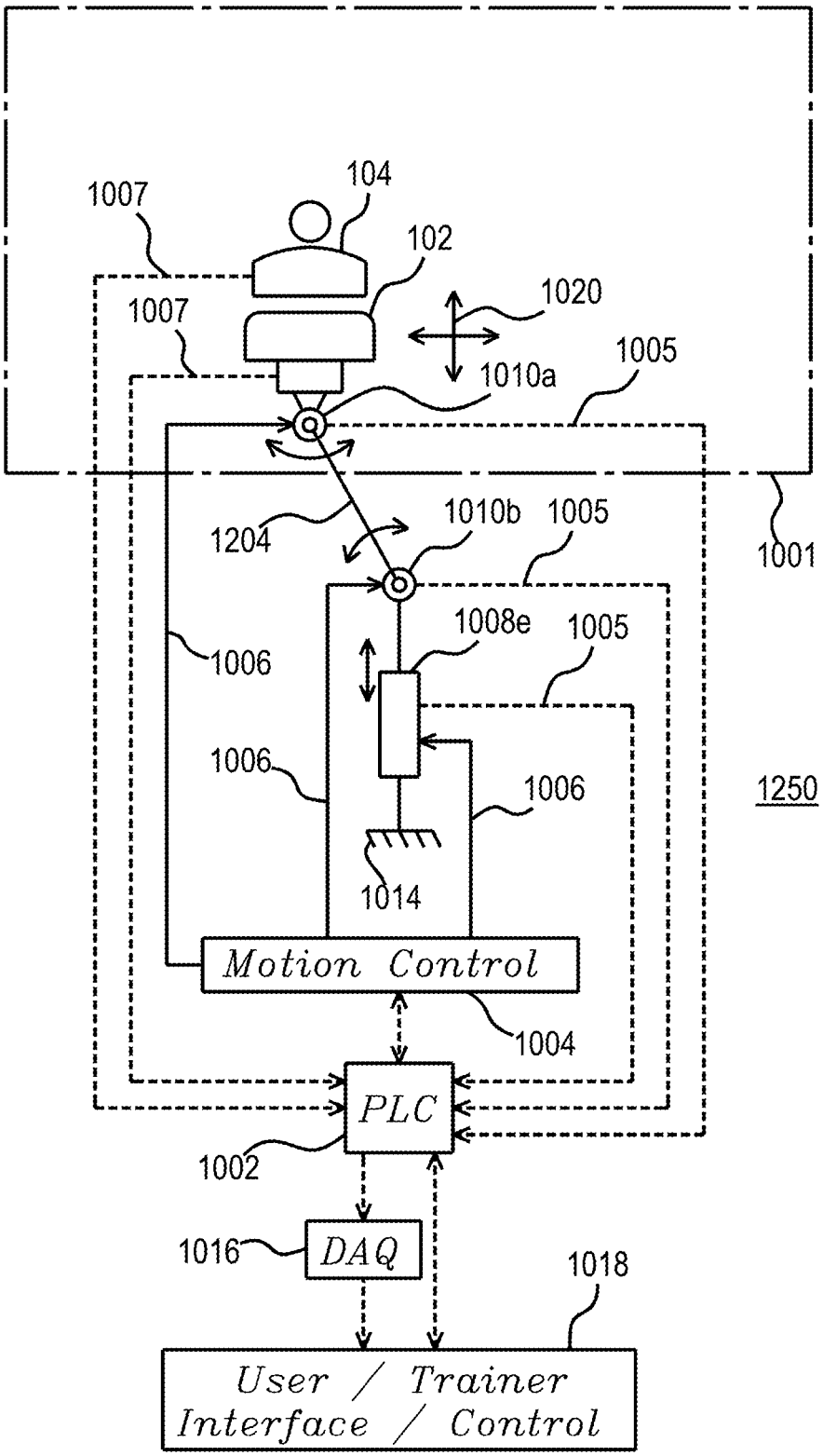

Exercise device example 1250 of FIG. 10 replaces revolute actuator 1010*c* and linkage 1202 of exercise device 1200 of FIG. 9 with a prismatic actuator 1008*e*. One end of the prismatic actuator 1008*e* is connected to frame 1014 in a fixed relationship rather than through a joint. The other end is connected to revolute actuator 1010*b*. Extending and retracting the prismatic actuator translates the position of the revolute actuator 1010*b* along a straight line. Revolute actuator 1010*b* can then be actuated to move the exercise interface 102 along an arc within the device motion space 1001.

Figure 11:
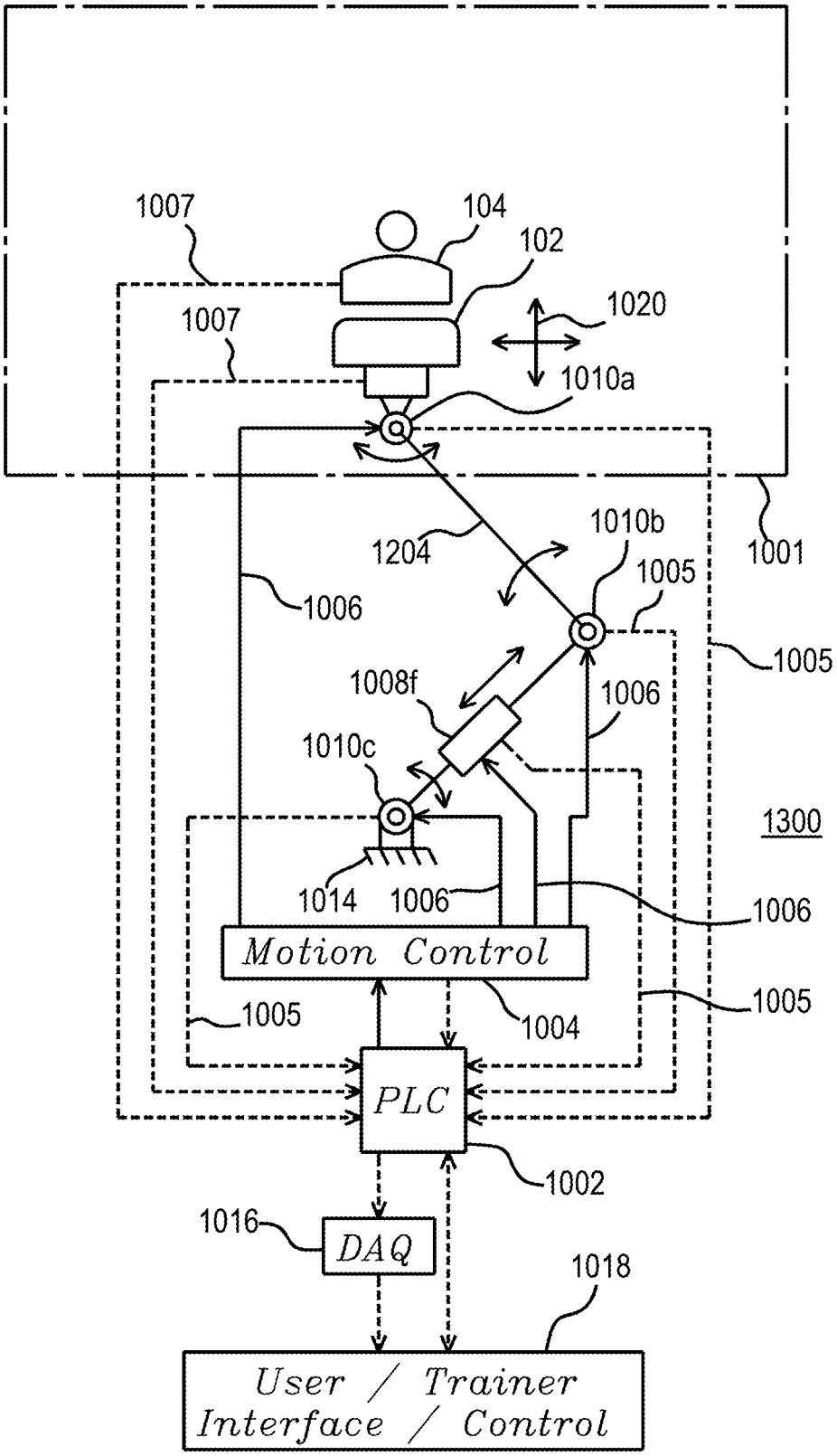
Figure 12:
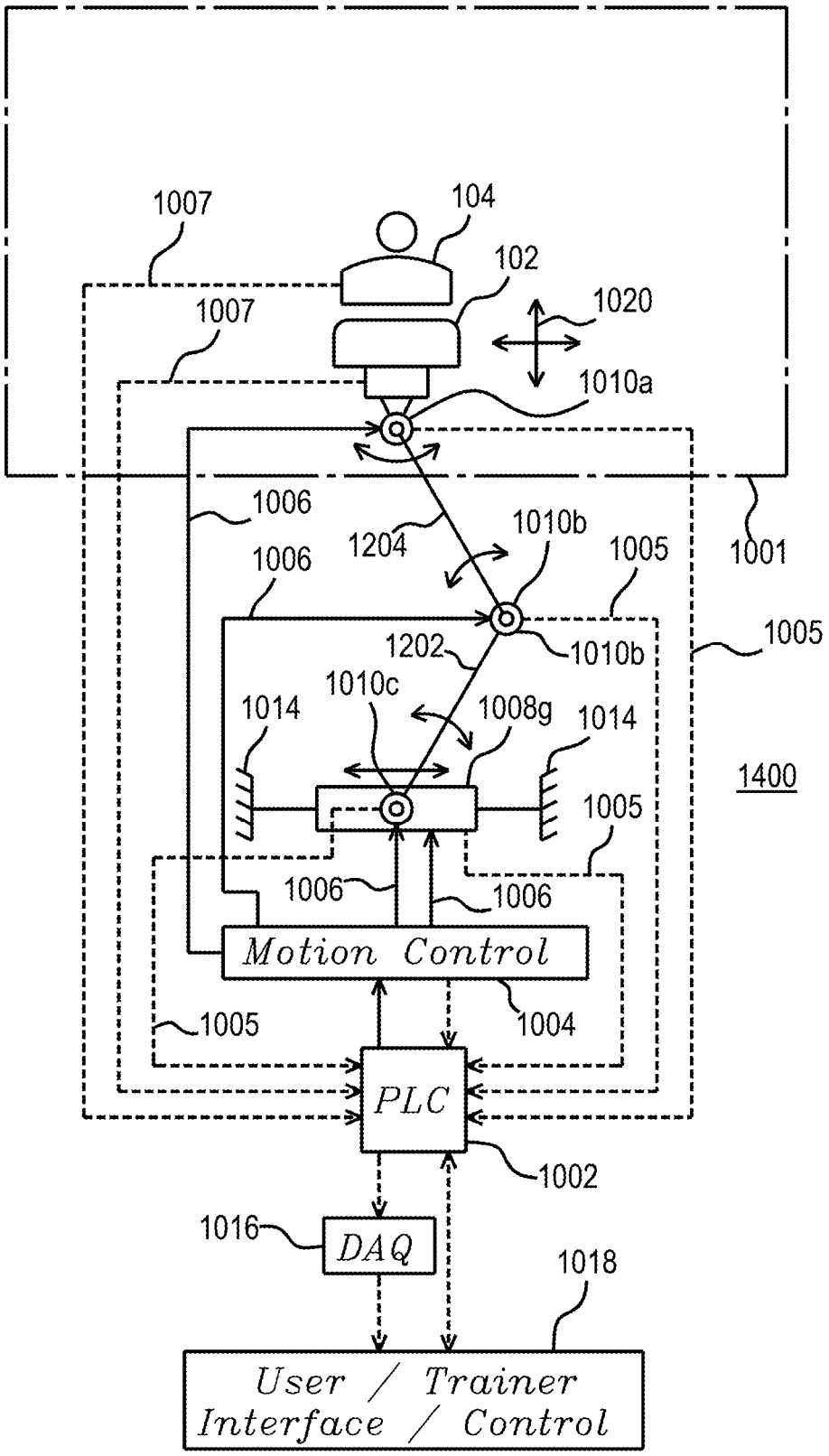
Figure 13:
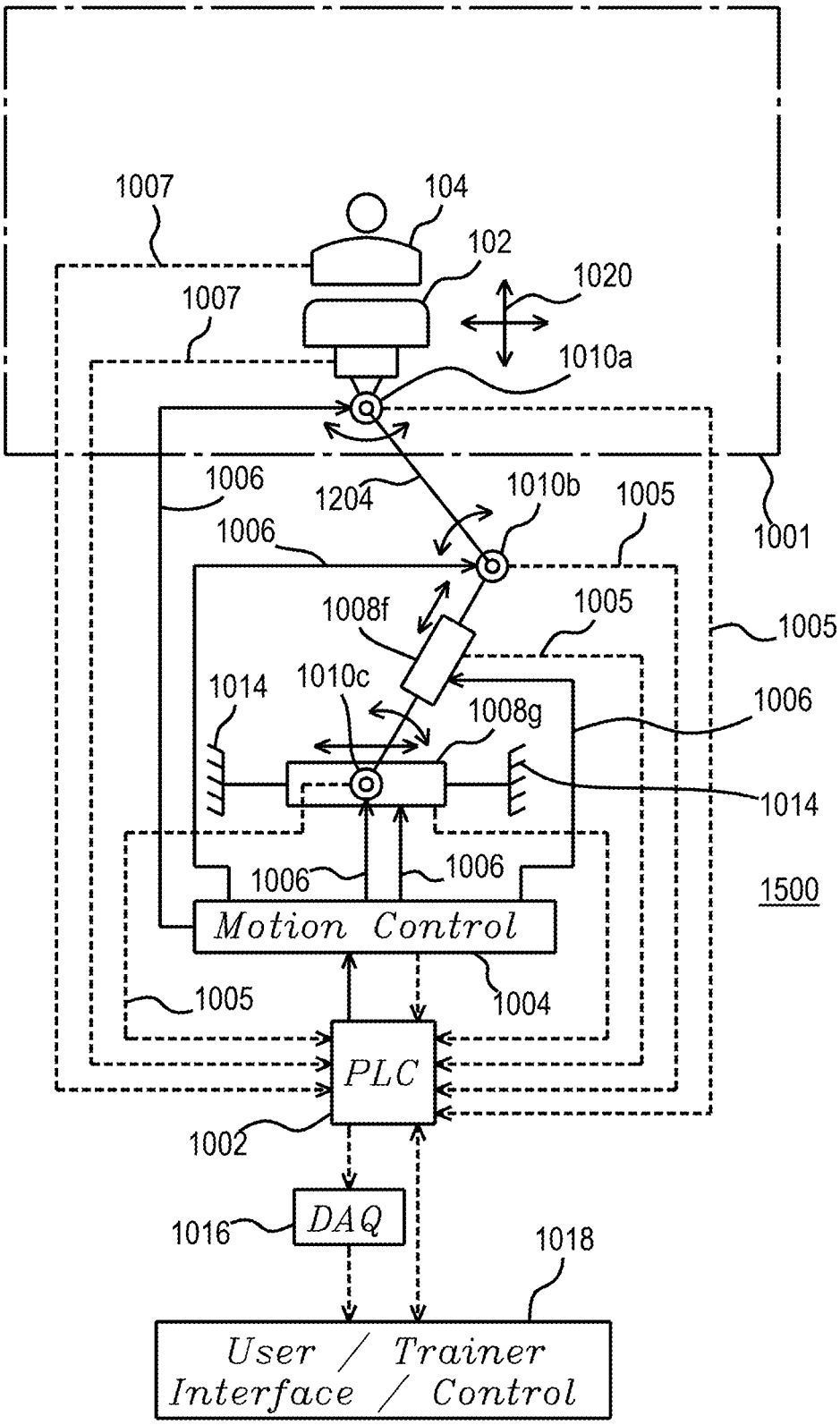

FIGS. 11, 12, and 13 are kinetic diagrams for other variations of the exercise device 1200 of FIG. 9.

In FIGS. 11 and 13, exercise devices 1300 and 1500 substitute a prismatic actuator 1008*f* for the fixed-length linkage 1202 of FIG. 9. The ends of prismatic actuator 1008*f* connect to revolute actuator 1010*b* and revolute actuator 1010*c*. The arrangement allows the distance between the shoulder and elbow joints of the articulating arm that correspond to revolute actuators 1010*c* and 1010*b*, respectively, to be increased or decreased. The ability to increase or decrease the distance between the revolute actuators may, for example, be used to simplify the execution of some movements of the exercise interface. It may also allow for a larger device motion space.

In comparison to the exercise devices 1200 (FIG. 9) and 1300 (FIG. 11), exercise devices 1400 (FIG. 12) and 1500 (FIG. 13) couple revolute actuator 1010*c*, which is the shoulder for the articulating arm, to frame 1014 in a manner that allows it to be translated along an axis relative to frame 1014. In these examples, the revolute actuator 1010*c* is connected to the body of the prismatic actuator 1008*g*, which is connected at each end to frame 1014 at different spaced locations. The prismatic actuator 1008*g* is configured so that its body can be shifted or translated with respect to the frame in either of two directions when it is actuated. Actuating prismatic actuator 1008*g* moves the position of the exercise interface 102 parallel to the axis of the prismatic actuator 1008*g* without having to actuate revolute actuators 1010*b* and 1010*c*, thus enabling lateral movement of the exercise interface without extending or retracting. The ability to translate the position of the shoulder of the articulated arms in these examples may also allow for the respective exercise devices to have larger device motion space 1001.

Figure 14:
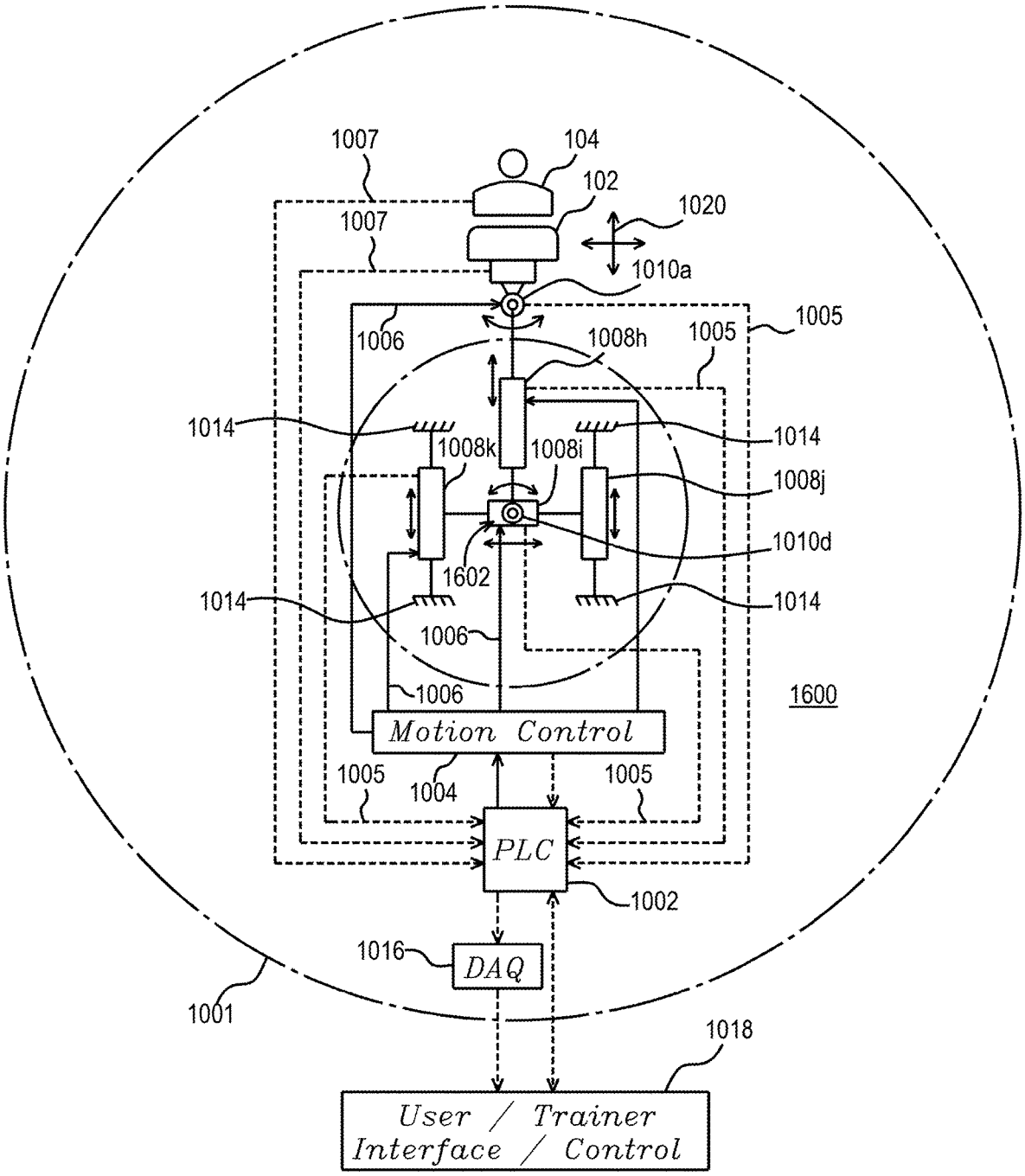
Figure 15:
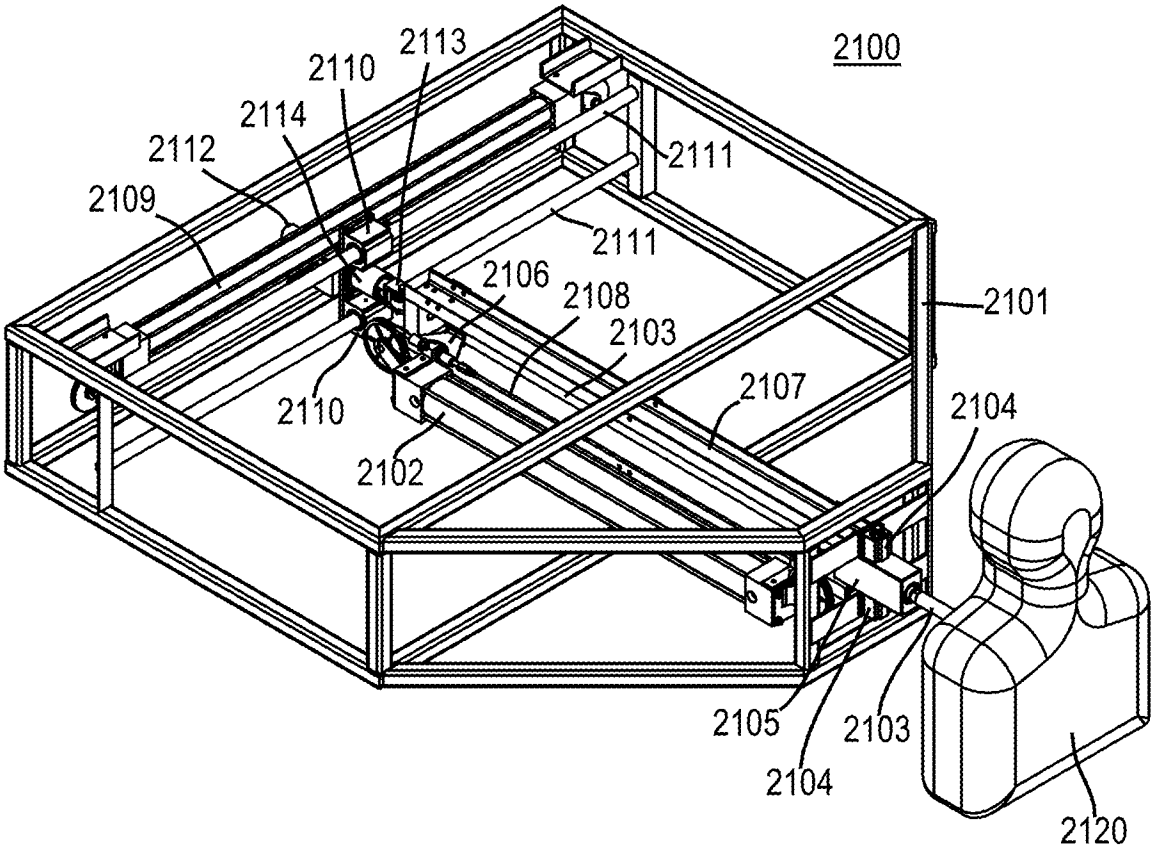
FIGS. 15-22 illustrate examples of training devices disclosed embodying aspects of the training device of FIG. 1.
Figure 16:
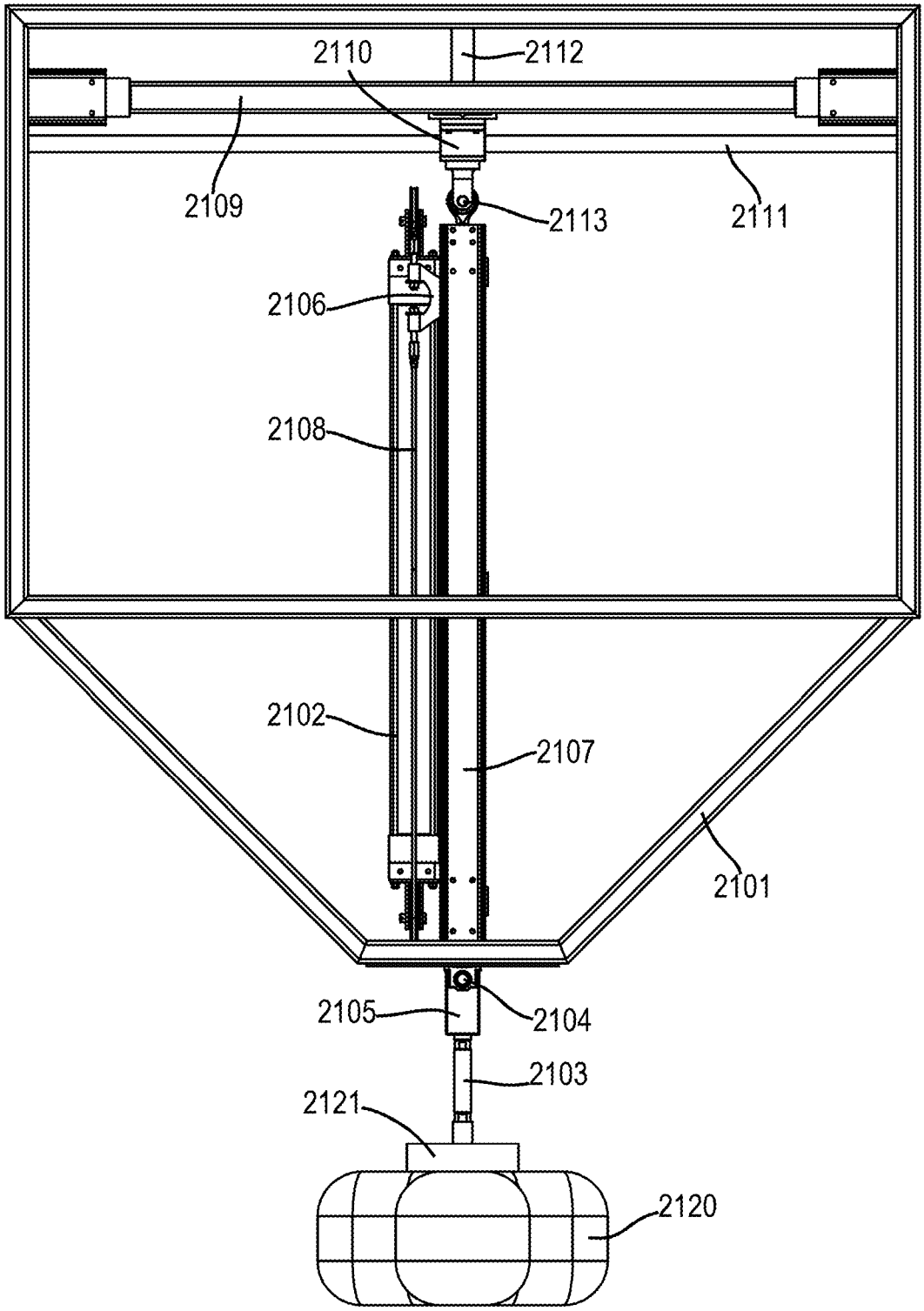
Figure 17:
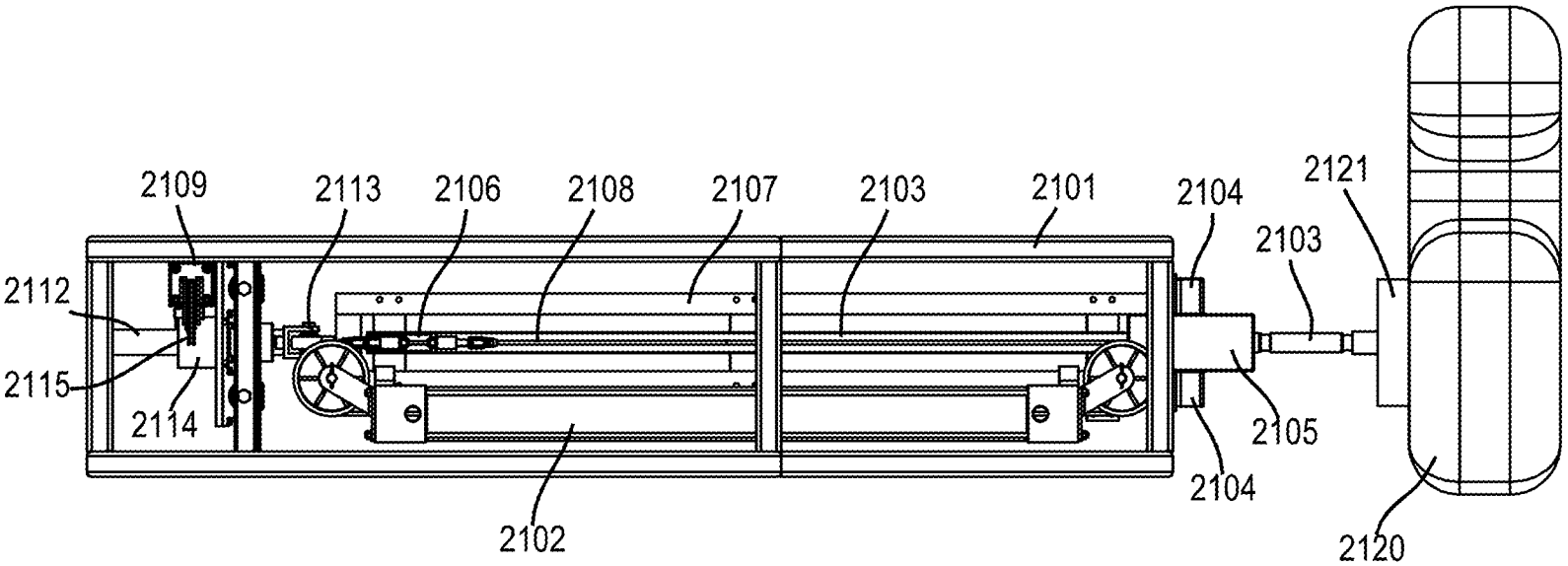
Figure 18:
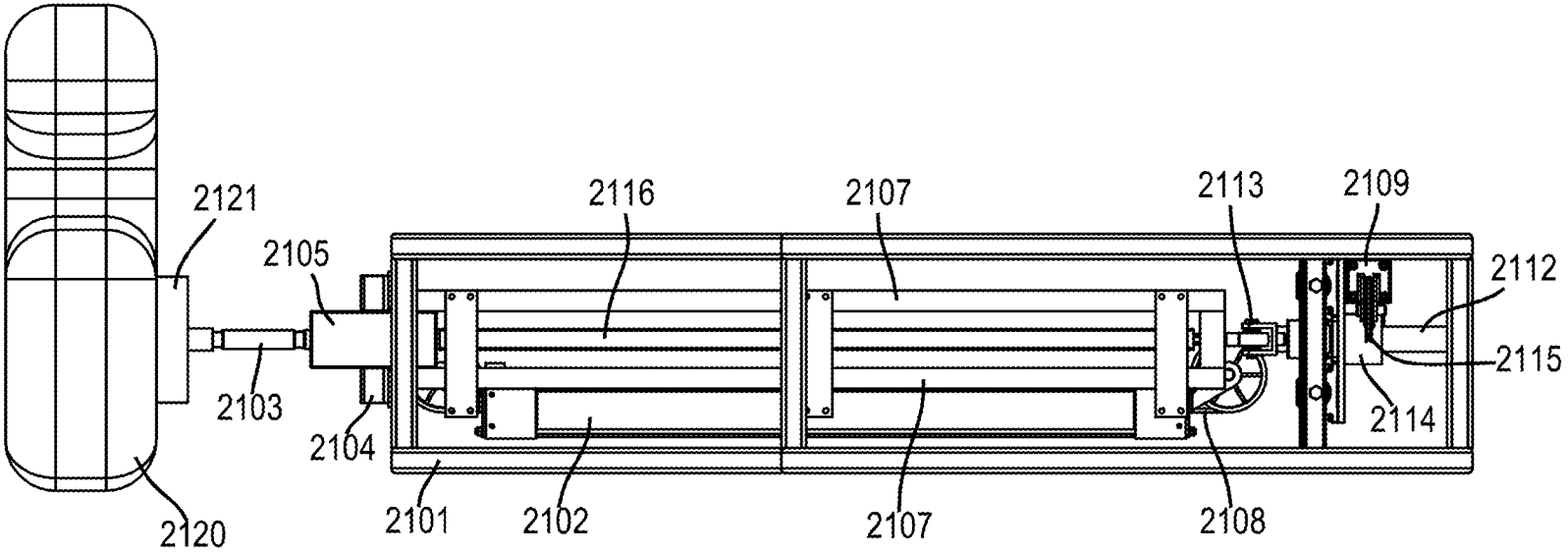
Figure 19:
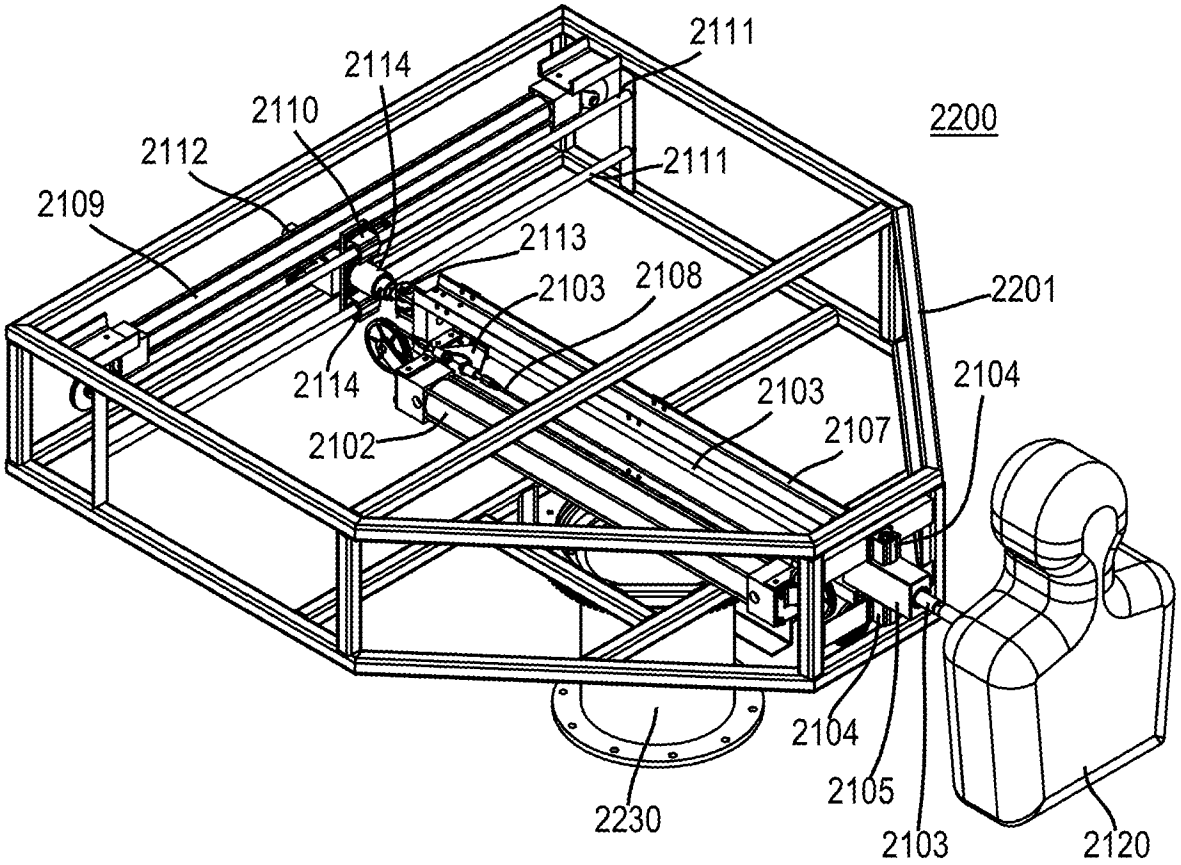
Figure 20:
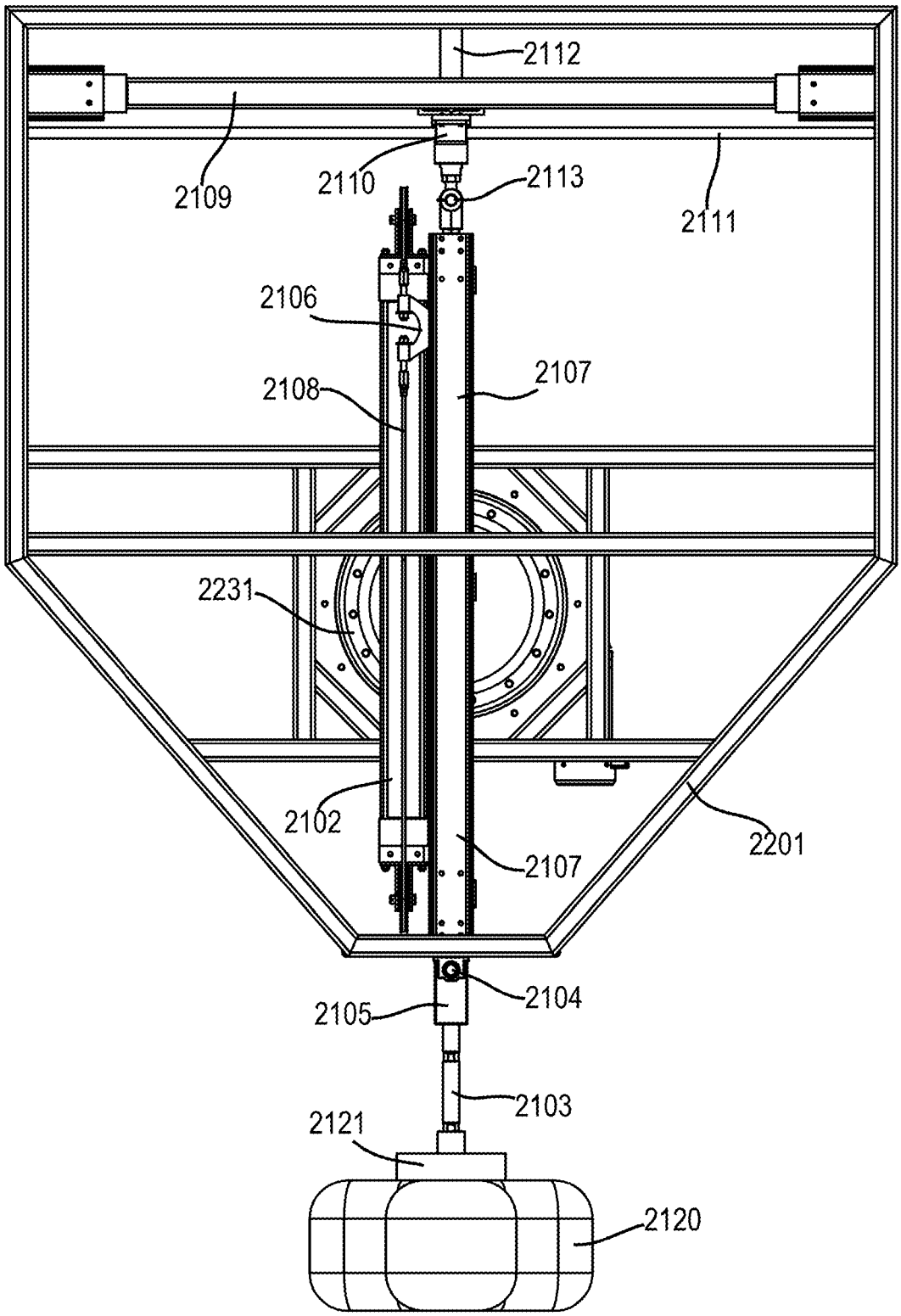
Figure 21:
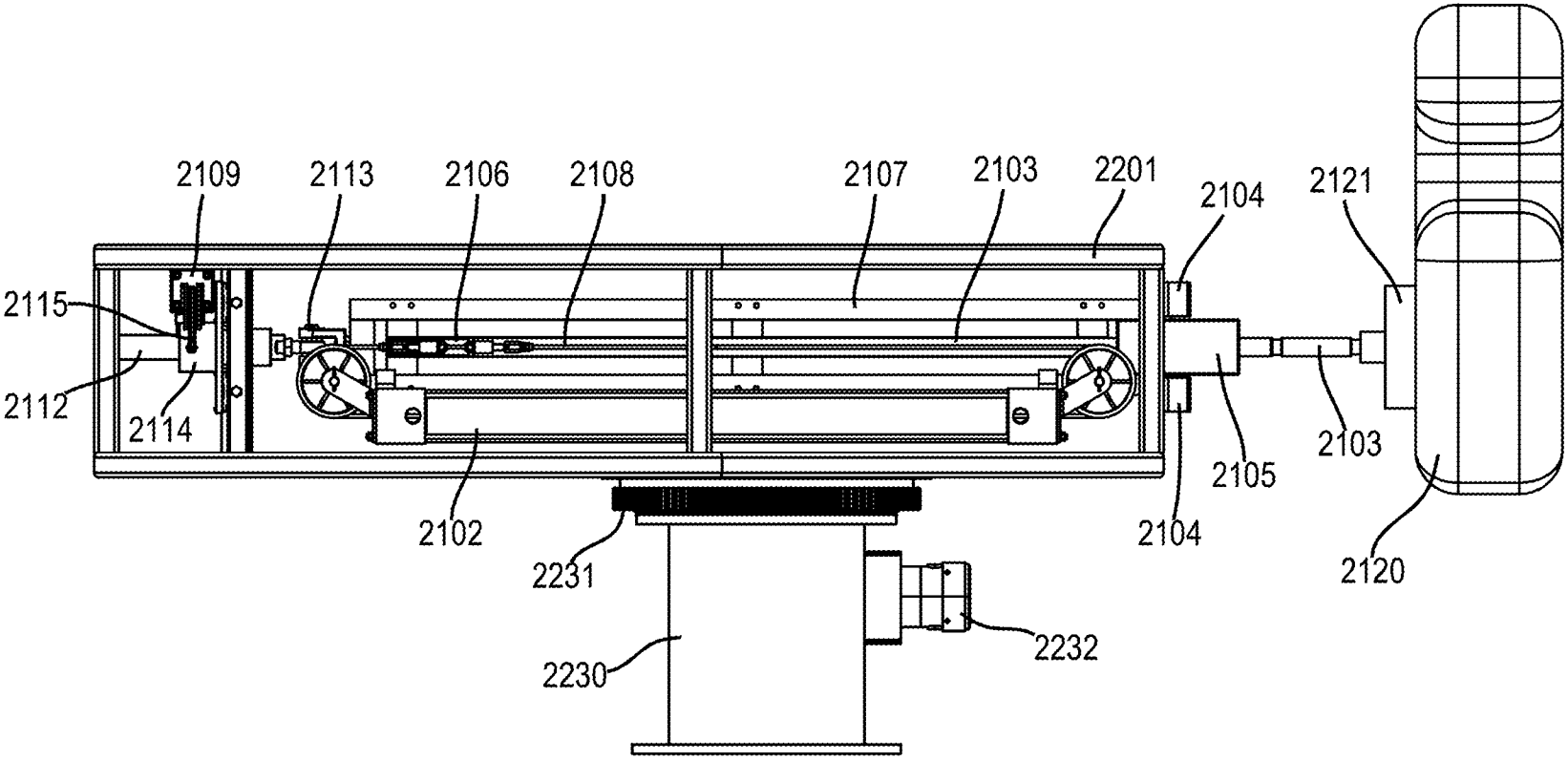
Figure 22:
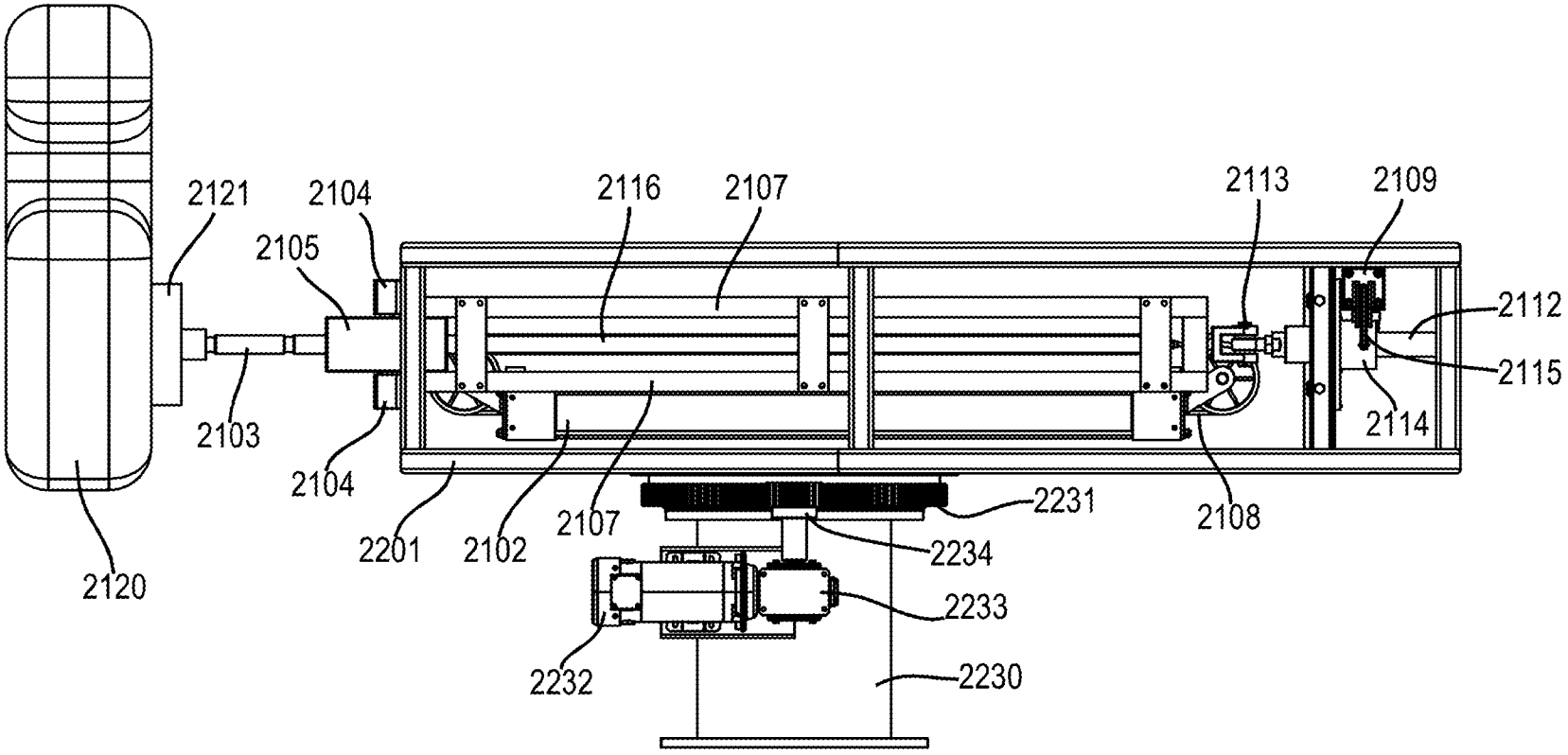

FIG. 14 illustrates a kinematic schematic for a representative example of an embodiment of an exercise device 1600 with an exercise and device motion space 1001 that extends entirely around the device, meaning that the exercise interface 102 can be moved around the device. The exercise interface 102 is rotated around a pivot point 1602 by actuation of revolute actuator 1010*d*. The prismatic actuator 1008*h* couples the revolute actuator 1010*a* with the revolute actuator 1010*d*. Prismatic actuator 1008*h* is configured to extend and retract the position of exercise interface 102 relative to the pivot point.

The central pivot is configured to be shifted laterally along two axes relative to frame 1014. This example uses three prismatic actuators, 1008*i*, 1008*j*, and 1008*k*, to translate the central pivot point along two axes. Revolute actuator 1010*d* is mounted on a body of prismatic actuator 1008*i*. Prismatic actuator 1008*i* is connected to the bodies of prismatic actuators 1008*j* and 1008*k* and configured so that it can be actuated in either direction to translate along a first axis to translate the revolute actuator 1010*d* along the first axis. Prismatic actuators 1008*j* and 1008*k* are connected to the frame in parallel and translate along a second axis to move the prismatic actuator 1008*i* and the revolute actuator along the second axis.

FIGS. 15 to 23 illustrate kinematic schematic diagrams of representative, nonlimiting examples of embodiments of a mechanical assembly for an exercise device that uses programmed instructions executed by a controller (not shown) to control actuators in the mechanical assembly to move an exercise interface in the manners described above in connection with FIGS. 1 to 5 to improve reaction times and explosive power and/or for any purpose identified above in connection with the descriptions of FIGS. 1-6. The actuators for embodiment are implemented using cable cylinders arranged to position the exercise interface anywhere within an exercise or device motion space defined by the mechanical limits on the range of motion of its actuators and other joints.

The mechanical assembly 2100 in FIGS. 15-18 discloses one representative embodiment.

Mechanical assembly 2200 in FIGS. 20-23 is an alternative embodiment that is similar to mechanical assembly 2100 except for the addition of a slewing arrangement that rotates the assembly around a pedestal and thus extends the exercise and device motion space at least partially, if not entirely, around the pedestal. Elements common to both embodiments are described first.

Each assembly, 2100 and 2200, has a frame. Assembly 2100 has a frame 2101, and assembly 2200 has a frame 2201. Frame 2101 can be mounted to a stationary or mobile surface. Frame 2201 is supported for rotation on a pedestal. The pedestal may, for example, be mounted on a stationary or mobile surface. Each frame provides the same or similar attachment points for cylinders, bearings, and motion support structures. It will be referred to as "the frame" in the following description.

A thrust cable cylinder 2102 is connected to the aft and forward end of the frame. It is operated by pressurized air acting on an internal piston coupled to thrust cable 2108 to apply force through thrust cable 2108 to move thrust rod 2103 forward or aft. The forward and aft movement of the thrust rod 2103 transmits force and motion from the cylinder piston and thrust cable 2108 to exercise interface 2120. Thrust pivot bearing 2104 transmits thrust forces to the forward end of the frame while providing a pivot point for thrust rod bearing 2105, thrust rod 2103, and thrust cable cylinder 2102 as the aft end of thrust frame 2107 moves laterally. Thrust rod bearing 2105 supports and guides the linear forward and aft motion of thrust rod 2103. Thrust cable mount 2106 provides an attachment point for the thrust cable 2108 to the aft end of thrust rod 2103. Thrust frame 2107 provides support and forward and aft attachment points for cable cylinder 2102, thrust bearing 2105, and clevis 2113.

Lateral cable cylinder 2109 is attached to the aft end of the frame (2101 or 2201). It is operated pneumatically with, for example, air to produce lateral motion transmitted with lateral cable 2115 to move the thrust frame 2107 left and right. Lateral bearing 2110 moves linearly left and right on bearing rail 2111 and supports and guides the lateral movement of clevis 2113 and the aft end of thrust frame 2107. Clevis 2113 connects the aft end of thrust frame 2107 to slide rod 2112 with a pivot pin to allow lateral motion of thrust frame 2107 and transmits lateral forces from rod bearing 2114 to frame 2107. Bearing rail 2111 provides a lateral path for lateral bearing 2110 to move left and right to transmit lateral forces to the frame. Slide rod 2112 is attached to the aft end of clevis 2113 and moves linearly through slide bearing 2114 during the lateral motion of thrust frame 2107 while transmitting lateral forces from slide bearing 2114 to clevis 2113. Rod bearing 2114 provides an attachment point of lateral cable 2115 and transmits lateral cable forces to clevis rod 2112. Lateral cable 2115 transmits left and right lateral forces from cable cylinder 2109 to slide bearing 2114 to produce lateral movement of thrust frame 2107. Guide rail 2116 rail is attached lengthwise to thrust frame 2107 to guide and limit rotation of thrust rod 2103 as the rod translates forward and aft.

Exercise interface 2120 transmits forces and motion generated by the cable cylinders 2102 and 2109 to a trainee and transmits forces from the trainee to the cable cylinders. A force, torque, and acceleration sensor 2121 converts applied forces, torques, and accelerations on exercise interface 2120 into electric signals that can be feedback to a controller (not shown) and collected by a data acquisition system.

Referring now only to FIGS. 19-22, frame 2201 of mechanical assembly 2200 functions like frame 2101 of assembly 2100 (FIGS. 15-19), but with the addition of a slewing bearing mount located centrally on the bottom side of the frame. Slewing bearing 2231 allows 360-degree rotation of the mechanical assembly 2200, thereby extending the exercise and device motion space around an axis of rotation of the mechanical assembly. Frame 2201 is rotated on bearing pedestal 2230. The bearing pedestal can, for example, be mounted to a stationary or mobile surface. The bearing provides a mounting surface for one of the bearing races for slewing bearing 2231. The height of the pedestal can be fixed or made variable. Motor 2232 produces rotary motion and torque (power) transmitted to gearbox 2233 to rotate the frame. The motor may, for example, be electric or other type of motor. Gearbox 2233 may, optionally, have variable ratios to increase or decrease the torque and speed of the motor. Pinion gear 2234 transmits torque and speed of the gearbox. The gearbox may be located internally or externally. Alternatively, other types of drives, such as a belt or chain, roller or wheel, can be substituted or otherwise added to transmit motion and torque from the motor or any type of rotary actuator to rotate the frame on the pedestal.

Figure 23:
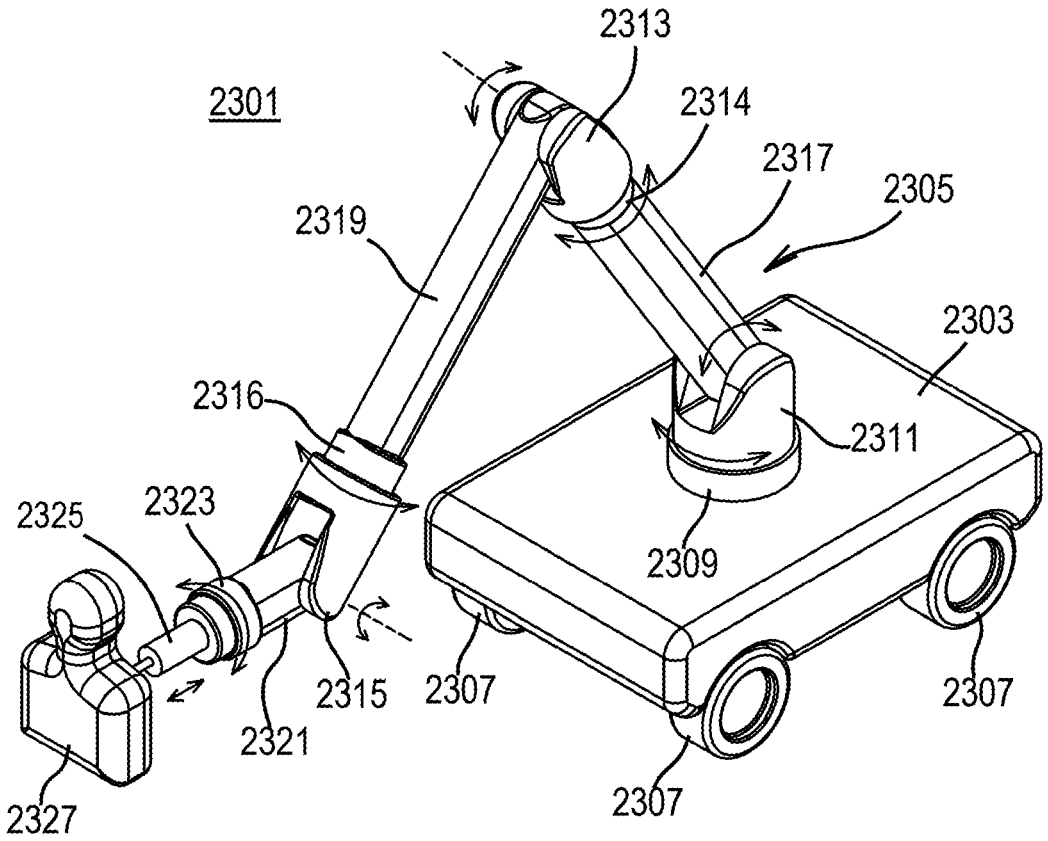
FIG. 23 illustrates an example of a mobile embodiment of a physical exercise device.

FIG. 23 illustrates a representative example of a mobile exercise device 2301 capable of being programmed and operated according to any one or more of the representative examples of exercise devices disclosed above. The mobile exercise device comprises a mobile base or platform 2303 and at least one articulating arm 2305 mounted on the mobile platform. The mobile platform includes, in this example, an optional propulsion system. In this example, the illustrated propulsion system has four wheels 2307, only three of which can be seen. If desired, any one or more of the wheels can be driven by, for example, one or more electric, hydraulic, or other type of motors (not visible).

Furthermore, fewer or more than four wheels can be used. Continuous tracks or other types of propulsion systems may be substituted for any one or more, or all, of the wheels. Other types of propulsion can be employed to move the platform, including pushing or pulling the platform manually or in other ways. The propulsion system enables, if desired, transportation of the exercise device on or between, for example, playing fields or rooms within buildings. The exercise device may, optionally, be moving while performing an exercise routine. Although not shown, the platform may optionally include one or more stabilizers that can be attached, extended, or otherwise deployed when it is not mobile to enhance stability. A nonlimiting, representative example of a stabilizer is an outrigger, which would project outwardly from the platform when extended.

Articulating arm 2305 is mounted to the mobile platform 2303 through revolute actuator 2309, which is used to rotate the articulating arm about a central vertical axis extending through the center of rotation of the revolute actuator, allowing the arm to be positioned for extension in any direction from the base. Revolute actuators 2311, 2313, and 2315 enable a programmable controller (not shown but optionally, mounted at least partially within mobile platform 2303) to pivot independently the central axes of the linkages 2317, 2319, and 2321, respectively, with respect to each other and the central vertical axis.

The revolute actuators 2313 and 2315 are connected to the end of linkages 2317 and 2319 through revolute actuators 2314 and 2316 that rotate about the central axis of linkages 2317 and 2319, respectively. Revolute actuator 2323 rotates a prismatic actuator 2325 about the axis of linkage 2321. Prismatic actuator 2325, connected to the exercise interface, extends and retracts the exercise interface along the axis of the linkage 2321.

The actuatable joints of FIG. 23 collectively provide six degrees of freedom of movement (3 degrees of translation along and 3 degrees of rotation about the x, y, and z axes) and allow the programmable controller to move the exercise interface 2327 to any location within a three-dimensional area that surrounds the mobile platform and to orient the exercise interface 2327 in any direction when in most if not all, locations.

Figure 24:
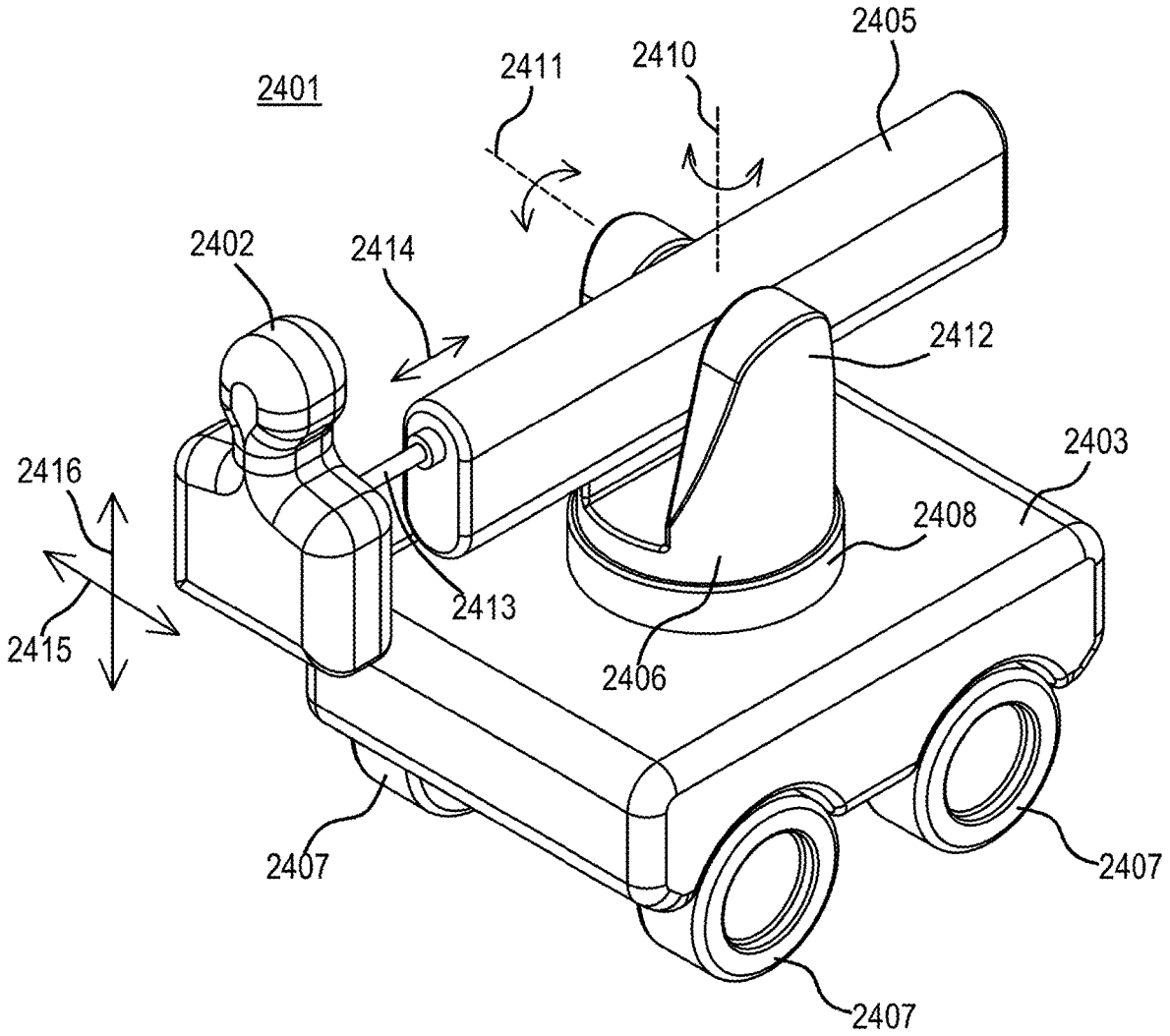
FIG. 24 illustrates an example of another mobile embodiment of a physical exercise device.

The number of joints in the articulating arm 2305 can be added or reduced to increase or reduce the range of motion and the degrees of freedom of movement if desired or acceptable. Furthermore, other configures of articulating arms are possible for a mobile exercise device FIG. 24 illustrates another example of a representative, nonlimiting embodiment of mobile exercise device 2401. The illustration does not show a controller or illustrate any features mentioned in the descriptions of FIGS. 1 to 5 that exercise device 100 (FIG. 1) may have. It may, for example, be programmed and operated according to any one or more of the representative examples of exercise devices disclosed above. It may include, or be adapted to include, any one or more of these features or any one or more of the features described in the examples shown in FIGS. 6 to 22.

The mobile exercise device 2401 includes a mobile platform 2403, a pivoting arm 2405 mounted on top of the mobile platform 2403 using a base 2406, and an exercise interface 2402 mounted on one end of arm 2405. Although not shown, part or the entirety of a programmable controller for controlling the movement of the exercise device using actuators within the mobile platform, base, arm, or exercise interface may, optionally, be mounted within the base 2406, mobile platform 2403, and/or other parts of the device.

The mobile platform includes, in this example, an optional propulsion system. In this example, the propulsion system has a plurality of wheels 2407. There are four wheels, only three of which can be seen. If desired, any one or more of the wheels can be driven by, for example, one or more electric, hydraulic, or other type of motors (not visible). Furthermore, fewer or more than four wheels can be used. Continuous tracks or other types of propulsion systems may be substituted for any one or more, or all, of the wheels. Other types of propulsion can be employed to move the platform, including pushing or pulling the platform manually or in other ways. The propulsion system enables, if desired, transportation of the exercise device on or between, for example, playing fields or rooms within buildings. The exercise device may, optionally, be moving while performing an exercise routine. Although not shown, the platform may optionally include one or more stabilizers that can be attached, extended, or otherwise deployed when it is not mobile to enhance stability. A nonlimiting, representative example of a stabilizer is an outrigger, which would project outwardly from the platform when extended.

Base 2406 is coupled to the mobile platform with a revolute actuator 2408 that rotates the base relative to the mobile platform about a vertical axis 2410. The amount of rotation may, for example, be 360 degrees, which provides the capability, if desired, of positioning the exercise interface 2402 within a device motion space extending around the platform. However, the rotation may be less than 360 degrees.

Arm 2405 is coupled to base 2406 through at least one revolute actuator 2412 to pivot about horizontal axis 2411. For example, the one or more revolute actuators may be implemented using an axle extending through the base and supported by the base on each side of the arm. Pivoting the arm pitches the exercise interface 2402 up and down. The arm may optionally, as shown in this example, be joined with the base at an intermediate point between its ends to make the arm more balanced about horizontal axis 2411. A more balanced arm can reduce the inertial mass of the arm, which makes it easier to control, especially when accelerating its movement or moving it at a high velocity, and reduces the power needed by the revolute actuator to pivot it. It may also simplify the construction of the arm.

A prismatic actuator 2413 is mounted inside arm 2405. Exercise interface 2402 is supported on the end of the prismatic actuator. The prismatic actuator moves the exercise interface 2402 in a forward and aft direction represented by arrow 2414 longitudinally extending or retracting the exercise interface from vertical axis 2410. The exercise interface 2402 and prismatic actuator 2413 may be enabled to rotate from zero to 360 degrees about vertical axis 2410 by actuator 2408. Optionally, the prismatic actuator's axis of motion may or may not be offset from vertical axis 2410 and horizontal axis 2411. For example, as shown in the figure, it may intersect the vertical axis 2410 but not the horizontal axis 2411. The offset may, for example, be used to accommodate a longer rod or other structural member, or an assembly of them, that can be extended, therefore providing a greater range of motion, extension, or throw that enables the exercise interface 2402 to be extended further from the base. The offset may, alternatively or in addition, also allow accommodation of, for example, a balancing mechanism that shifts a balance mass rearwardly as the exercise interface is extended.

Therefore, the exercise device 2401 is enabled to move the exercise interface 2402 in three degrees of freedom, as indicated by arrows 2414, 2415, and 2416.

Although not indicated in the drawing, the exercise interface may, for example, be connected to the prismatic actuator 2413 through one or more revolute actuators, one or more revolute joints, or a combination of revolute actuators and joints. Each additional revolute joint provides an additional degree of freedom of movement. If any one or more of the revolute joints are actuated, the exercise device's controller may, optionally, control the orientation of the exercise interface relative to the joint or control point for the arm independently of the arm's position. For example, a revolute actuator that rotates the exercise interface about the axis extending through the connection to the prismatic joint parallel to the horizontal axis 2411 enables the exercise device controller to maintain or change the orientation of the exercise interface relative to a trainee position as the arm is pivoted to move the exercise interface up or down. Alternatively, the connection can be configured with, for example, multiple revolute joints and linkages that automatically change the orientation of the exercise interface as the arm 2405 is pivoted up or down to change the height of the exercise device relative to the ground. Similarly, a revolute actuator that rotates the exercise interface about an axis parallel to vertical axis 2410 enables the exercise device controller, for example, to maintain or change the interface orientation as the arm is rotated about vertical axis 2410.

Any one of the embodiments shown in FIGS. 6 to 24 may, optionally, be adapted to include any one or more of the features of exercise device 100 mentioned in the description of FIGS. 1 to 5, above.

The prismatic and revolute actuators used in any representative embodiments disclosed in connection with FIGS. 1-24 have, unless otherwise indicated, one degree of freedom (DOF). However, an actuator with two or more degrees of freedom could be substituted for any single DOF actuator. Furthermore, any of the disclosed embodiments or examples can be modified by adding or removing actuators, such as, for example, to increase or decrease the number of degrees of freedom of movement or to enable additional or alternate control options for executing certain types of exercise movements with, for example, a greater range of motion, more force or speed, finer control, or simplified programming.

Processes illustrated in the accompanying figures are explanatory and do not imply that the steps must be performed sequentially or in the illustrated order, that any step is essential to the process, or that they cannot be performed concurrently if a process step or combination of steps would or could be executed concurrently with other steps, executed in a different order, omitted, or made dependent on other processes or conditions.

Unless otherwise noted, the preceding disclosures of embodiments and examples, including preferred embodiments, are representative and nonlimiting examples of possible implementations, embodiments, and uses given to explain the principles and how they can be put into practice by those of ordinary skill in the field. Modifications and substitutions can be made to disclosed embodiments, including what might be considered alternative embodiments, without departing from the scope of a claim. Each illustrative embodiment includes multiple features or sub-combinations that can be practiced independently or in other combinations. Therefore, none of the features of an embodiment are essential to the practice of the embodiment or any other feature unless otherwise stated.

The use of the term "may" should be interpreted in its normal sense as expressing a possibility and not a requirement, even when not accompanied by the word "option" or "optionally." No feature, aspect, or element is essential unless explicitly identified as essential. Unless otherwise defined, the meanings of the terms used in this specification are intended to have their ordinary and customary meaning to those skilled in the art. The meaning of a term is not intended to be limited to or defined by the specific structures or acts that it identifies in any figures. A structure or act referenced by a common term for a class of structures or acts is only a representative example of that structure or act. Limitations described for an element in one embodiment do not limit the same or similar element in another embodiment unless otherwise stated in the description of that embodiment.

The terms "comprise," "have," "include," "contain," and "involve," and variations of them are open-ended linking verbs that signal a nonexclusive listing and thus permit the addition of other elements. When used in claims, the term "comprising" should be interpreted in the manner typically done in patents, which is "including but not limited to." On the other hand, the phrase "consisting of," when used in a claim, implies a closed set of elements. When used in a claim, the phrase "consisting essentially of" excludes additional material elements but allows the inclusion of nonmaterial elements. A material element substantively modifies, adds to, or subtracts from the functionality or nature of the subject matter recited in the claim. If the specification states a component or feature "may," "can," "could," "should," "would," "preferably," "possibly," "typically," "optionally," "for example," "often," or "might" (or other such language) be included or have a characteristic, that component or feature is not required to be included or to have the mentioned characteristic. Such a component, feature, or characteristic may be included or excluded.

A singular form of an element or components of an apparatus described herein is understood to include its plural form. Use of the word "a" or "an" when used in conjunction with the term "comprising" in the claims or the specification means one or more than one unless context would otherwise make it indefinite. The term "or" in the claims means "and/or" unless the sentence explicitly indicates that it refers only to alternatives. Using "and/or" in some situations does not signal that using "or" in other situations should be interpreted otherwise. The terms "couple," "coupled," "connect," "connection," "connected," "in connection with," and "connecting" refer to "in direct connection with," "integral with," or "in connection with via one or more intermediate elements or members.

Aspects of the foregoing disclosure include, but are not limited to, the following:

Aspect 1. A physical training apparatus comprising: an exercise interface configured to engage with a human trainee; an assembly of joints and actuators coupling the exercise interface to a frame for supporting the exercise interface above a surface, the actuators and joints being configured to move the exercise interface relative to the frame in at least two degrees of freedom to any point within an exercise area having at least two dimensions; and a device controller configured to receive feedback signals from a plurality of sensors indicative of any one or more of a position, velocity, or force of any one or more of the joints, the actuators, the exercise interface, or the human trainee when engaging the exercise interface and generating control signals for the actuators to control motion of the exercise interface; wherein the device controller is configured to execute a program to control motion of the exercise interface during an exercise routine performed by the human trainee by generating control signals for one or more of the actuators to cause a movement of the exercise interface when the human trainee is engaging it; and wherein the movement comprises any one or more of the following: a movement unexpected by the trainee, one of a series of movements that imitate a sports-specific opponent, and a movement that causes the human trainee to activate quick response and elastic properties of the trainee's muscles.

Aspect 2. The physical training apparatus of aspect 1, wherein the unexpected movement comprises any one or more of the following: an abrupt change in direction of the exercise interface's motion not caused by forces being applied to the exercise interface by the human trainee; an abrupt change in an amount of force applied by the actuators to the exercise interface not caused by a change in the forces being applied to the exercise interface by the human trainee; an abrupt change in a velocity of the exercise interface not caused by a change in the forces being applied by the human trainee to the exercise interface; and an abrupt change in acceleration of the exercise interface not caused by a change in the forces being applied by the human trainee to the exercise interface.

Aspect 3. The physical training apparatus of aspect 1, wherein the exercise routine specifies any one or more of: one or more planned paths, each of the one or more planned paths comprising at last a point within the device motion space for the exercise interface; one or more target velocities for movement of the exercise interface, each of the one or more target velocities including at least one of a maximum velocity, a minimum velocity, and a set velocity; and one or more target forces to apply to the exercise interface.

Aspect 4. The physical training apparatus of aspect 1, the exercise routine includes at least two sequential movements, wherein the device controller moves the exercise interface from a first point in the device motion space area to a second point within the device motion space and then from the second point to a third point within device motion space that is different from the first point and the second point.

Aspect 5. The physical training apparatus of aspect 1, wherein the unexpected movement of the exercise interface according to the programmed exercise routine causes the human trainee to make one or more movements required for an athletic sport.

Aspect 6. The physical training apparatus according to any one of aspects 1 to 5, wherein at least one of the plurality of actuators comprises a pneumatically operated cylinder.

Aspect 7. The physical training apparatus of aspect 6, wherein the pneumatically operated cylinder is a cable cylinder.

Aspect 8. The physical training apparatus according to any one of aspects 1 to 7, wherein the device controller is configured to change the movement of the exercise device in response to a trigger.

Aspect 9. The physical training apparatus, according to aspect 8, wherein the trigger comprises one or more of the following conditions: the position, trajectory, velocity, or acceleration of, or force applied to, the exercise interface indicated by the feedback signals, as compared to one or more target values; performance, stress or other condition of the human trainee indicated by the feedback signals as compared to one or more performance criteria; and a predetermined posture or position of the human trainee.

Aspect 10. The physical training apparatus of aspect 8 or 9, wherein the trigger causes a change to one or more variables for the exercise routine, the variables including any one or more of a planned path, a trajectory, a target velocity, a target acceleration, and a target force for exercise interface.

Aspect 11. The physical training apparatus, according to aspect 8, wherein the trigger comprises a movement of the exercise interface that deviates from a planned movement of the exercise device from the exercise routine.

Aspect 12. The physical training apparatus of any one of aspects 8 to 11, wherein the trigger causes execution by the device controller of a different planned movement in the exercise routine program.

Aspect 13. The physical training apparatus of any one of aspects 8 to 12, wherein the trigger is generated pseudo-randomly by the device controller.

Aspect 14. The physical training apparatus of any one of aspects 8 to 13, wherein the trigger causes a change to one or more programmed variables in the exercise routine program that are pseudo-randomly chosen by the device controller, the variables including any one or more of a planned path, trajectory, target velocity, target acceleration, and target force for exercise interface.

Aspect 15. The physical training apparatus of aspect 1, wherein the device controller is configured to change one or more programmed variables for the exercise routine in response to a trainee's motion or posture.

Aspect 16. The physical training apparatus of aspect 1, wherein the controller is further configured to enforce trainee limits during execution of the exercise routine, wherein the trainee limits comprise at least one of the following values for any one or more of the actuators: a maximum value for position or travel; a maximum value for velocity; a maximum value for generated force; and a maximum value for acceleration.

Aspect 17. The physical training apparatus of any one of aspects 1 to 16, wherein the exercise routine includes the device controller causing generation of control signals to one or more of the actuators to create a movement of the exercise interface unexpected by the trainee, and wherein the unexpected movement comprises any one or more of: movement of the exercise interface along a path or trajectory not known to the trainee in advance; a change in a current path or trajectory of the exercise interface; a change in velocity of the exercise interface, which is not proportional to a change in force or a change in velocity applied to the exercise interface by the trainee; and a change in force applied to the exercise interface by the actuators that is not proportional to a change in force or a change in velocity applied to the exercise interface by the trainee.

Aspect 18. An exercise device, comprising: a frame; an exercise interface configured to engage with a human trainee; a plurality of joints coupling a frame to the exercise interface to allow the exercise interface to move in at least two degrees of freedom anywhere within a predetermined exercise that has at least two dimensions; a plurality of actuators that control movement of the joints; a controller configured to control motion of the exercise interface through the actuators according to an exercise routine that causes the human trainee to react with body movements for exercising reaction time and fast twitch muscles.

Aspect 19. The exercise device of aspect 18, wherein the controller causes at least one movement of the exercise interface during the exercise routine that is unanticipated by the human trainee.

Aspect 20. The exercise device of aspect 18, wherein the controller is further configured to enforce trainee limits during execution of the exercise routine program, wherein the trainee limits comprise any one or more of: a maximum or minimum value for travel or position of any one or more of the plurality of actuators, a maximum or minimum value for velocity of any one or more of the plurality of actuators, a maximum or minimum value for force applied by any one or more of the plurality of actuators, and a maximum or minimum value for acceleration of the actuators.

Aspect 21. The exercise device of aspect 18, wherein the controller is further configured to receive feedback signals from sensors associated with at least one or more of the actuators, the exercise interface, and the trainee and respond to the feedback signals by controlling the actuators based on the feedback signals during execution of the exercise routine.

Aspect 22. The exercise device of aspect 18, wherein the controller causes movement of the exercise interface to simulate a real-world opponent in a sport.

Aspect 23. The exercise device of aspect 18, further comprising a data acquisition system configured to collect and store performance data of the human trainee during execution of the exercise routine.

Aspect 24. The exercise device of aspect 18, wherein the exercise interface comprises embedded sensors configured to measure at least one of force, torque, position, direction, and velocity of the exercise interface.

Aspect 25. The exercise device of aspect 18, wherein the exercise interface further comprises embedded speakers configured to provide auditory feedback or instructions, or wherein the exercise interface further comprises embedded screen configured to provide visual feedback or instructions.

Aspect 26. The exercise device of aspect 18, wherein the controller causes the actuators to apply forces to confine movement of the exercise interface to a planned path or trajectory and to move the exercise along the planned path or trajectory using a force that does not exceed a predetermined force or velocity.

Aspect 27. A method for a physical training apparatus having an exercise interface configured to engage with a human trainee, which is coupled through an assembly of joints and actuators to a frame, the actuators and joints being configured to move the exercise interface relative to the frame in at least two degrees of freedom to any point within a device motion space having at least two dimensions, the physical training apparatus further including a device controller generating control signals for controlling movement of the actuators to control motion of the exercise interface according to an exercise routine when a human trainee engages the exercise interface, the method comprising: generating control signals to cause one or more of the actuators to control motion of the exercise interface when engaged by a human trainee; wherein the movement of the exercise interface comprises any one or more of the following: an unexpected movement that is not expected by the trainee; a movement requiring the trainee to perform a movement specific to a sport; a movement that simulates a sport-specific opponent; and a movement that causes the trainee to activate quick response and elastic properties of the trainee's muscles.

Aspect 28. The method of aspect 27, wherein the unexpected movement comprises any one or more of the following: an abrupt change in direction of movement of the exercise interface not caused by forces being applied to the exercise interface by the human trainee; an abrupt change in an amount of force resisting movement of the exercise interface not caused by a change in the forces being applied to the exercise interface by the human trainee; an abrupt change in a velocity of the exercise interface not caused by a change in the forces being applied by the human trainee to the exercise interface; a sudden change in the size or shape of the exercise interface not caused by a change in the forces being applied by the human trainee; and an sudden change in acceleration of the exercise interface not caused by a change in the forces being applied by the human trainee to the exercise interface; wherein the change is made without warning to the trainee.

Aspect 29. The method of aspect 27 or 28, wherein the device controller generates control signals to cause the exercise interface to move according to one or more planned paths, each planned path comprising at least one point within the exercise area for the exercise interface.

Aspect 30. The method of any one of aspects 27 to 29, wherein the device controller generates control signals to cause the exercise interface to move according to one or more target velocities for movement of the exercise interface, each of the one or more target velocities including at least one of a maximum velocity, a minimum velocity, and a set velocity.

Aspect 31. The method of any one of aspects 27 to 30, wherein the device controller generates control signals to apply to one or more target forces to the exercise interface, each of the one or more target forces including at least one of a maximum force, a minimum force, and a set force.

Aspect 32. The method of aspect 27 to 31, wherein the exercise routine includes at least two sequential movements comprising the device controller moving the exercise interface from a first point to a second point within the device motion space, and then from the second point to a third point within the device motion space that is different from the first point and the second point.

Aspect 33. The method of aspect 27, wherein the unexpected movement of the exercise interface according to the programmed exercise routine causes the human trainee to make one or more movements used in a sport.

Aspect 34. The method of any one of aspects 27-33, wherein the movement of the exercise device is changed by the device controller in response to a trigger.

Aspect 35. The method of aspect 27, wherein the trigger comprises one or more of the following conditions: the position, trajectory, velocity, or acceleration of, or force applied to, the exercise interface indicated by the feedback signals, as compared to one or more target values; performance of the human trainee as indicated by the feedback signals as compared to one or more performance criteria; and a predetermined posture or position of the human trainee.

Aspect 36. The method of aspects 34 or 35, wherein the trigger causes a change to one or more variables for the exercise routine, the variables including any one or more of a planned position, a path, a trajectory, a target velocity, a target acceleration, and a target force for exercise interface.

Aspect 37. The method of aspect 34, wherein the trigger comprises a movement of the exercise interface that deviates from a planned movement of the exercise device.

Aspect 38. The method of any one of aspects 34 to 37, wherein the trigger causes execution by the device controller of a different planned movement in the exercise routine.

Aspect 39. The method of aspect 34 wherein the trigger is generated pseudo-randomly by the device controller.

Aspect 40. The method of aspect 34, wherein the trigger is comprised of at least a manual input.

Aspect 41. The method of any one of aspects 34 to 40, wherein the trigger causes a change to one or more programmed variables in the exercise routine that are pseudo-randomly chosen by the device controller, the variables including any one or more of a planned path, a trajectory, a target velocity, a target acceleration, a size or shape, and a target force for the exercise interface.

Aspect 42. The method of aspect 27, wherein the device controller changes one or more programmed variables for the exercise routine in response to a movement or posture of a trainee.

Aspect 43. The method of aspect 27, wherein the device controller enforces trainee limits during execution of the random motion routine, wherein the trainee limits comprise at least one or more of the following: maximum values for travel or position of the actuators; maximum values for velocity of the actuators; maximum values for force applied by the actuators; maximum values for acceleration of the actuators.

Aspect 44. The method according to any one of aspects 27 to 43, wherein the movement of the exercise interface comprises an unexpected movement that is not expected by the trainee and wherein the unexpected movement comprises any one or more of: movement of the exercise interface along a path or trajectory not known to the trainee in advance; a change in a current path or trajectory of movement of the exercise; a change in velocity of the exercise interface, which is not proportional to a change in force applied to the exercise interface by the trainee; a change in orientation or shape of the exercise interface which is not proportional to a change in force applied by the trainee; and a change in force applied to the exercise interface by the actuators that is not proportional to a change in force applied to the exercise interface by the trainee.

Aspect 45. In an exercise device with an exercise interface that is configured to engage with a human trainee during a performance of a physical exercise, controller that is configured to control actuators to move the exercise interface in at last two degrees of freedom within an exercise area having at least two dimensions when executing a program for an exercise routine that controls movement of the exercise interface during performance of the physical exercise, a method for the controller to adaptively modify execution of the exercise routine during the exercise routine comprising: receiving feedback signals from sensors associated with at least one of the actuators, the exercise interface, and a trainee; and changing one or more planned paths of the exercise interface based on the feedback signals.

Aspect 46. The method of aspect 45 further comprising changing a target force to be applied to the exercise interface based on the feedback signals.

Aspect 47. The method of aspect 45 or 46 further comprising changing a target velocity for the exercise interface based on the feedback signals.

Aspect 48. The method of any one of aspects 45 to 47 further comprising dynamically modifying the exercise routine in response to one or more feedback signals indicating any one or more of a performance, position, effort, and energy output of the trainee during the exercise routine.

Aspect 49. The method of any one of aspects 45 to 49, further comprising storing trainee limits in the controller and enforcing the trainee limits during execution of the exercise routine.

Aspect 50. A method of exercising a human trainee using an apparatus having an exercise interface configured to engage with a human trainee, the exercise interface being coupled through an assembly of joints and actuators to a frame that are configured for moving the exercise interface relative to the frame in at least two degrees of freedom to any point within a device motion space having at least two dimensions, the apparatus further including a device controller for moving the exercise interface through generation of control signals that cause at least one of the actuators to displace the exercise interface with a force, the device controller moving the exercise interface while human trainee is engaging the exercise interface according to an executing exercise routine program and one or more feedback signals received by the device controller, the method comprising: moving exercise interface according to a first trajectory within the device motion space; changing movement of the exercise interface from the first trajectory to a second trajectory different from the first trajectory, wherein the change is unexpected to the human trainee and involves a sudden change in any one or more of direction of movement, speed, acceleration, and force of the exercise interface that is not a linear or proportional response to input to the exercise interface from the human trainee.

Aspect 51. The method of aspect 50, wherein the change to the second trajectory is triggered by any one or more of the following conditions: a change in a planned path for the exercise interface used by the device controller to control movement of the exercise interface; a position, trajectory, velocity, or acceleration of, or force on, the exercise interface as compared to one or more stored or calculated target values or limits; performance, stress or other condition of the human trainee based one or more stored or calculated performance criteria values; elapsed time based on one or more stored or calculated values; a predetermined posture or change in posture of the human trainee; a manual input to the device controller; and a pseudo-random process on the device controller.

Aspect 52. A method of exercising a human trainee using an apparatus having an exercise interface configured to engage with a human trainee, the exercise interface being coupled to a frame through an assembly that includes a plurality of joints configured to move the exercise interface relative to the frame in at least two degrees of freedom to any point within a device motion space having at least two dimensions, the apparatus further including a device controller for generating control signals to a plurality of actuators to displace the plurality of joints to move the exercise interface to any point along any path within the device motion space; the method comprising: moving the exercise interface with the device controller along a first trajectory within the device motion space by while the exercise interface is engaged by the human trainee, the device controller selectively actuating according to an exercise routine one or more of the plurality of actuators to displace with a force one or more of the plurality of joints to move the exercise interface along the directory; changing movement of the exercise interface from the first trajectory to a second trajectory with a sudden change in any one or more of direction of movement, speed, acceleration, and force of the exercise interface that is not a linear or proportional response to input to the exercise interface from the human trainee.

Aspect 53. The method of aspect 52, wherein changing the planned path comprises switching from a path between a first point and a second point to a path to a third point in the device motion space.

Aspect 54. The method of aspect 52 or 53, wherein changing the planned path comprises switching from a first path between the first point and the second point, to a second path between the second point to the third point.

ASPECT 55. The method of aspect 52, wherein the first trajectory comprises moving the exercise in a direction opposite a direction the trainee is applying force to the exercise interface and the second trajectory moves the exercise interface in the direction the trainee is applying force to the exercise interface.

ASPECT 56. The method of aspect 52, wherein the first trajectory comprises moving the exercise in a direction opposite a direction the trainee is applying force to the exercise interface and the second trajectory comprises moving the exercise interface in a direction oblique to the direction that the trainee is applying force to the exercise interface.

ASPECT 57. The apparatus or method in any one of the preceding aspects, wherein the unexpected movement or motion occurs at a time or position not known in advance by the trainee or without warning.

ASPECT 58. The apparatus or method in any one of the preceding aspects, wherein a sudden movement or abrupt motion or movement occurs quickly and unexpectedly.

What is claimed is:

1. A physical training apparatus comprising:

an exercise interface configured to engage with a human trainee;

an assembly of joints and actuators coupling the exercise interface to a frame for supporting the exercise interface above a surface, the exercise interface rigidly coupled to the assembly of joints and actuators, the assembly of joints and actuators being configured to move the exercise interface relative to the frame in at least two degrees of freedom to any point within a device motion space having at least two dimensions; and a device controller configured to receive feedback signals from a plurality of sensors indicative of any one or more parameters selected from a group consisting of a position, velocity, and force of any one or more elements selected from a group consisting of a joint of the assembly of joints and actuators, an actuator of the assembly of joints and actuators, the exercise interface, and the human trainee when engaging the exercise interface;

generate control signals for the actuators to control motion of the exercise interface in a first trajectory;

execute a program to control motion of the exercise interface during an exercise routine performed by the human trainee by generating control signals for one or more actuators of the assembly of joints and actuators to cause a movement of the exercise interface when the human trainee is engaging it;

determine when the feedback signals from a first sensor exceeds a set threshold; and change movement of the exercise interface from the first trajectory to a second trajectory different from the first trajectory when the feedback signals from the first sensor exceeds the set threshold.

2. The physical training apparatus of claim 1, wherein at least one of the actuators comprises a pneumatically operated cylinder.

3. The physical training apparatus of claim 2, wherein the pneumatically operated cylinder is a cable cylinder.

4. The physical training apparatus of claim 1, wherein the device controller is configured to change the movement of the exercise device in response to a trigger, wherein the trigger comprises any one or more items selected from a group consisting of:

the position, trajectory, velocity, acceleration of, or force applied to, the exercise interface indicated by the feedback signals, as compared to one or more target values;

performance, stress or other condition of the human trainee indicated by the feedback signals as compared to one or more performance criteria;

a predetermined posture or position of the human trainee;

a movement of the exercise interface not caused by the device controller that deviates from a planned movement of the exercise device from the exercise routine; and a trigger pseudo-randomly by the device controller.

5. The physical training apparatus of claim 4, wherein the trigger causes any one or more changes selected from a group consisting of:

a change to one or more variables for the exercise routine, the variables including any one or more actions from a group consisting of a planned path, a trajectory, a target velocity, a target acceleration, and a target force for the exercise interface;

execution by the device controller of a different planned movement in the exercise routine program; and a change to one or more programmed variables in the exercise routine program that are pseudo-randomly chosen by the device controller, the variables including any one or more of a planned path, trajectory, target velocity, target acceleration, and target force for the exercise interface.

6. The physical training apparatus of claim 1, wherein the movement comprises any one or more actions selected from a group consisting of: a change in direction of the exercise interface's motion not caused by forces being applied to the exercise interface by the human trainee; a change in an amount of force applied by the actuators to the exercise interface not caused by a change in the forces being applied to the exercise interface by the human trainee; a change in a velocity of the exercise interface not caused by a change in the forces being applied by the human trainee to the exercise interface; and a change in acceleration of the exercise interface not caused by a change in the forces being applied by the human trainee to the exercise interface.

7. The physical training apparatus of claim 1, wherein the movement comprises any one or more actions selected from a group consisting of:

one or more planned paths, each of the one or more planned paths comprising at least one point within the device motion space for the exercise interface;

one or more target velocities for movement of the exercise interface, each of the one or more target velocities including at least one of a maximum velocity, a minimum velocity, and a set velocity; and one or more target forces to apply to the exercise interface.

8. The physical training apparatus of claim 1, wherein the movement further comprises at least two sequential movements, wherein the device controller moves the exercise interface from a first point in the device motion space to a second point within the device motion space and then from the second point to a third point within the device motion space that is different from the first point and the second point.

9. The physical training apparatus of claim 1, wherein the controller is further configured to enforce limits of the human trainee during execution of the exercise routine, wherein the limits of the human trainee comprise at least one or more limits of the actuators selected from a group consisting of:

a maximum value for position or travel;

a maximum value for velocity;

a maximum value for generated force; and a maximum value for acceleration.

10. A method for a physical training apparatus having an exercise interface configured to engage with a human trainee, which is coupled through an assembly of joints and actuators to a frame, the assembly of joints and actuators being configured to move the exercise interface relative to the frame in at least two degrees of freedom to any point within a device motion space having at least two dimensions, the physical training apparatus further including a device controller generating control signals for controlling movement of the assembly of joints and actuators to control motion of the exercise interface according to an exercise routine when the human trainee engages the exercise interface, the method comprising:

setting a first set of limits for the human trainee;

generating control signals to cause one or more actuators of the assembly of joints and actuators to control motion of the exercise interface when engaged by the human trainee; and limiting the motion of the exercise interface including enforcing at least one of the first set of limits during use of the physical training apparatus based at least in part on the first set of limits for the human trainee, wherein limiting the motion of the exercise interface includes one or more members selected from a group consisting of:

limiting the maximum values for travel or position of the actuators, limiting the maximum values for velocity of the actuators, limiting the maximum values for force applied by the actuators, and limiting the maximum values for acceleration of the actuators.

11. The method of claim 10, further comprising generating control signals to cause the exercise interface to move according to one or more planned paths, each planned path comprising at least one point within the device motion space for the exercise interface.

12. The method of claim 10, wherein limiting the motion of the exercise interface including limiting the maximum values for travel or position of the actuators involves enforcing a physical or virtual boundary with at least one of an upper bound or a lower bound different to a maximum range of travel of the actuators.

13. A physical training apparatus comprising:

a frame;

an assembly of joints and actuators supported by the frame and including a joint and an actuator;

an exercise interface rigidly coupled to the assembly of joints and actuators and configured to engage with a human trainee;

a sensor configured to detect an input, the input including one or more members selected from the group consisting of a motion of the joint, a position of the joint, a motion of the actuator, a position of the actuator, a motion of the exercise interface, a position of the exercise interface, a motion of the human trainee, and a position of the human trainee; and a controller configured to control motion of the assembly of joints and actuators to move the exercise interface in at least two degrees of freedom relative to the frame along an exercise routine path and adjust the exercise routine path based on the detected inputs to resist inputs applied to the exercise interface by the human trainee, wherein the motion of the joint includes a velocity and a force of the joint, the motion of the actuator includes a velocity and a force of the actuator, and the motion of the human trainee includes a velocity and a force of the human trainee.

14. The physical training apparatus of claim 13, wherein the exercise routine path includes a preset sequence of velocities and forces exerted by the assembly of joints and actuators to move the exercise interface, and wherein the controller is configured to change the preset sequence of velocities and forces randomly.

15. The physical training apparatus of claim 14, wherein the change to the preset sequence of velocities and forces includes at least one second input from a random number generator or a human trainer.

16. The physical training apparatus of claim 13, wherein the position and orientation of the exercise interface is fully defined relative to the frame by the assembly of joints and actuators.

17. The physical training apparatus of claim 13, wherein the controller is configured to control motion of the assembly of joints and actuators to actively resist inputs applied to the exercise interface by the human trainee.

18. The physical training apparatus of claim 13, wherein the exercise routine path includes a preset sequence of velocities and forces exerted by the assembly of joints and actuators to move the exercise interface, and wherein the controller is configured to change the preset sequence of velocities and forces in response to the input.

* * * * *